US012396516B2

(12) United States Patent
Macri'

(10) Patent No.: US 12,396,516 B2
(45) Date of Patent: Aug. 26, 2025

(54) MODULAR SYSTEM FOR COMPOSING FOOTWEAR ASSEMBLED BY COMBINING AT LEAST TWO INTERCHANGEABLE MODULES CONNECTED IN A REMOVABLE WAY BY CONNECTING MEANS

(71) Applicant: ZETAJAY S.R.L., Turin (IT)

(72) Inventor: Giacomo Macri', Turin (IT)

(73) Assignee: ZETAJAY S.R.L., Turin (IT)

( * ) Notice: Subject to any disclaimer, the term of this patent is extended or adjusted under 35 U.S.C. 154(b) by 0 days.

(21) Appl. No.: 18/697,142

(22) PCT Filed: Sep. 9, 2022

(86) PCT No.: PCT/IT2022/050245

§ 371 (c)(1),
(2) Date: Mar. 29, 2024

(87) PCT Pub. No.: WO2023/053152

PCT Pub. Date: Apr. 6, 2023

(65) Prior Publication Data

US 2024/0389712 A1 Nov. 28, 2024

(30) Foreign Application Priority Data

Sep. 30, 2021 (IT) ..... 102021000025187

(51) Int. Cl.
*A43B 3/24* (2006.01)
*A43B 13/36* (2006.01)
*A43B 23/02* (2006.01)

(52) U.S. Cl.
CPC ..... *A43B 13/36* (2013.01); *A43B 3/242* (2013.01); *A43B 3/244* (2013.01); *A43B 23/0245* (2013.01); *A43B 23/0295* (2013.01)

(58) Field of Classification Search
CPC ..... A43B 3/24; A43B 3/242; A43B 3/244; A43B 3/246; A43B 13/36; A43B 23/0295
(Continued)

(56) References Cited

U.S. PATENT DOCUMENTS 854,274 A * 5/1907 Crook et al. ..... A43B 7/20 36/100
2,200,080 A * 5/1940 Fein ..... A43B 3/24 36/15

(Continued)

FOREIGN PATENT DOCUMENTS

FR 1048994 A 12/1953
IT PN20060047 A1 12/2007

(Continued)

OTHER PUBLICATIONS

PCT Search Report dated Oct. 19, 2022 in connection with PCT Application No. PCT/IT2022/050245.

(Continued)

*Primary Examiner* — Marie D Bays
(74) *Attorney, Agent, or Firm* — Eschweiler & Potashnik, LLC

(57) ABSTRACT

A modular system is described for composing footwear assembled by combining at least two interchangeable modules connected in a removable way by connection means (66), the interchangeable modules comprising: a sole module (5, 13); an upper module (6, 14); a tab module (8); an ankle size adapter module (17, 18, 21, 23, 25, 27); a boot module (30, 32, 34, 36, 38, 40, 42, 44); a thigh size adapter module (46, 48, 51, 53); and a finishing module (7, 15, 19, 20, 22, 24, 26, 28, 31, 33, 35, 37, 39, 41, 43, 45, 47, 49, 52, 54).

16 Claims, 42 Drawing Sheets

(58) Field of Classification Search
USPC ..... 36/15, 100, 101
See application file for complete search history.

(56) References Cited

U.S. PATENT DOCUMENTS 5,848,484 A * 12/1998 Dupree ..... A43B 1/0081 36/114
8,065,821 B1 * 11/2011 Reid ..... A43B 3/242 36/100
2006/0117598 A1 * 6/2006 Czaplewski ..... A43B 3/242 36/7.1 R
2008/0072451 A1 * 3/2008 Mizrahi ..... A43B 1/0045 36/2.6
2008/0201988 A1 * 8/2008 Mattia ..... A43B 3/244 36/15
2010/0064551 A1 * 3/2010 Aldridge ..... A43B 7/12 36/2 R
2010/0186259 A1 * 7/2010 Garza ..... A43B 1/0081 36/55
2010/0275465 A1 * 11/2010 Reilly ..... A43B 3/242 36/4
2012/0047766 A1 * 3/2012 Moore ..... A43B 3/242 36/1.5
2012/0324656 A1 * 12/2012 Shu ..... A43B 3/244 12/146 B
2014/0013621 A1 * 1/2014 Dupree ..... A43B 3/242 36/100
2014/0041260 A1 * 2/2014 Jewell ..... A43B 1/0072 36/2 R
2014/0053432 A1 2/2014 Delaney
2014/0165425 A1 * 6/2014 Byam ..... A43B 1/0081 36/100
2015/0000160 A1 1/2015 Giraldo
2016/0150849 A1 * 6/2016 Cheung ..... A43B 23/06 36/100
2017/0340276 A1 * 11/2017 Noorzai ..... A43B 5/12
2018/0184753 A1 7/2018 Stillwagon
2018/0242681 A1 * 8/2018 Lovett ..... A43B 3/242
2018/0325208 A1 11/2018 Delaney
2019/0223555 A1 * 7/2019 Iannuzzi ..... A43B 1/0027
2019/0239593 A1 * 8/2019 Willis ..... A43B 3/242

FOREIGN PATENT DOCUMENTS

IT RM20100089 U1 11/2011
IT PC20150004 U1 8/2016
WO 2005007254 A2 1/2005

OTHER PUBLICATIONS

PCT Written Opinion dated Oct. 19, 2022 in connection with PCT Application No. PCT/IT2022/050245.

* cited by examiner

113

14
111
19
57
112
20
115

Fig.60
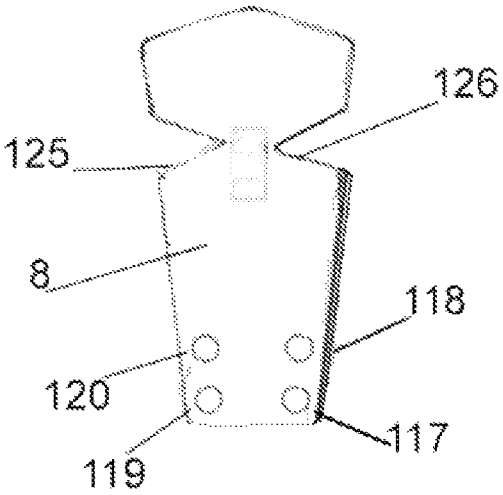
Fig.61
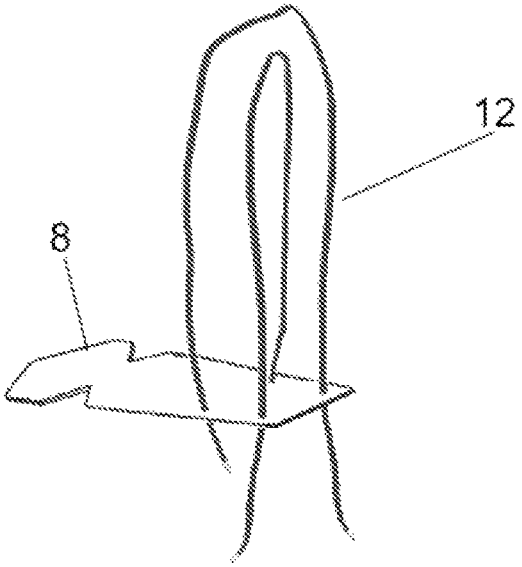
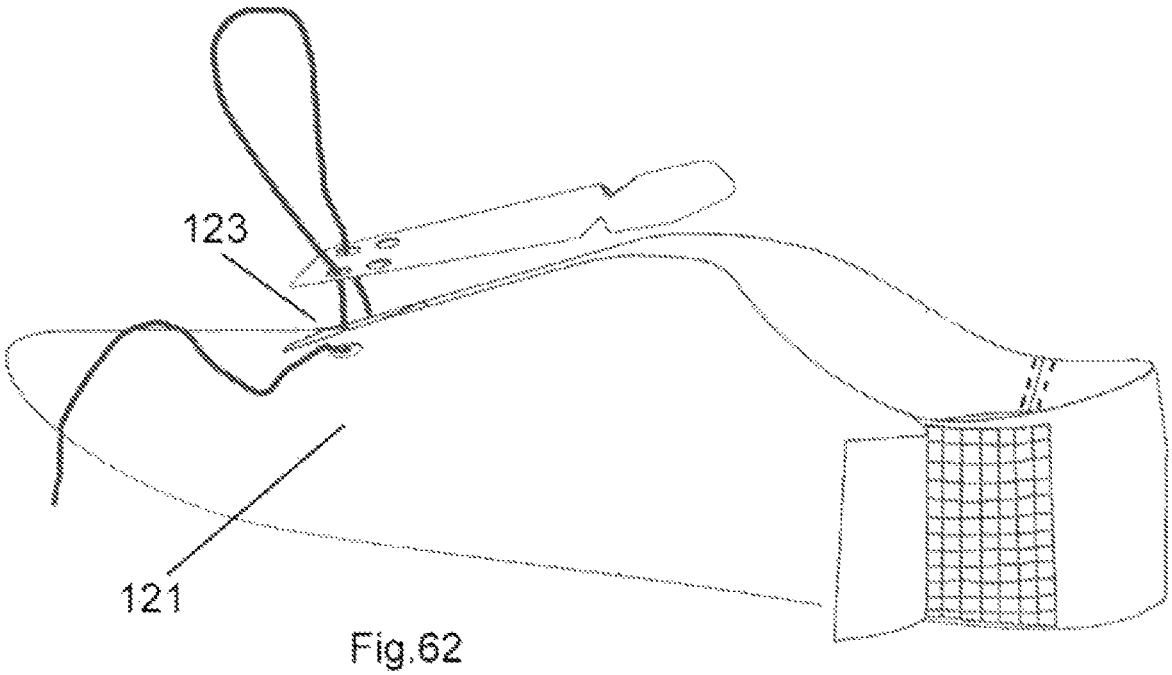
Fig.62

175

182

MODULAR SYSTEM FOR COMPOSING FOOTWEAR ASSEMBLED BY COMBINING AT LEAST TWO INTERCHANGEABLE MODULES CONNECTED IN A REMOVABLE WAY BY CONNECTING MEANS

CROSS-REFERENCE TO RELATED APPLICATIONS

This application is a National Phase entry application of International Patent Application No. PCT/IT2022/050245 filed Sep. 9, 2022, published as WO 2023/053152, which claims the benefit of and priority from Italian Patent Application No. 102021000025187 entitled "Sistema modulare per comporre calzature assemblate mediante la combinazione di almeno due moduli intercambiabili collegati in modo rimovibile da mezzi di connessione, metodo di confezionamento e relativa calzatura," filed Sep. 30, 2021, the entire disclosures of these prior applications are incorporated herein by reference.

The present invention relates to a modular system for composing footwear assembled by combining at least two interchangeable modules connected in a removable way by connection means.

In particular, the invention relates to a system of interchangeable, foldable and waterproof modules, joined together by shielded connection means, to create a modular shoe for men, women or children, which is highly performing and customizable, being able to be adapted to the fit of the single user and be easily transformed into another shoe with a different shape.

The sole module is joined in a removable way to the upper by a connection means shielded by two tapes glued and sewn to the perimeter edge of the sole, in turn joined to a midsole, designed to avoid deformation of the module itself, while the upper module is equipped with two shielded connection means located along the perimeter edges that engage it to the sole module and, if necessary, to additional upper modules, designed to create a shoe of different height, which have different geometries to accommodate the shape of the ankle/leg of the user. All modules are completed by a respective finishing module as well as by a double-headed rivet that allows the user to immediately identify both size and, when necessary, direction of attachment.

Many types of footwear are known in the prior art, differentiated from each other according to their seasonal use or according to their specific use. Each shoe comprises among its components the upper, that is the upper part of the shoe that wraps and completely or partially encloses the foot; the mounting insole; the sole and the heel as well as, lastly and possibly, a legging, or the height extension of the upper.

Generally, the upper is connected in a fixed manner to the insole and to the sole while the quarter-when present is in turn connected in a fixed manner to the upper, so that each shoe represents a product sold and conceived as a predetermined unit. This has, in fact, its own precise material and its own peculiar design. Such shoes have some drawbacks. For example, a user buys a product already pre-packaged from others, which he finds on the market and which best matches his needs and personal tastes. However, he will not be able to decide on the combination of colors and, in general, the design. This shoe is not versatile, that is, it is not able to adapt-even only aesthetically to the different moments of the day, especially for those who are forced to spend long periods away from home.

Furthermore, these shoes become unusable when the shoe is damaged even in a single part, such as, for example, the sole or upper, so that the user will have to purchase a new product.

The need has therefore arisen in the market for footwear that allows the user to customize them, which are cheaper, more ecological and respectful of the environment, avoiding unnecessary waste and wastage. The operators in the sector have therefore turned their attention to the field in question and the concept of interchangeability between the parts of the footwear, such as the sole and/or upper and/or leg, has already been introduced and developed for some time, in order to make it is possible and easy for a user to replace the parts of the shoe following wear or in accordance with the needs or tastes of fashion.

In fact, notoriously, part of the current state-of-the-art modular or sectional footwear is equipped with interchangeable parts that have tried to meet the aforementioned needs. For example, some solutions have been envisaged that provide for the interchangeability of the soles, connected in a removable way to the upper (RM94U000219 or FR1048994), and/or of the leg, also connected in a removable way to the upper (10201190200246 or 202010901841195). As means of connection between one part of the shoe and the other, some proposed solutions include the use of buttons, strings or Velcro® (202015902331000, 102012902074765 or 102015000083510), of interlocking systems (102006901422235), of screws (WO 2005/07254) or hinges (CN108158116, US20150000160 or US2008056283). The idea of the interchangeability of footwear components is not, therefore, completely new in the art, as well as double-sided modular footwear (US2018184753 or US20150000160) are also known. However, the aforementioned inventions have drawbacks.

Firstly, the mentioned shoes have not proved practical, aesthetically pleasing and the interchangeability of their components has not proved to be functional and/or easy. Indeed, these inventions, in the majority of cases, have not found a real production, given that their characteristics were not suitable for receiving a positive feedback from users such as to justify their large-scale commercialization.

Secondly, known modular shoes have not solved the problem of the greater deformability of the sole. A sole, in fact, during the walk, in the lateral parts where the shoe bends (n. 1-2 FIG. 1) and rises from the ground (n. 1-2, FIG. 3), is subjected to an internal lateral force (FIG. 4 and n. 3 FIG. 5) such that the shoe tends to deform and widen (n. 4, FIG. 6). As is known, in footwear conceived as a unit, said drawback is solved by wrapping and containing the affected area by means of the extension of the upper below the sole. On the other hand, in footwear with separable uppers, this will clearly not be possible due to the interchangeability of the upper so that the need has arisen to find a solution that makes the invention more resistant to deformation of the sole.

Furthermore, shoes designed to be double-sided do not allow an effective tip-up of the upper. For example, in patent n. US20150000160 the tip-up is bound to the presence of a sandal to protect the foot. In fact, the presence of tabs, laces or other aesthetic forms of the upper on the instep are annoying to the user when the module is overturned.

Otherwise, in patent n. US2018184,753 the upper module is linear and does not provide for any aesthetic solution such as those mentioned above (for example, laces and tabs) so that the module can be overturned and conform to the user's foot only thanks to a strap that surrounds the instep.

Finally, known footwear is not able to be perfectly adapted to the specific characteristics of the user's foot, ankle and leg. Clearly, modular shoes are the ones that could best solve this problem, but none of the inventions present in today's state of the art have proposed a solution.

The features of the invention, as claimed in claim 1, will be better understood by any skilled person in the art on the basis of the following description and the attached tables of drawings, provided as a non-limiting example, in which:

FIG. 60 is a front view of the tab module.

FIG. 61 represents a perspective view of the tab module with the laces.

FIG. 62 represents a perspective view of the upper module joined to the tab module.

The object of the present invention is, therefore, to create modular footwear through the use of different modules of easy production and use, which allow solving the aforementioned drawbacks with reference to the known art.

The invention of the modular system in question provides a user with the possibility of assembling an extremely versatile and optimal fit shoe, the latter being able to be adapted simply and quickly not only to the type of activity to be carried out, to personal taste or climate, but also and above all to the conformation of the ankle and leg and this simply by detaching and reattaching the individual modules. A further advantage is given by the possibility of being able to wash the individual modules easily and even individually, according to need.

The object of the present invention, in addition to those that will better appear below, therefore consists in having created a system of modules suitable for easily composing a modular, double-faced, highly performing shoe, waterproof and aesthetically pleasing if necessary. where the aforementioned modules, even when overturned, are packaged in such a way as to shield the connection elements (FIGS. 7-36).

Figure 37:
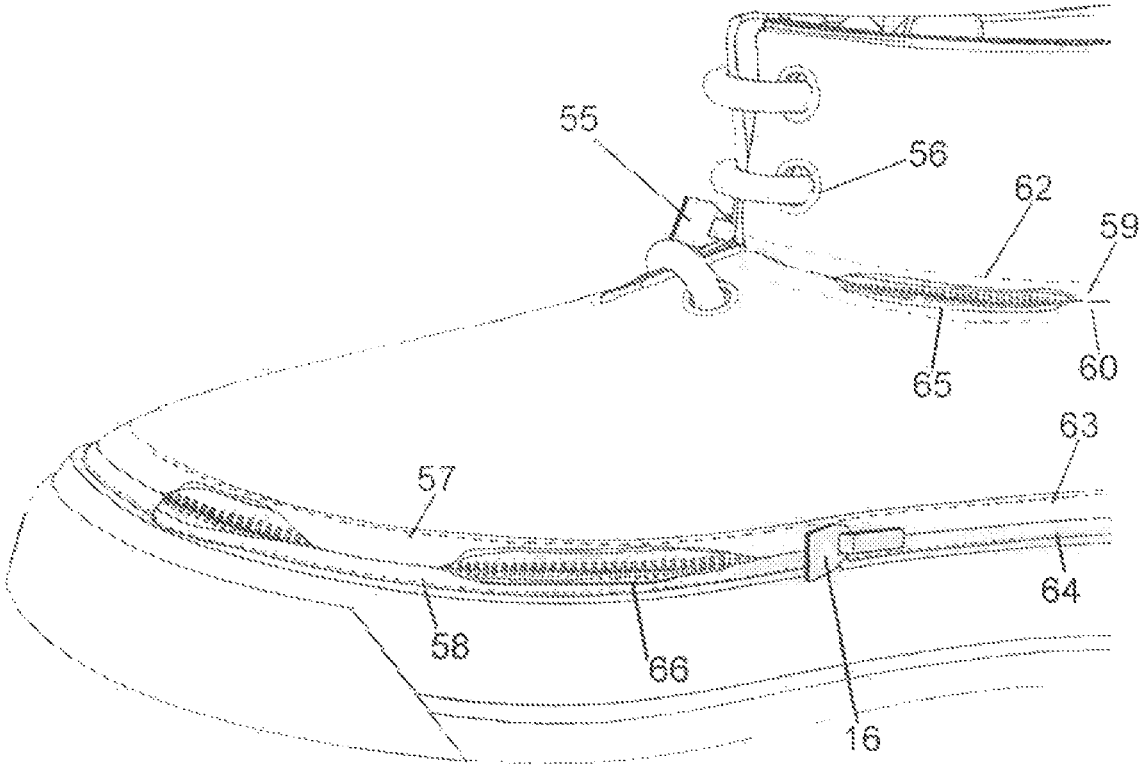
FIG. 37 represents a side view of the high shoe with the connection means partly shielded and partly visible.

In particular, the connection means are shielded on both their sides with peripheral flaps which also constitute the edges of each module of the system object of the present invention (for example, n. 57-60, FIG. 37 for the realization of the upper module).

Figure 38:
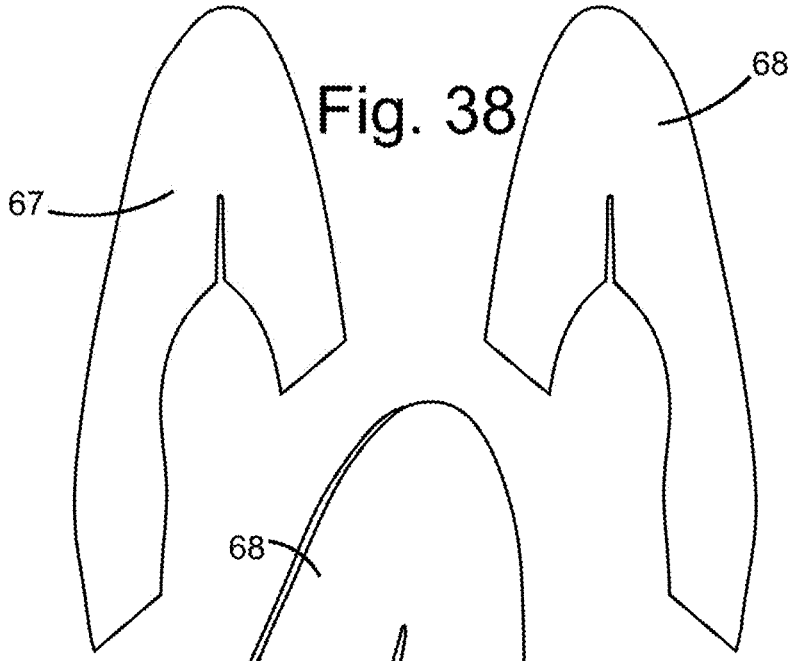
FIG. 38 represents a front view of the two shapes of the upper, left and right.
Figure 39:
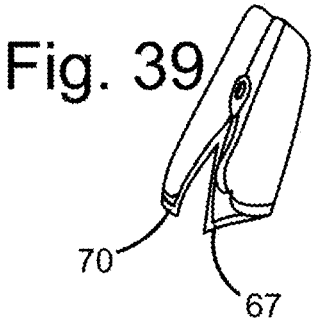
FIG. 39 represents a perspective view of a detail of the connection means shielded by the flaps created on the two shapes that make up the single module.
Figure 41:
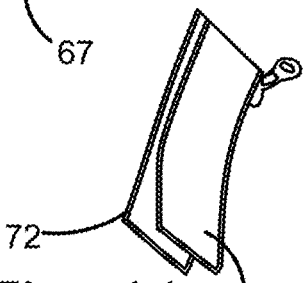
FIG. 41 represents a perspective view of a portion of the two shapes that make up the finishing module superimposed on each other with the positioning of the connection means.

As regards the packaging method, each module is created starting from two scraps of fabric (n. 67-68 FIG. 38), such as denim, leather, eco-leather or any other flexible material, of variable size and shape depending on the size and design that one wants to give to the module itself. Both shapes thus obtained, which can also be the result of the combination of several materials sewn together, are folded on themselves along their entire perimeter in such a way as to create a hem of about 1 cm/1.5 cm (n. 70, FIG. 39).

Figure 40:
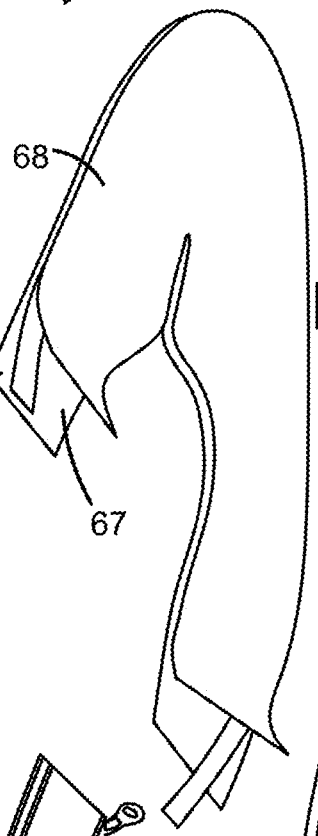
FIG. 40 represents a perspective view of the two shapes that make up the upper module superimposed on each other with the positioning of the webbing of the connection means.
Figure 42:
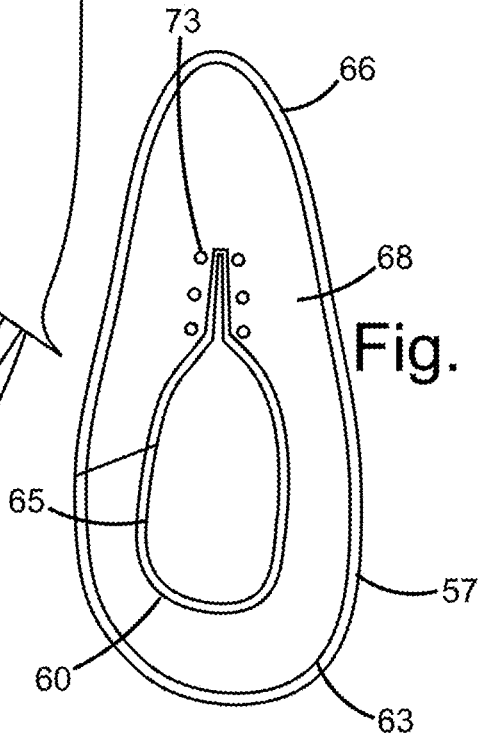
FIG. 42 represents a front view of the upper module.

Along the entire perimeter edge of the first shape that makes up the single module (n. 67, FIG. 40), the tape of the connection means is laid and pinned (n. 69, FIG. 40). At this point, the second template is positioned over the first template and the webbing (n. 68, FIG. 40), so that their edges match perfectly. These elements are then firmly joined together by means of a perimeter seam (n. 61 and 63, FIG. 42) which is performed at a minimum distance of about 5 mm from the outer edge of the two shapes, so as to create the respective peripheral flaps (n. 57 and 60, FIG. 42).

The particular positioning of the ends of the tape will be indicated in detail below with reference to the individual modules.

Figure 58:
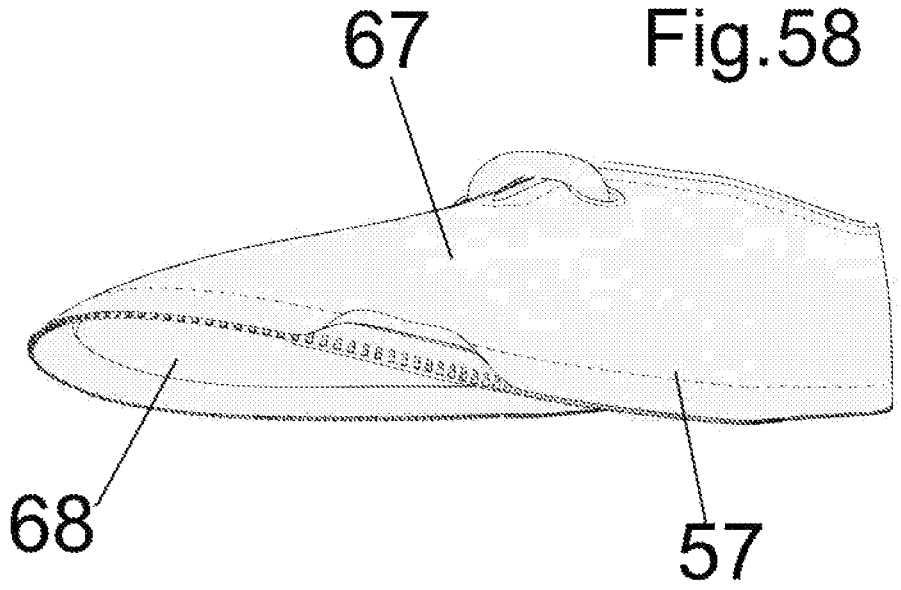
FIG. 58 represents a perspective view of the upper module with focus on the connecting means.
Figure 59:
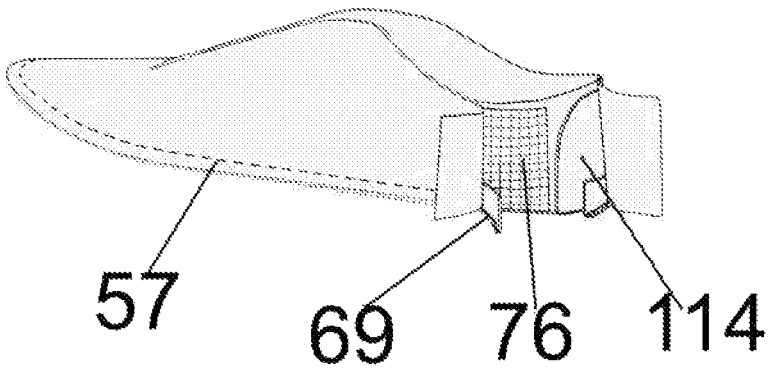
FIG. 59 represents a sectional perspective view of the upper module with a focus on the buttress, on the webbing of the connecting means and on the water-repellent fabric.
Figure 63:
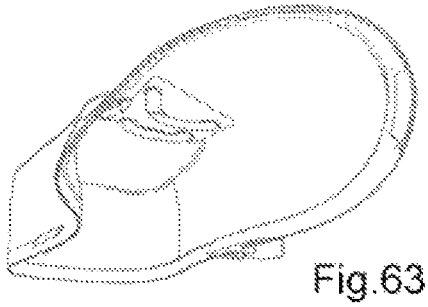
FIG. 63 represents a perspective view of the internal part of the upper module with tab module.
Figure 64:
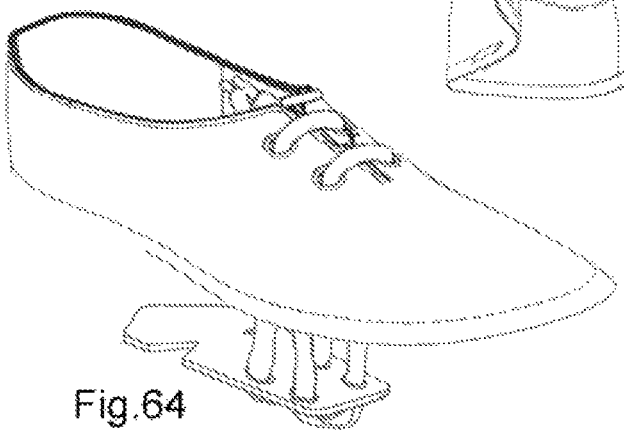
FIG. 64 represents an exploded perspective view of the sole module, the upper module and the tongue module.
Figure 65:
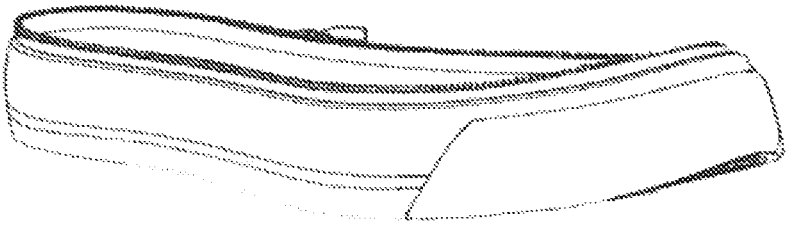
FIG. 65 represents a front view of the upper module with tab module, right and left.
Figure 65:
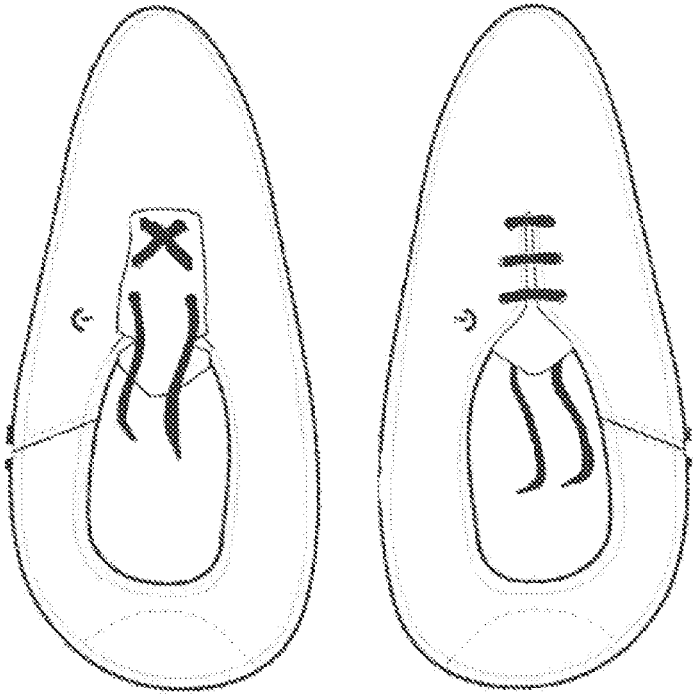
Figure 66:
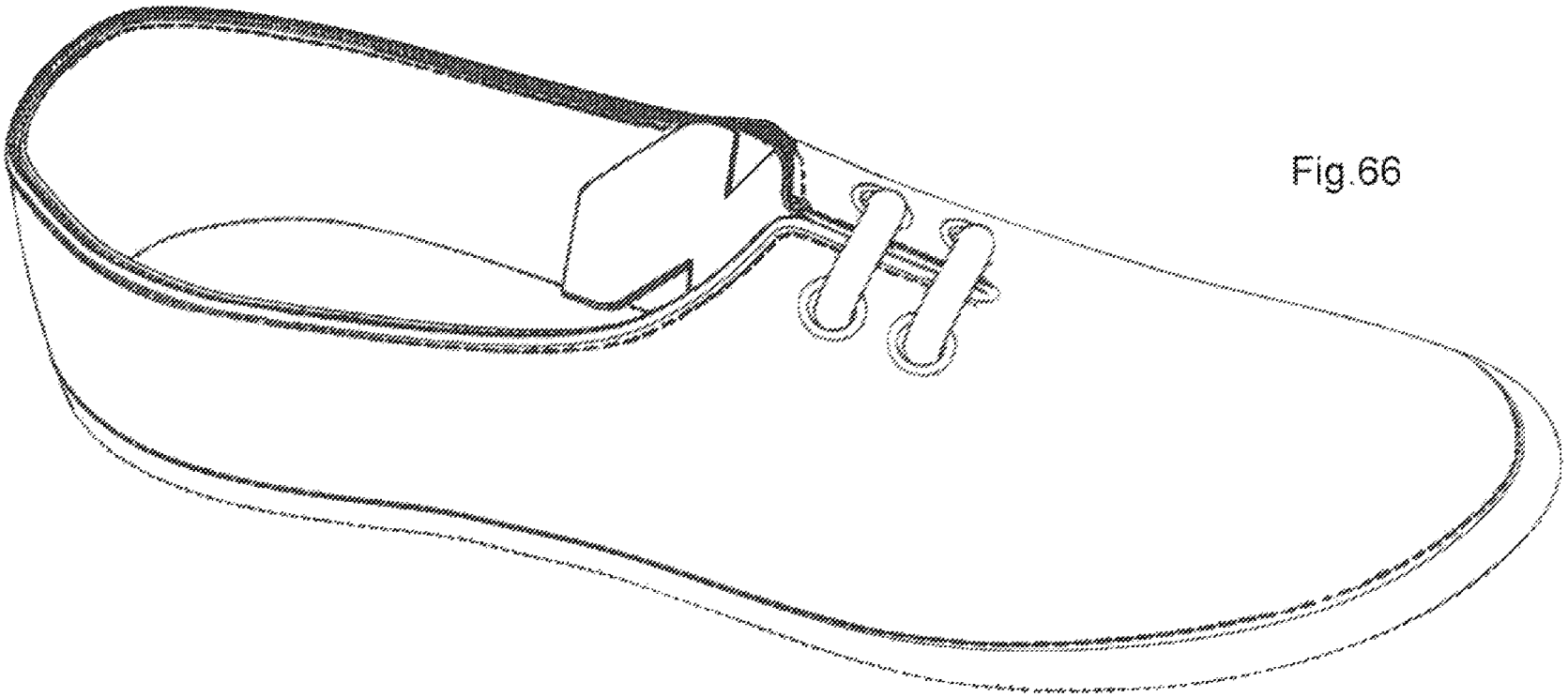
FIG. 66 represents a perspective view of the upper module joined to the tab module.

The presence in each module of the peripheral flaps covering the connection means will ensure that the user's foot and/or leg is always protected so that the shoe of the present invention can be worn consecutively for long periods without causing any damage to the user, by rubbing, given that the latter will always be in contact with the peripheral edges and never directly with the connection means (see for example FIGS. 58 and 63). Otherwise, in fact, the friction and rubbing of the connecting elements between the modules with the user's body would make the shoe non-functional and practical.

The presence of the peripheral flaps on both sides of the connection means performs the further important function of protecting the shoe from any impact avoiding wear and/or breakage of the latter. Any blows received by external agents are in fact cushioned by the aforementioned peripheral flaps and do not directly impact with the joining elements (FIG. 37).

Finally, the respect of the aesthetic requirement thus obtained will also be appreciated by the user. Given that each means of connection between the modules of this shoe is completely shielded from the outside, when they are mutually engaged, a unitary shoe will be seen (see for example FIG. 43).

Of course, the embodiments described here should not be construed as being limited to the examples set out and all modifications, equivalents, alternatives falling within the scope of the attached claims must be included.

Figure 7:
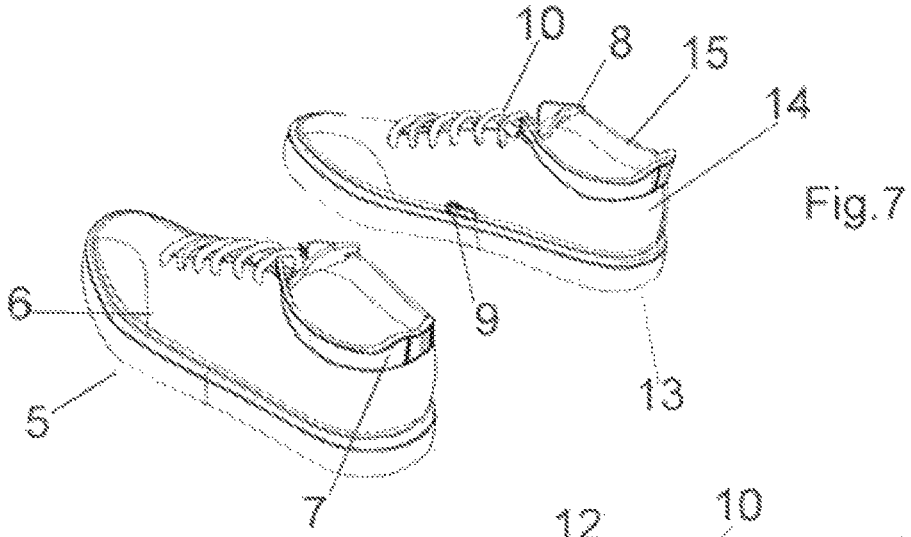
FIG. 7 represents an assembled perspective view of the basic shoe according to the present invention, including the sole module, the upper module and the finishing module.
Figure 8:
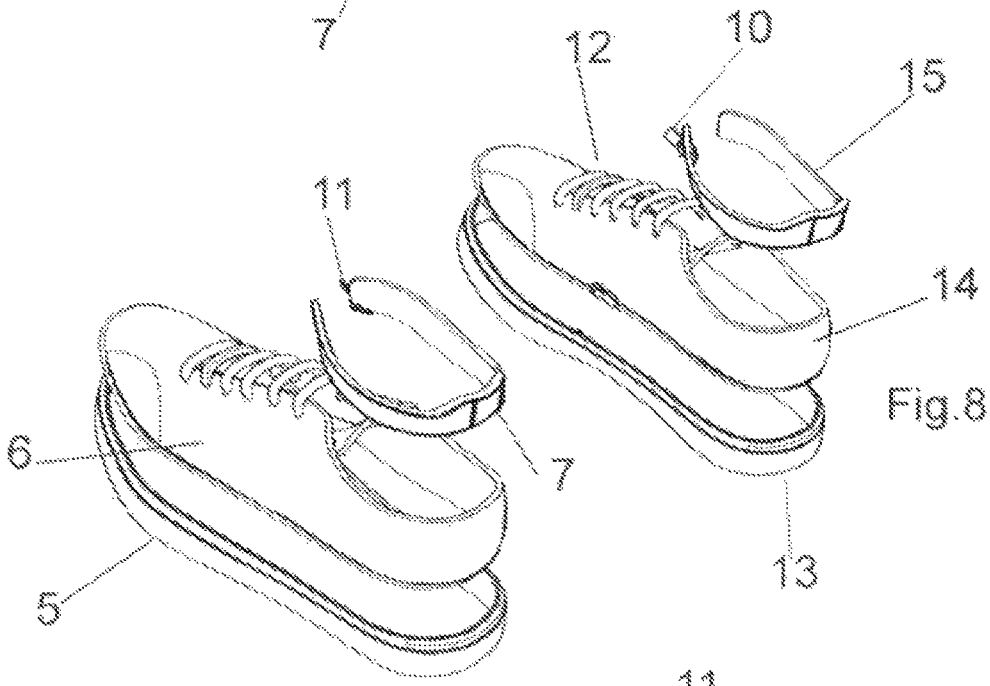
FIG. 8 represents an exploded view of the basic shoe according to the present invention, including the sole module, the upper module and the finishing module.
Figure 9:
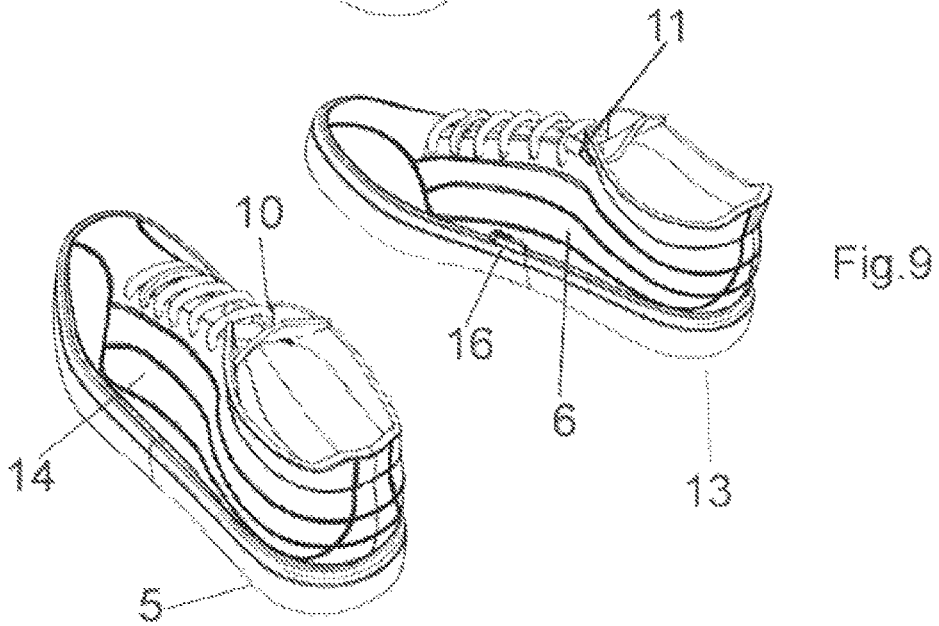
FIG. 9 represents an assembled perspective view of the basic shoe according to the present invention, including the sole module, the upper module and the finishing module, overturned.
Figure 10:
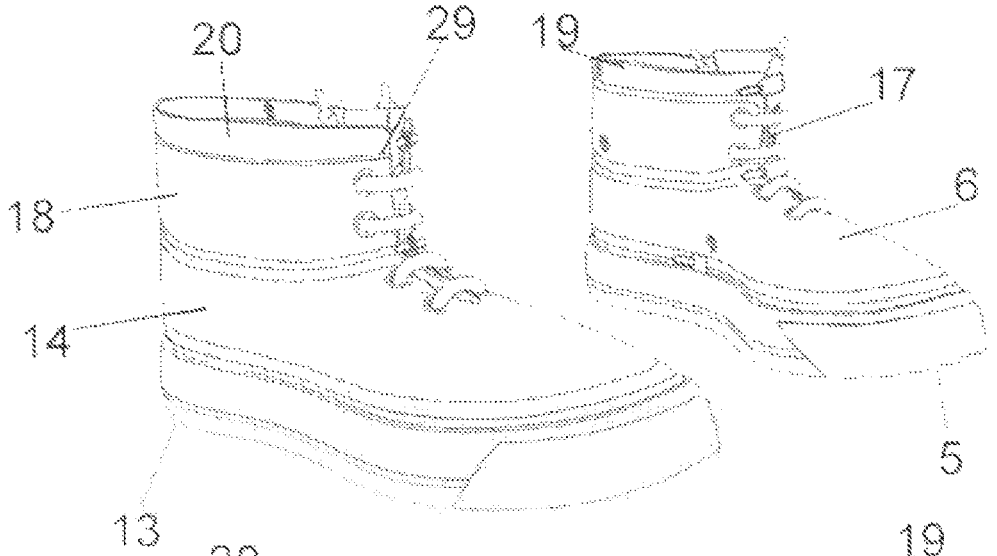
FIG. 10 represents an assembled perspective view of the high shoe according to the present invention, including the sole module, the upper module, the regular ankle-cutting adapter module and the finishing module.

Now, it will be understood that each module is double-sided, i.e. foldable, since each of the two sides can be used by the user as the outside of the shoe (see, for example, FIGS. 7-9). Each side of the module is in fact constructed in the same way and is formed by a shape with the aforementioned peripheral flaps at the edges that cover the connection means so that both sides have the same aesthetic appearance, albeit formed by different fabrics and/or materials (see for example, FIGS. 10-12). Therefore, no module has the typical lining of footwear known in the current state of the art and the obvious advantage is that a single module can form two different shoes (see for example, FIGS. 19-21).

The innovation of the present invention consists in having created a system of double-sided modules, which can be easily industrialized and otherwise aesthetically pleasing. The double-sided shoe assembled and produced according to the present invention can take on any aesthetic aspect and can have tongues and laces (FIGS. 7, 10, 19, FIG. 43) without the need to have fixed structures on the sole to protect the foot, when, for example, it is the upper module that is overturned (US20150000160).

As indicated above, in fact, the double-face modules of currently known footwear do such not allow industrialization and do not allow exploiting all the aesthetic potential of a shoe, so much so that the final shoe, for example, only assumes the shape of a slipper or, when an attempt has been made to insert laces or other aesthetic elements of the upper, is heavier, requiring compulsory structures (such as sandals) to protect the foot.

The innovation of the present invention therefore consists in having created a modular system compatible with any aspect of the shoe, in accordance with the multiple needs, including aesthetic ones, of the user (FIGS. 7, 10, 19, 28, 43).

Figure 44:
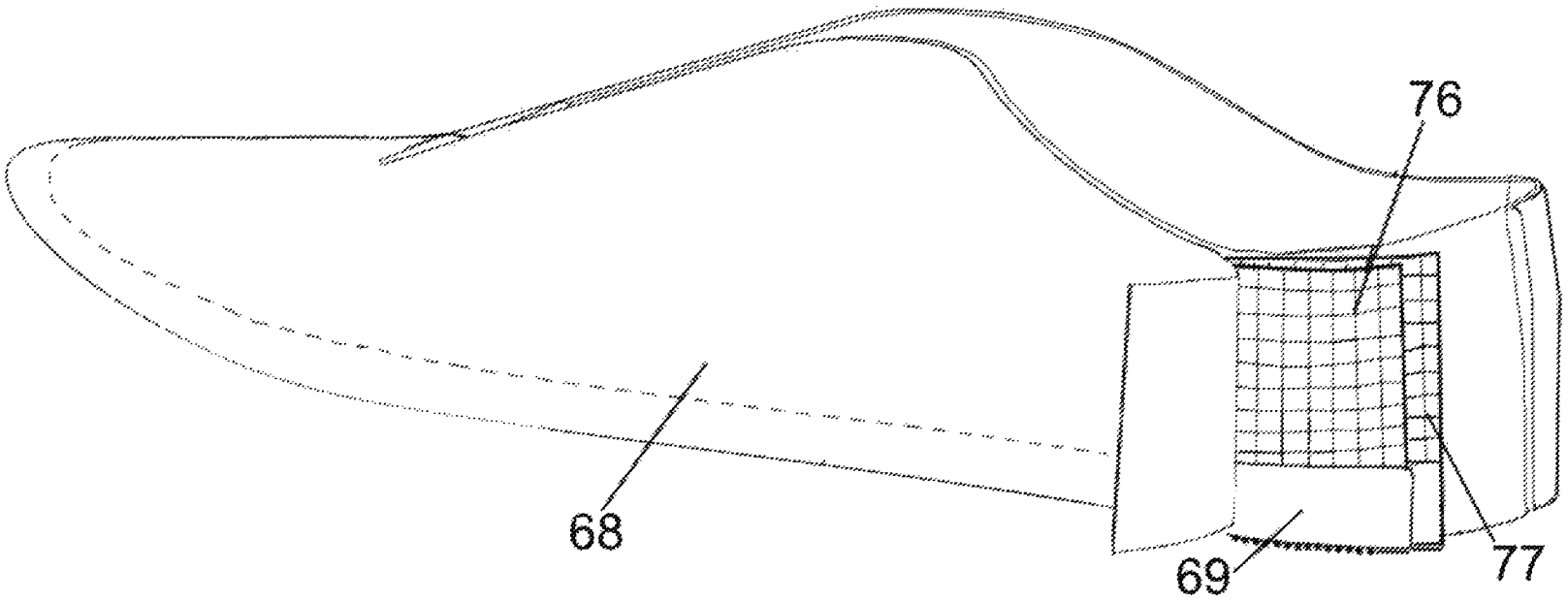
FIG. 44 represents a sectional side view of the upper module with a focus on the webbing of the connecting means and on the water-repellent fabric.

When the modules are made waterproof, a water-repellent fabric, such as Ripstop (n. 76-77, FIG. 44) of the same shape as the shapes and with a surface that extends up to the edge of the peripheral edges, is inserted and sewn between the two aforementioned shapes. In particular, the respective waterproof fabric (n. 76-77, FIG. 44) is positioned on each template (n. 67-68, FIG. 44) and the peripheral flap is sewn with it. Thereafter, the same method of packaging the module is followed, consisting in sewing together the shapes and the tape of the connection means. Therefore, each module is formed by four superimposed shapes where the two external ones—always present (n. 67-68, FIG. 38)—represent the aesthetic aspect while the internal ones—optional (n. 76-77, FIG. 44)—have the function of making the module waterproof.

Figure 45:
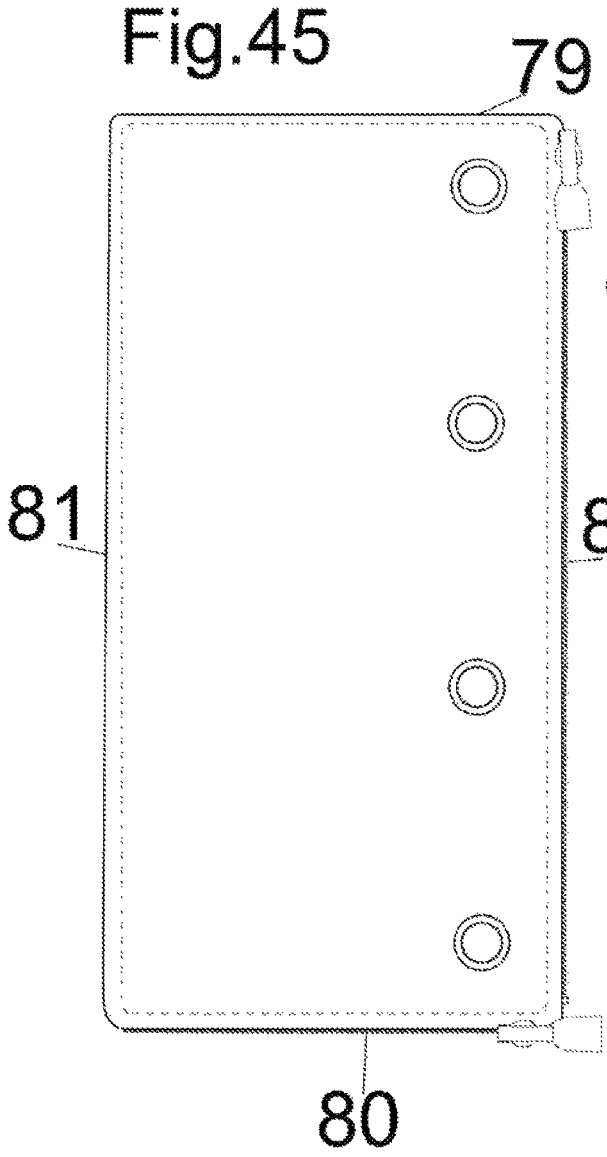
FIG. 45 represents a front view of the boot module with vertical closure by means of a zip and laces.

It will certainly be understood that each module of the present invention is structurally two-dimensional (FIG. 45). The three-dimensional shape is in fact acquired by them when they are engaged with each other (see for example, FIG. 46, 19-21). This means that each module, taken individually, has a flat structure and takes on a three-dimensional shape only when combined with the others at the time of assembly and creation of the shoe.

Figure 32:
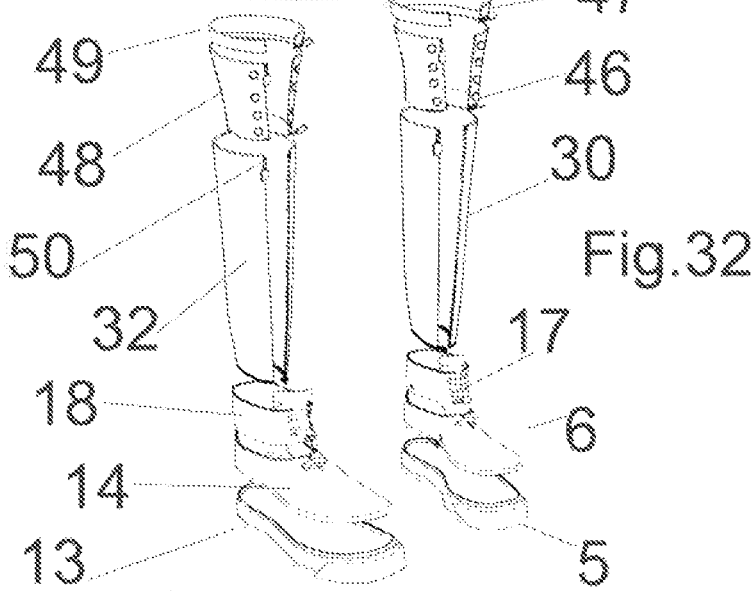
FIG. 32 represents an exploded view of the thigh-high boot according to the present invention, including the sole module, the upper module, the ankle size adapter module, the boot module, the regular thigh size adapter module and the finishing module.
Figure 33:
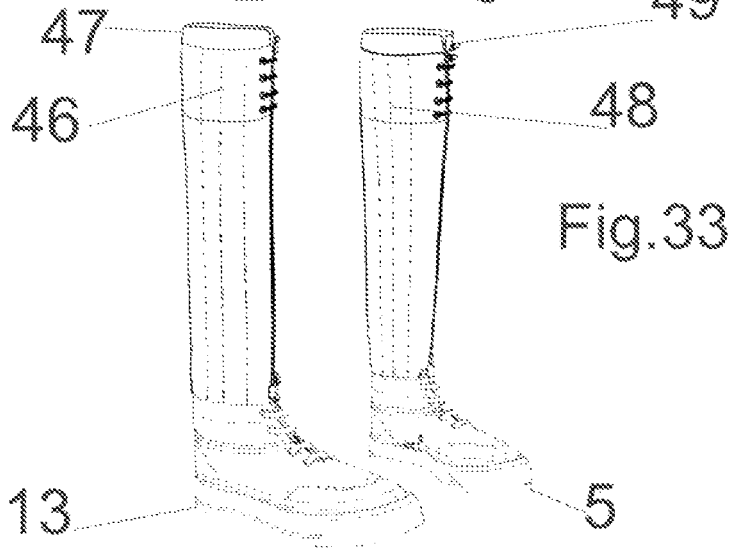
FIG. 33 represents an assembled perspective view of the thigh-high boot according to the present invention, including the sole module, the upper module, the ankle size adapter module, the boot module, the regular thigh size adapter module and the overturned finishing module.

Specifically, the modular system of the present invention consists of modules called—starting from the bottom upwards—sole module (n. 5 and 13, FIG. 32), upper module (n. 6 and 14, FIG. 32), ankle size adapter module (n. 17 and 18, FIG. 32), boot module (n. 30 and 32, FIG. 32), thigh size adapter module (n. 46 and 48, FIG. 32).

Figure 11:
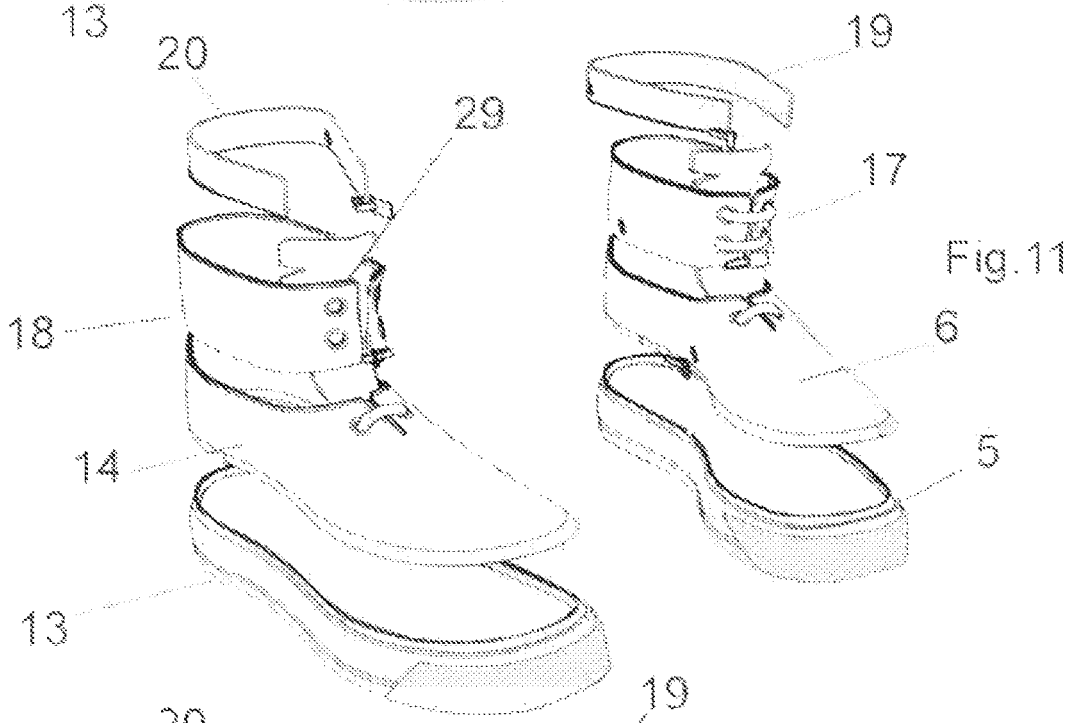
FIG. 11 represents an exploded view of the high shoe according to the present invention, including the sole module, the upper module, the regular ankle-cutting adapter module and the finishing module.
Figure 12:
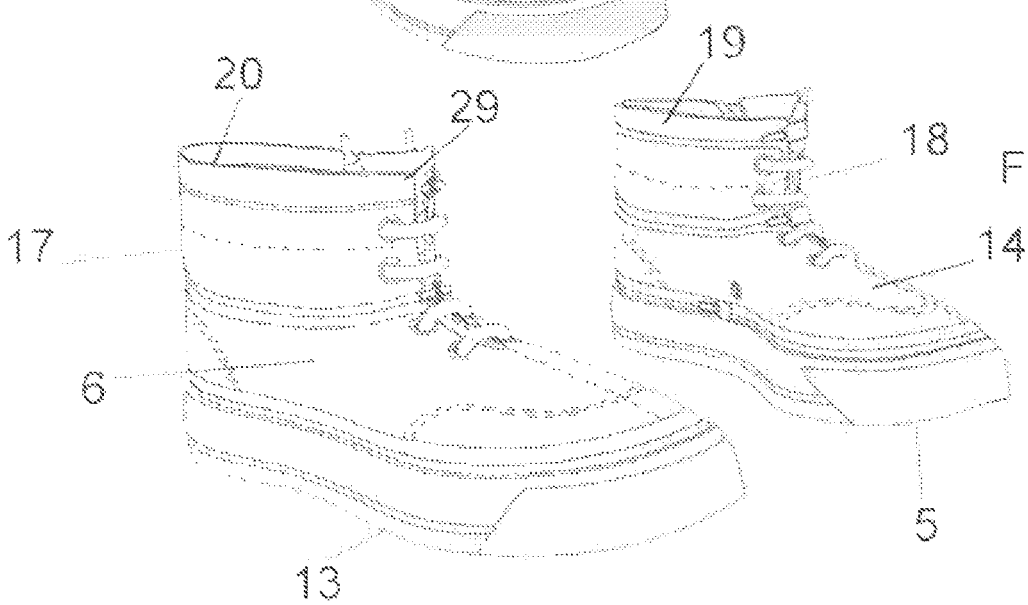
FIG. 12 represents an assembled perspective view of the tall shoe according to the present invention, including the sole module, the upper module, the regular ankle-cutting adapter module and the overturned finishing module.
Figure 13:
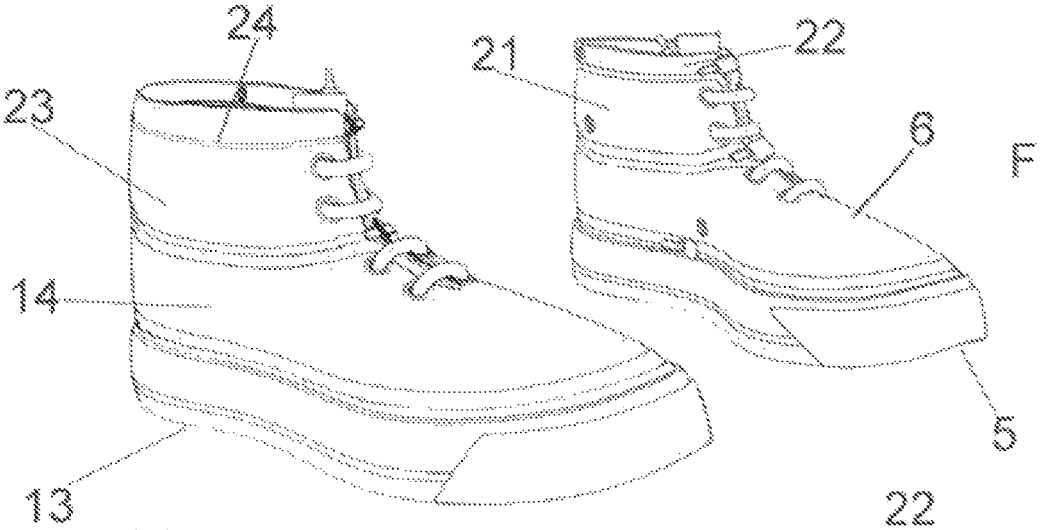
FIG. 13 represents an assembled perspective view of the high shoe according to the present invention, including the sole module, the upper module, the small ankle size adapter module and the finishing module.
Figure 14:
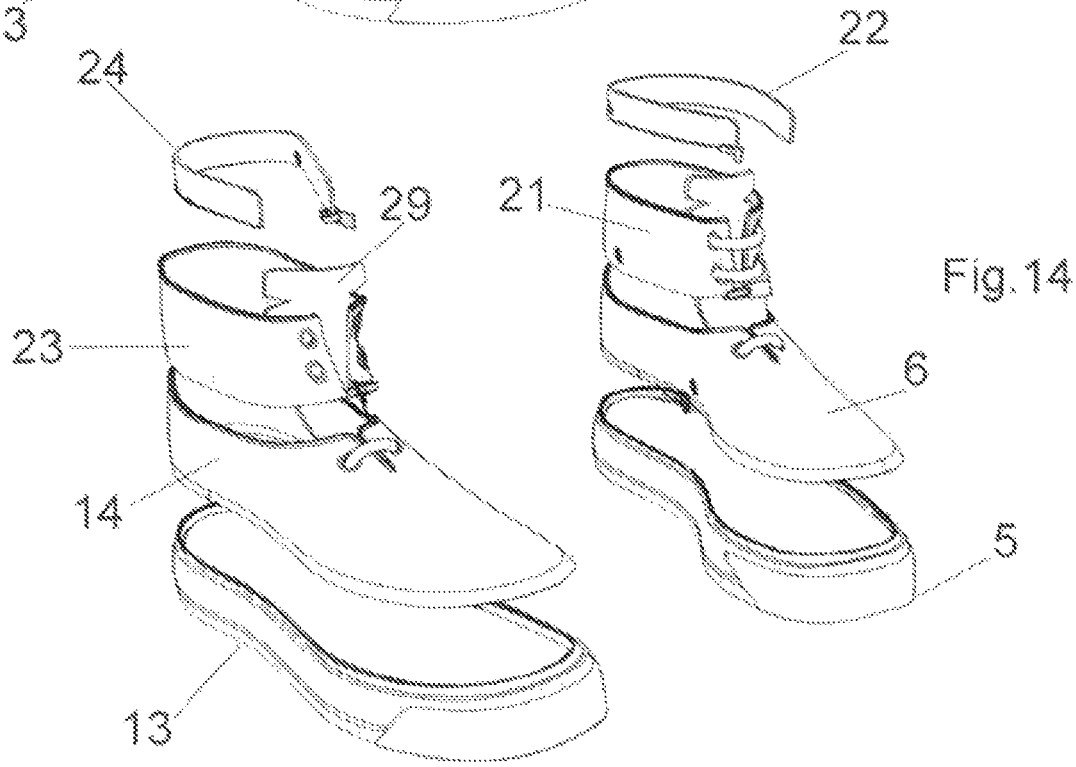
FIG. 14 represents an exploded view of the high shoe according to the present invention, including the sole module, the upper module, the small ankle size adapter module and the finishing module.
Figure 15:
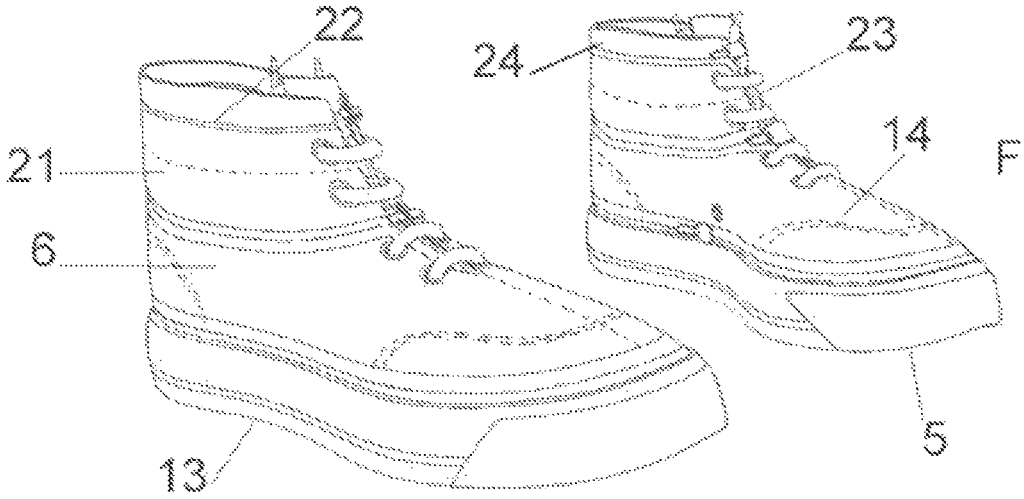
FIG. 15 represents an assembled perspective view of the tall shoe according to the present invention, including the sole module, the upper module, the small ankle size adapter module and the overturned finishing module.
Figure 16:
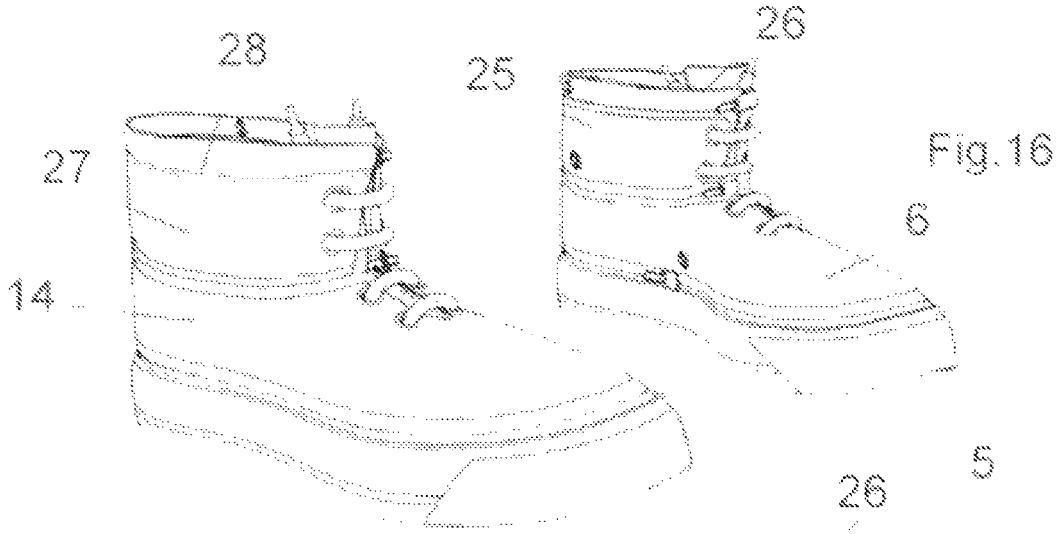
FIG. 16 represents an assembled perspective view of the high shoe according to the present invention, including the sole module, the upper module, the wide ankle size adapter module and the finishing module.
Figure 17:
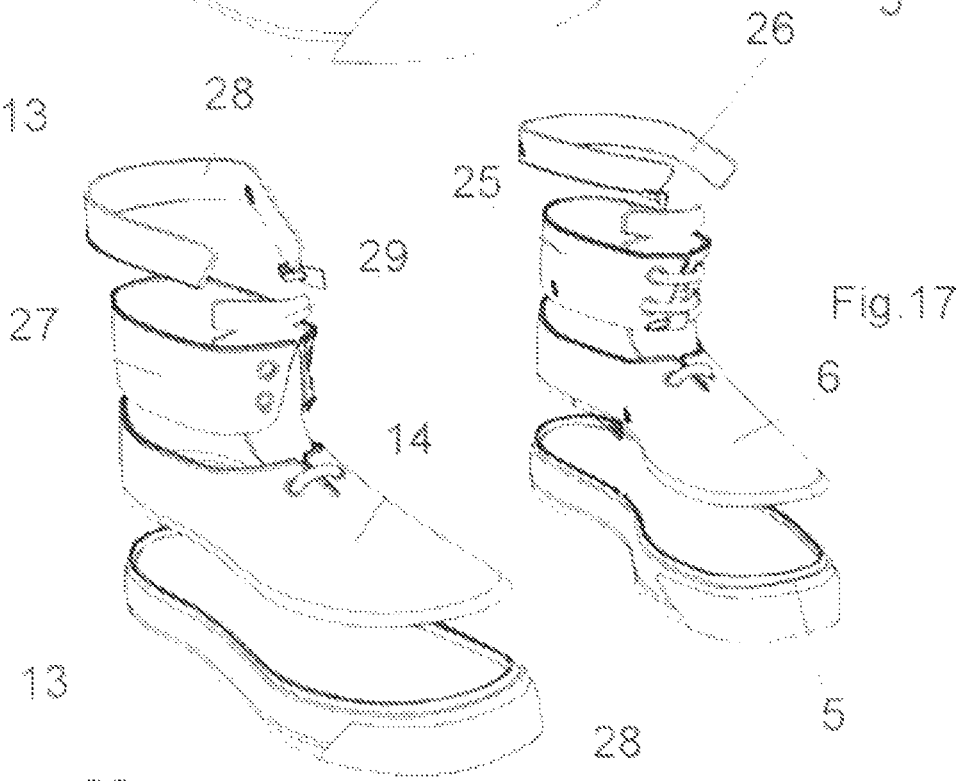
FIG. 17 represents an exploded view of the high shoe according to the present invention, including the sole module, the upper module, the wide ankle-cutting adapter module and the finishing module.
Figure 18:
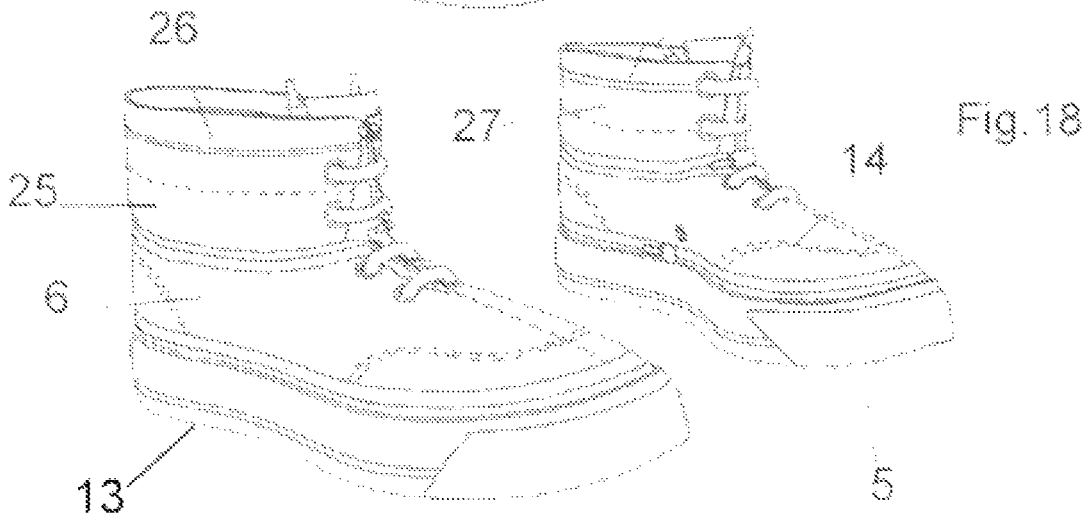
FIG. 18 represents an assembled perspective view of the high shoe according to the present invention, including the sole module, the upper module, the wide ankle size adapter module and the overturned finishing module.
Figure 20:
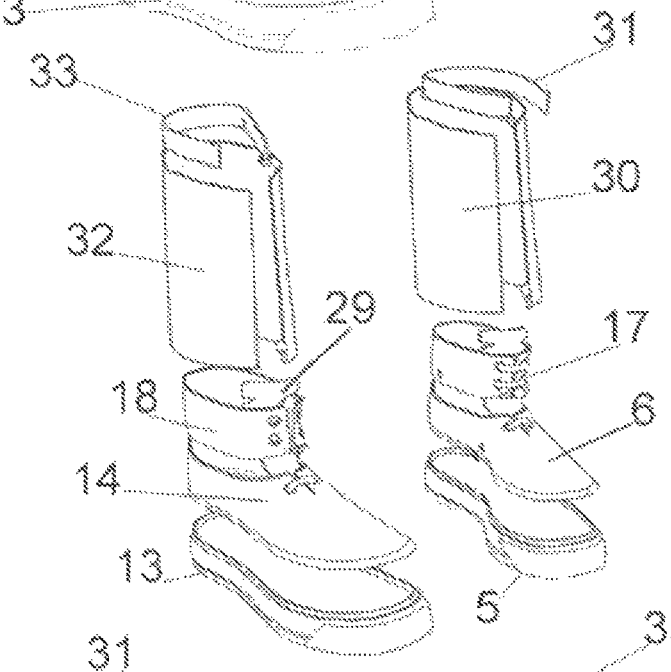
FIG. 20 represents an exploded view of the boot according to the present invention, including the sole module, the upper module, the regular ankle size adapter module, the regular size boot module and the finishing module.
Figure 23:
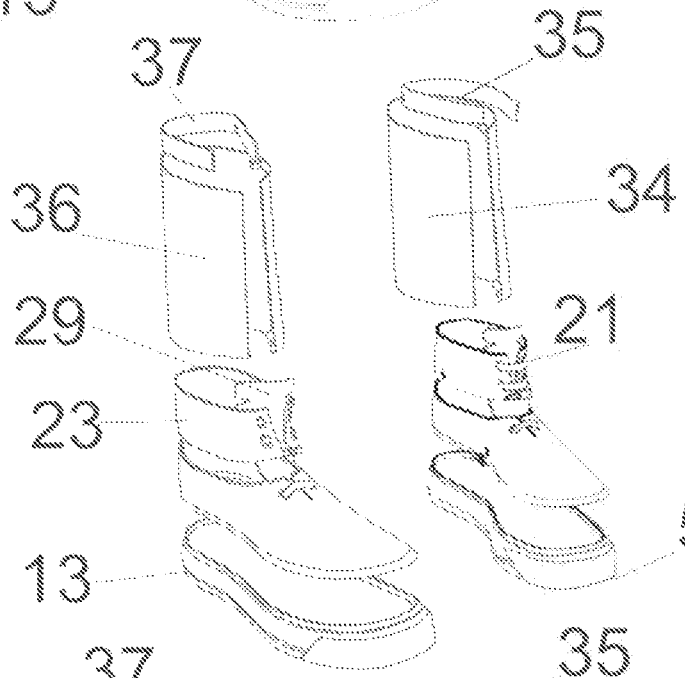
FIG. 23 represents an exploded view of the boot according to the present invention, including the sole module, the upper module, the small ankle size adapter module, the small size boot module and the finishing module.
Figure 24:
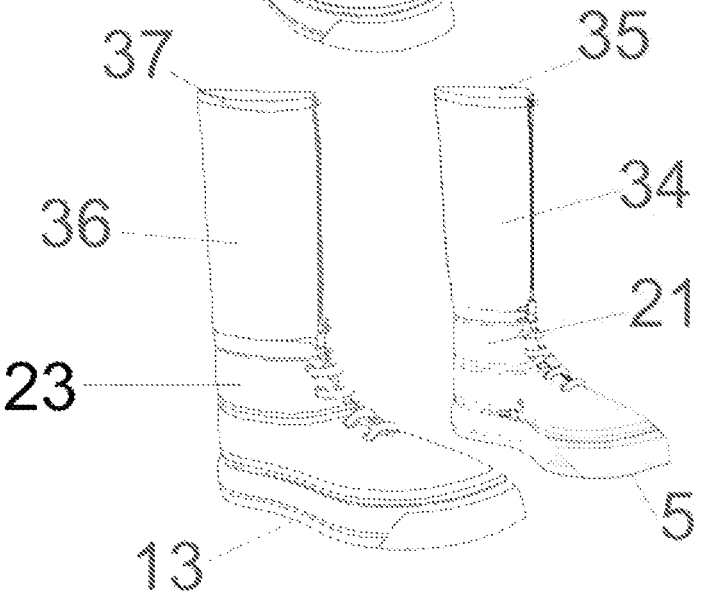
FIG. 24 represents an assembled perspective view of the boot according to the present invention, including the sole module, the upper module, the small ankle size adapter module, the small size boot module and the overturned finishing module.
Figure 25:
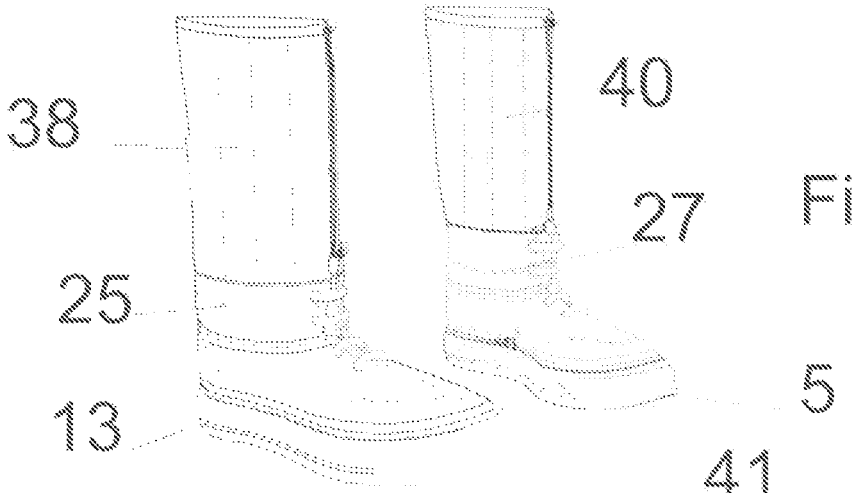
FIG. 25 represents an assembled perspective view of the boot according to the present invention, including the sole module, the upper module, the wide ankle size adapter module, the wide size boot module and the finishing module.
Figure 26:
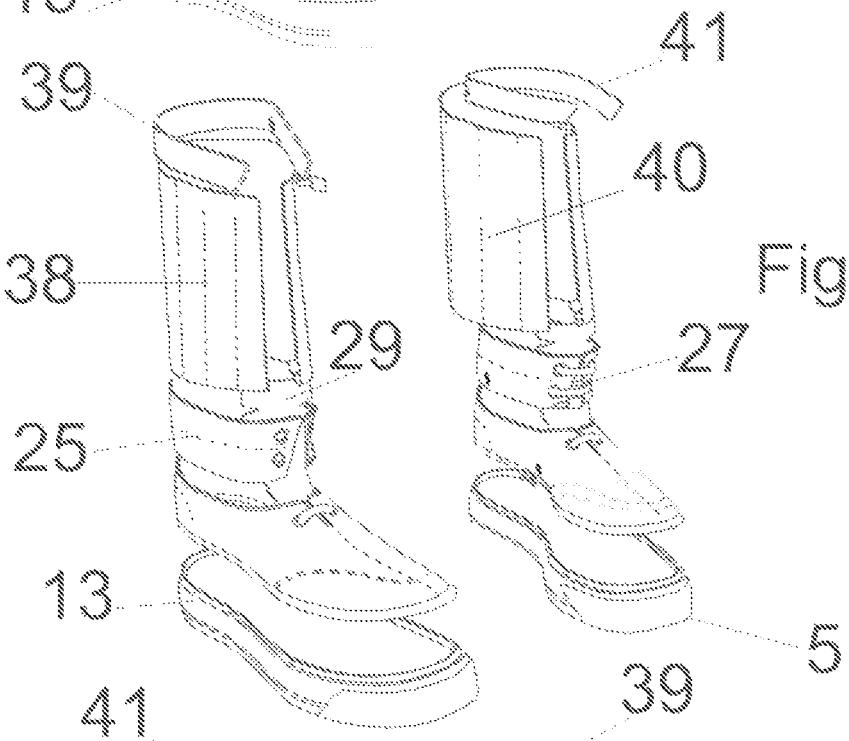
FIG. 26 represents an exploded view of the boot according to the present invention, including the sole module, the upper module, the wide ankle size adapter module, the wide size boot module and the finishing module.
Figure 27:
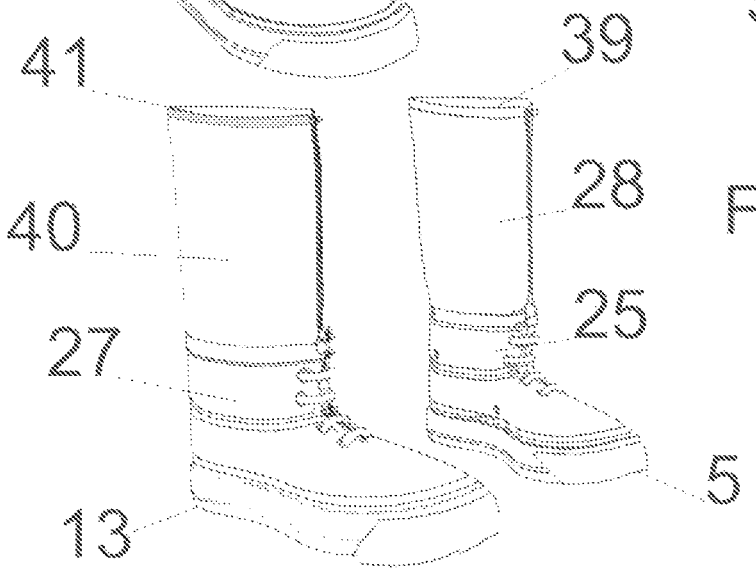
FIG. 27 represents an assembled perspective view of the boot according to the present invention, including the sole module, the upper module, the wide ankle size adapter module, the large size boot module and the overturned finishing module.
Figure 29:
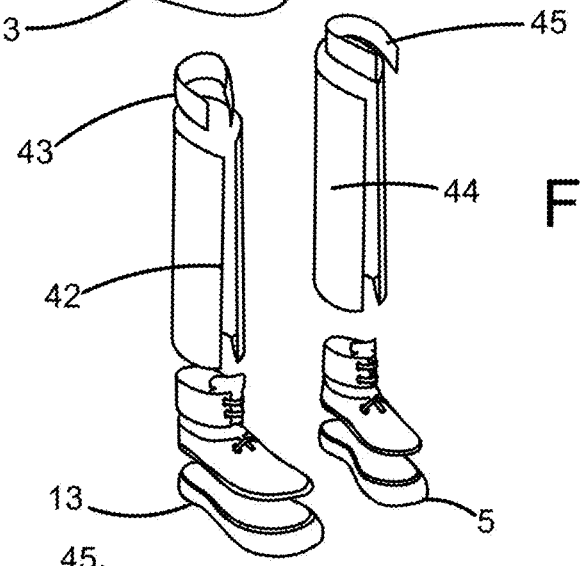
FIG. 29 represents an exploded view of the boot according to the present invention with thigh-high boot module.
Figure 35:
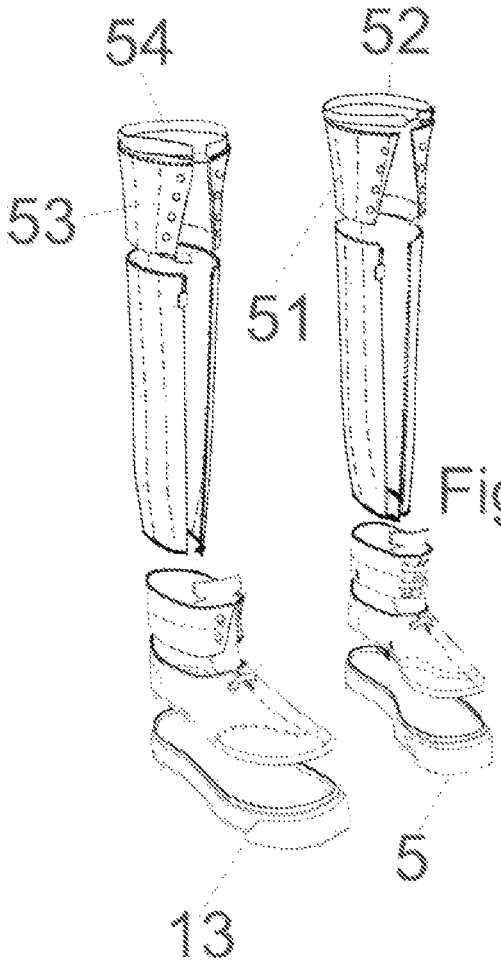
FIG. 35 represents an exploded view of the thigh-high boot according to the present invention, including the sole module, the upper module, the ankle size adapter module, the boot module, the wide thigh size adapter module and the finishing module.
Figure 36:
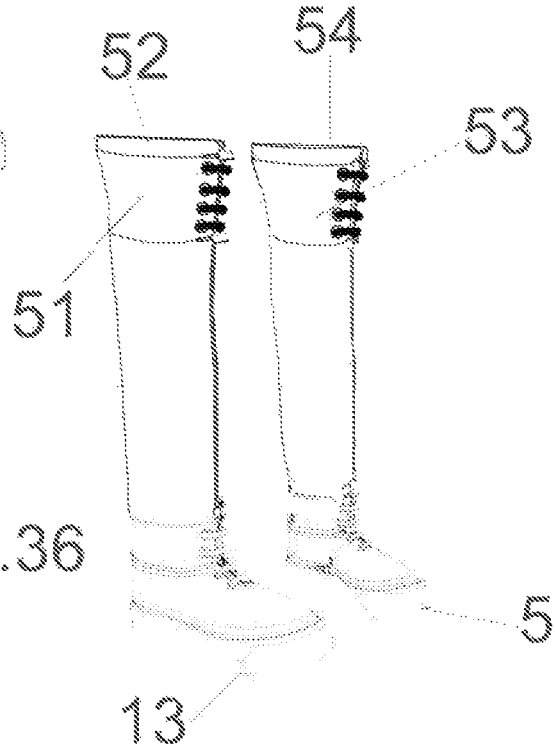
FIG. 36 represents an assembled perspective view of the thigh-high boot according to the present invention, including the sole module, the upper module, the ankle size adapter module, the boot module, the wide thigh size adapter module and the overturned finishing module.

Each terminal module chosen by the user will have its specific finishing module with the aim of making the module chosen by the user to assemble the shoe more aesthetically pleasing (n.7 and 15, FIGS. 8, n.19-20, FIGS. 11, n. 22 and 24 FIGS. 14, n. 26 and 28 FIGS. 17, n. 31 and 33 FIGS. 20, n. 35 and 37 FIGS. 23, n. 39 and 41 FIGS. 26, n. 43 and 45 FIGS. 29, n. 49 and 47 FIGS. 32, n. 52 and 54 FIG. 35).

Figure 19:
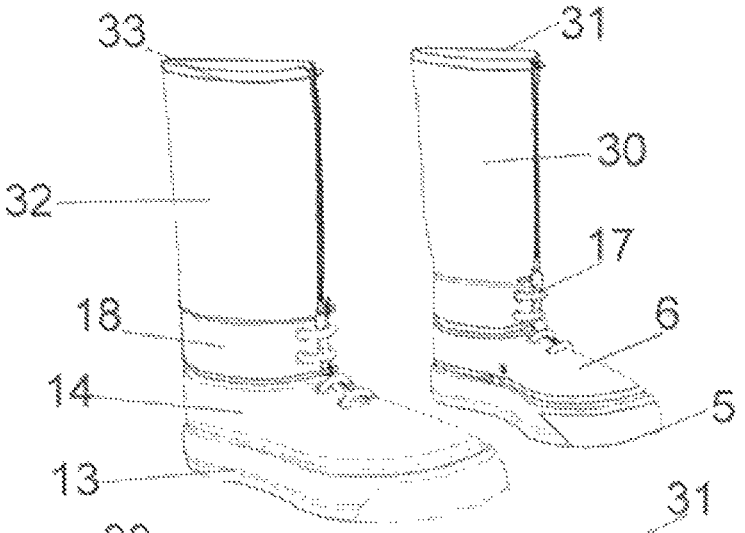
FIG. 19 represents an assembled perspective view of the boot according to the present invention, including the sole module, the upper module, the regular ankle size adapter module, the regular size boot module and the finishing module.
Figure 28:
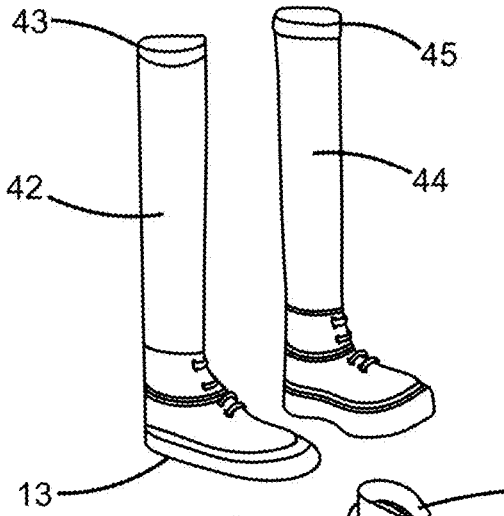
FIG. 28 represents an assembled perspective view of the boot according to the present invention with thigh-high boot module.
Figure 31:
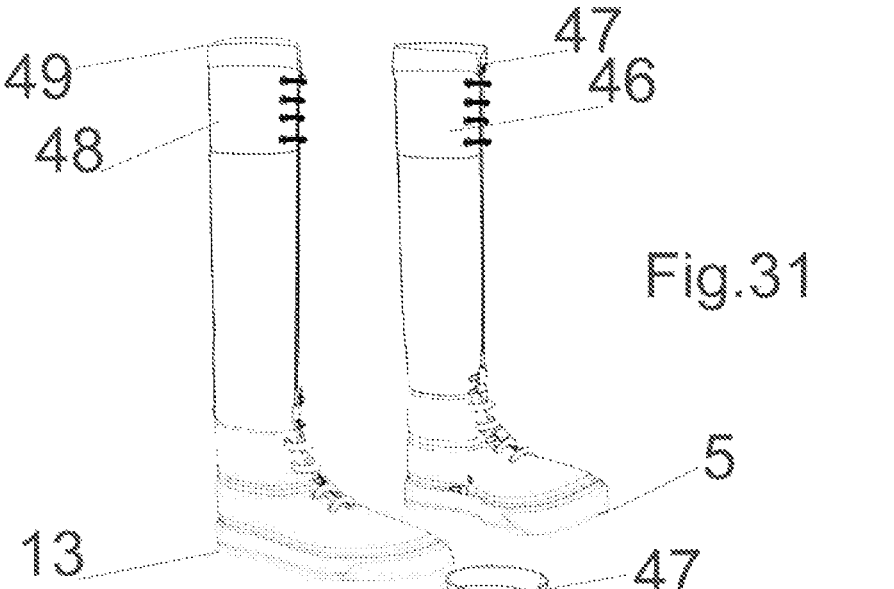
FIG. 31 represents an assembled perspective view of the thigh-high boot according to the present invention, including the sole module, the upper module, the ankle size adapter module, the boot module, the regular thigh size adapter module and the finishing module.

This will allow the user to create, according to his needs, a low shoe (FIG. 7), at ankle height (FIG. 10) or a boot of variable height (FIGS. 19, 28 and 31).

Each of these modules has a particular structure and a packaging method designed ad hoc to solve technical and/or aesthetic problems depending on their location within the shoe.

As indicated above, one of the problems affecting a modular shoe is that of the greater deformability of the sole during the user's walk, which also affects its resistance over time.

The innovation of the present invention is therefore that of having designed a sole capable of resisting the various deforming lateral pressures caused by the movement of the foot during walking (FIGS. 1-6), undoubtedly greater due to the separation of the upper from the sole, realized thanks to the connection means placed, on one side, along the entire upper perimeter of the sole and, on the other, on the lower one of the upper.

As is known, in footwear conceived as a unit, the deforming effect of the sole is counteracted by wrapping and containing the affected area by means of the extension of the upper inside the sole, something that cannot clearly be possible in the footwear of the present invention, in light of the interchangeability of the upper.

In the shoe of the present invention, the sole module must be packaged according to the following methods.

Sole Module

Figure 47:
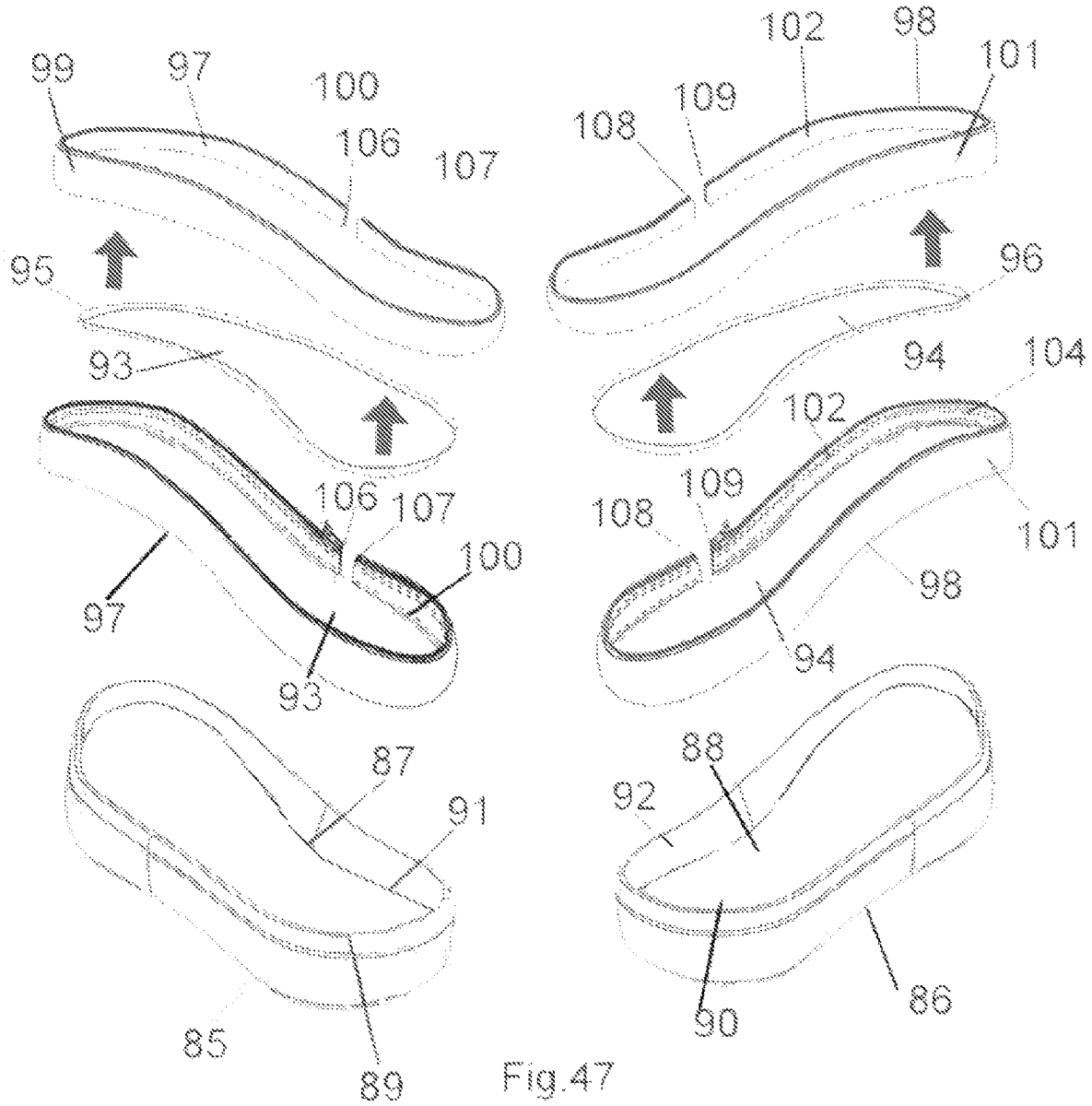
FIG. 47 is an exploded perspective view of the right and left sole module.

The sole module (see for example n. 5 and 13 FIG. 8) was invented to adapt to a common sole made of elastic material (such as, by way of example, plastic, rubber, polyurethane materials such as TPU and its derivatives, etc., n. 85 and 86, FIG. 47), obtained by means of an injection mold, with the inner hull having the higher outer edge (n. 91 and 92, FIG. 47). In the present embodiment, the sole is, therefore, pre-formed.

With reference to FIG. 8, representing a basic shoe according to the present invention, the sole module is made starting from a having a sole shape substantially corresponding to the sole of the foot, of which it follows the line, equipped with a tread, of any type and geometry and, if necessary, inserts of the same material of which the sole is made or of other material suitable for creating the known anti-slip effect (n. 85 and 86, FIG. 47). The pre-formed sole is also equipped with an internal sole shell (n. 87 and 88, FIG. 47) which has side walls that extend vertically from the bottom surface of the shell in a substantially perpendicular way to the bottom of the sole itself. The inner side walls of the sole will be called the perimeter edge of the inner sole shell (n. 91 and 92, FIG. 47).

On the bottom of the inner hull (n. 87 and 88, FIG. 47), a pressed cardboard insole is glued onto which a midsole is housed (n. 93 and 94, FIG. 47). Such midsole is made of flexible and elastic material, but at the same time resistant such as, by way of example, cotton, denim, ripstop, jersey, microfiber etc., with the upper surface facing the user's foot that extends for at least 1 centimeter along the edge perimeter of the inner sole shell (n. 95 and 96, FIG. 47). The end of the midsole that rises vertically towards the edge of the inner shell is firmly sewn to a module (n. 104, FIG. 47), called the upper sole connection module, adapted to engage the sole module with the upper module, which will be described hereinafter (n. 97-98, FIG. 47).

The midsole is then sewn along its perimeter edge to the joining module of the upper sole (FIG. 48) and is not cemented or fixed to the sole to prevent it from deforming or tearing over time.

Figure 50:
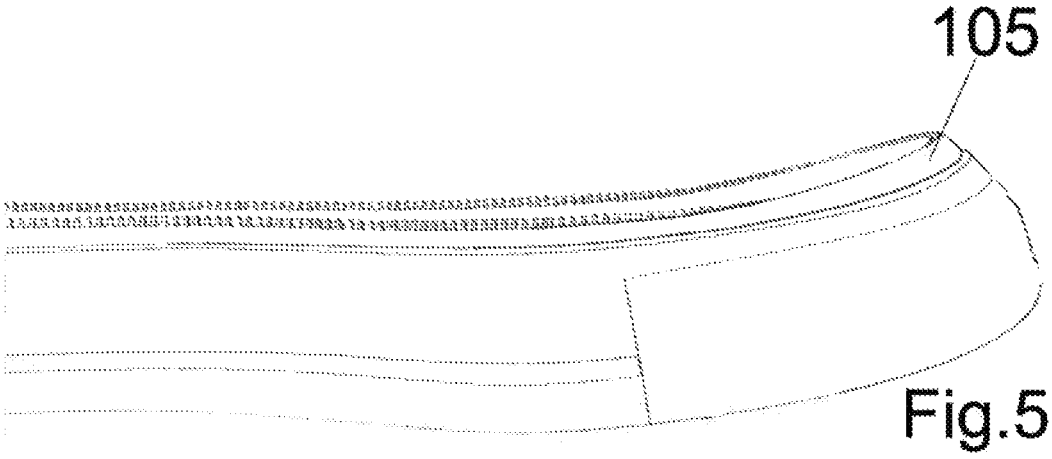
FIG. 50 represents a side view of a portion of the sole module.

The connection module of the upper sole consists of two strips of fabric (n. 99-100 and 101-102, FIG. 47), or of any other flexible material, of length corresponding to the internal perimeter of the sole (FIGS. 47 and 48) and of variable height according to that of the perimeter edge of the inner sole shell, so that the portion that protrudes above it (peripheral flaps) will always have a minimum height of 5 mm (n.105, FIG. 50).

Figure 48:
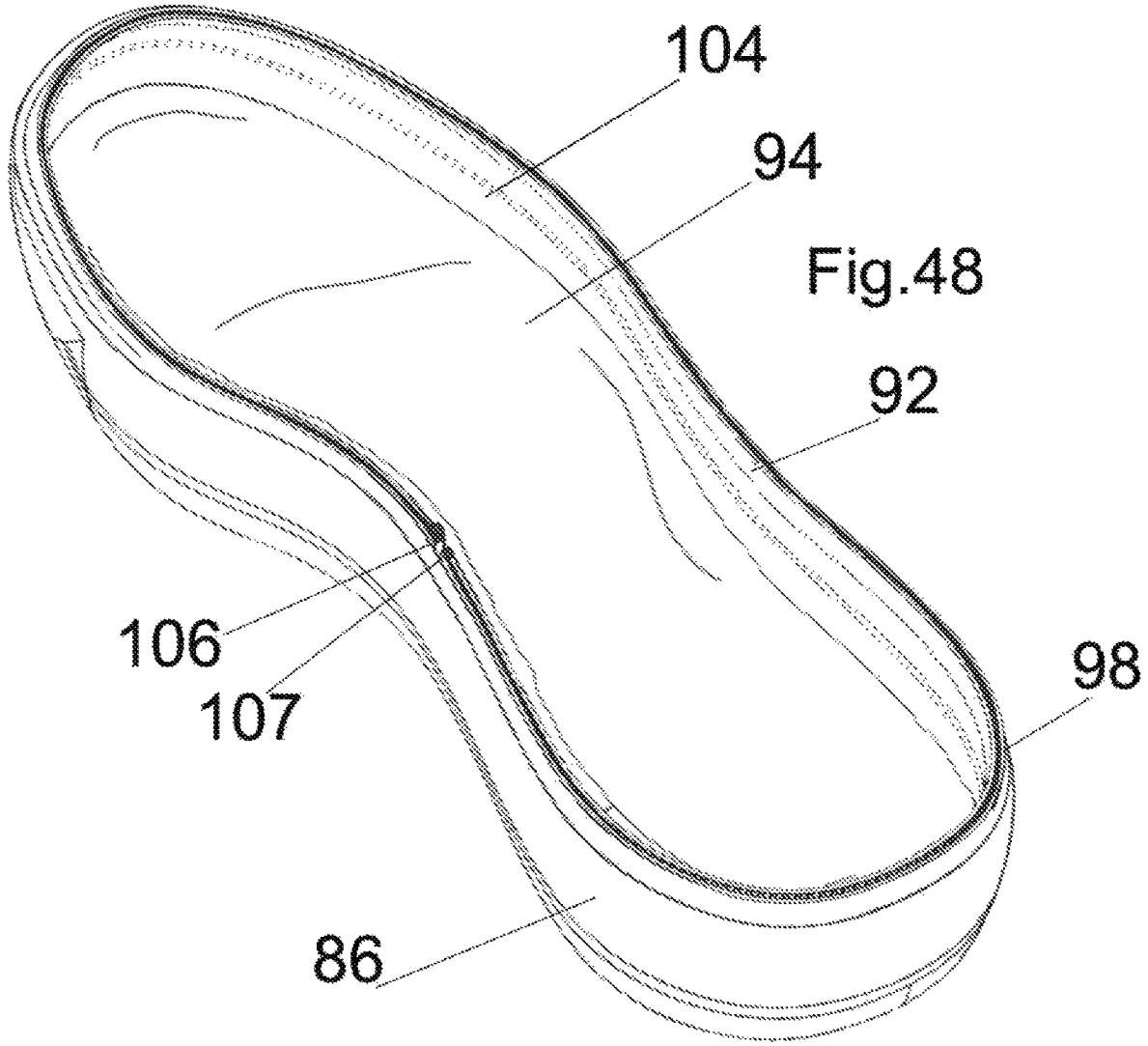
FIG. 48 represents an assembled perspective view of the sole module, including the upper sole module and the midsole.
Figure 49:
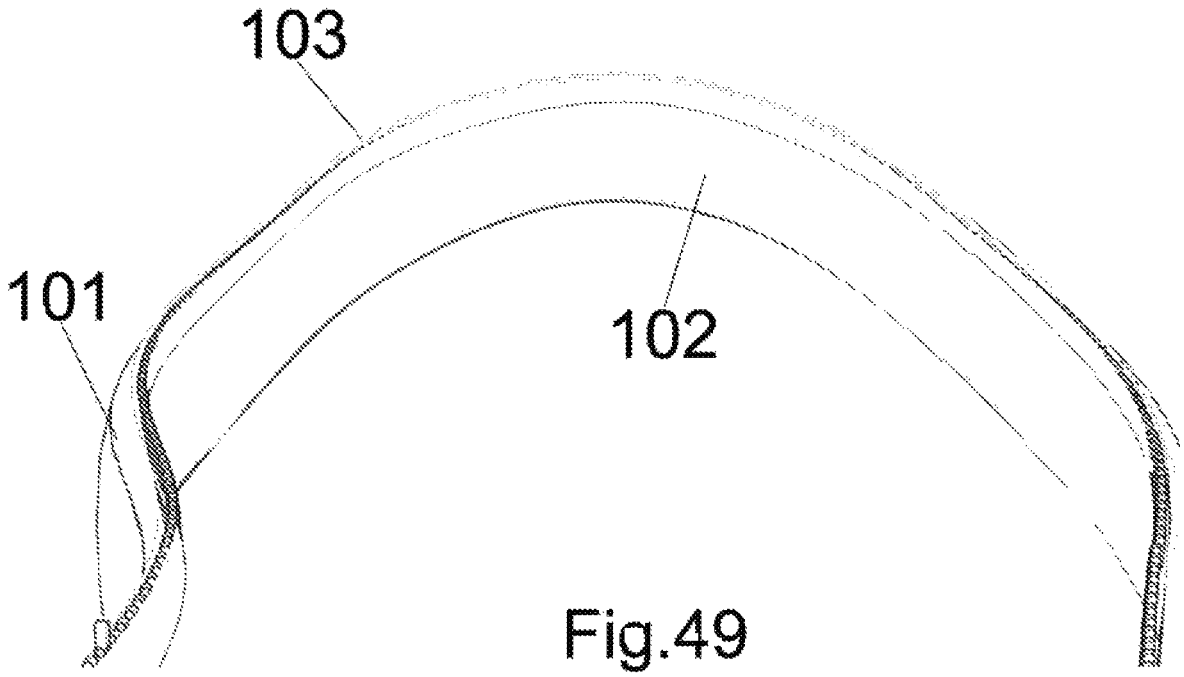
FIG. 49 represents a perspective view of a portion of the upper sole joining module.
Figure 52:
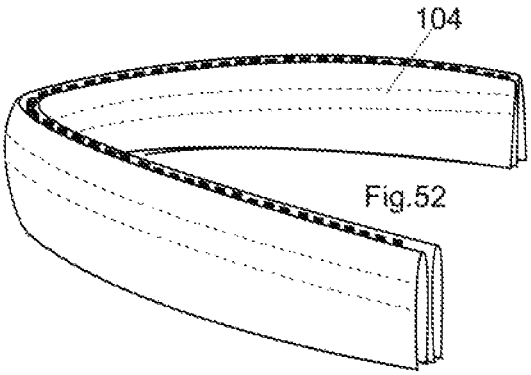
FIG. 52 represents a perspective view of a portion of the upper sole joining module.
Figure 53:
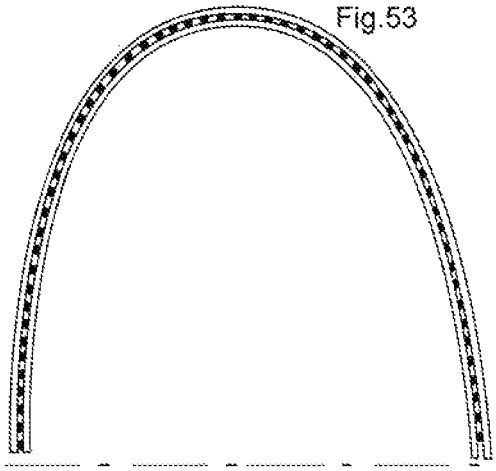
FIG. 53 represents a top view of a portion of the upper sole joining module.
Figure 51:
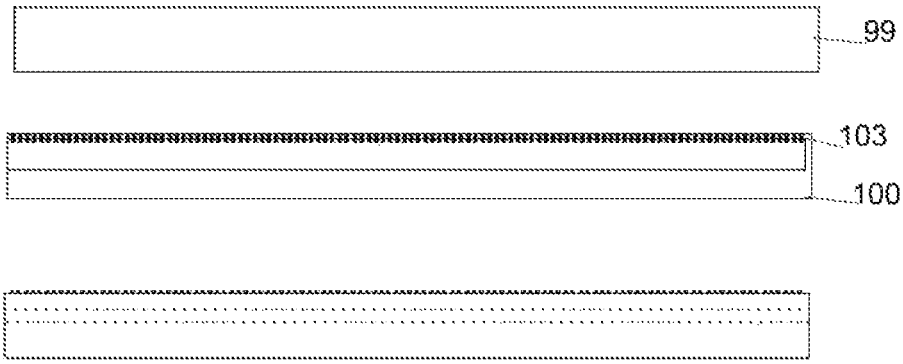
FIG. 51 represents the sequence for the packaging of the upper sole joining module.

Between the two belts, once positioned flat (n. 99-100, FIG. 51), the tape of the connection means used for this purpose is laid (n. 103, FIG. 51). These three elements are then sewn together with two or more parallel seams along their entire length (n. 104. FIGS. 47, 48 and 52) so that the tape is strongly anchored to the two tapes and that the edges of the three elements match perfectly, so as to ensure that the connection means is shielded laterally (FIGS. 48-49 and FIG. 53). In this case, when the module is made waterproof, a water-repellent fabric, such as Ripstop, is inserted and sewn to the external tape only.

The junction module thus assembled (FIG. 49, 51-53) is positioned along the perimeter edge of the inner sole shell (n. 91 and 92, FIG. 47) until it covers the entire circumference (FIG. 48). The two ends A and B of the module in question (n. 106-107 and 108-109, FIG. 47, n. 106-107, FIG. 48) must match each other without overlapping (FIGS. 48 and 54) and the belts must be as tight as possible to avoid the formation of folds which, otherwise, would not only make it difficult to close the connecting means, but would also cause annoying friction against the user's foot. The joining module, in the position described above, is first glued along the perimeter edge of the inner sole shell (n. 91 and 92, FIG. 47) and then sewn to it together with the midsole portion that rises vertically there (n. 95-96, FIG. 47 and FIG. 48). On the other hand, the two ends of the ribbons must not be sewn or glued (n. 106-107, 108-109, FIG. 48).

Due to the known upward inclination of the front part of the sole, the upper edge of the outer web of the joining module is a few millimeters higher than the upper edge of both the connecting means and the inner web (n. 105, FIG. 50). This induced effect is particularly advantageous since it softens any impacts to which the connection means in the front part of the sole could be subjected.

The sole module is completed by a removable insole in gel, cork, fabric, eva or any other material suitable for insulating the foot and guaranteeing its comfort.

Figure 1:
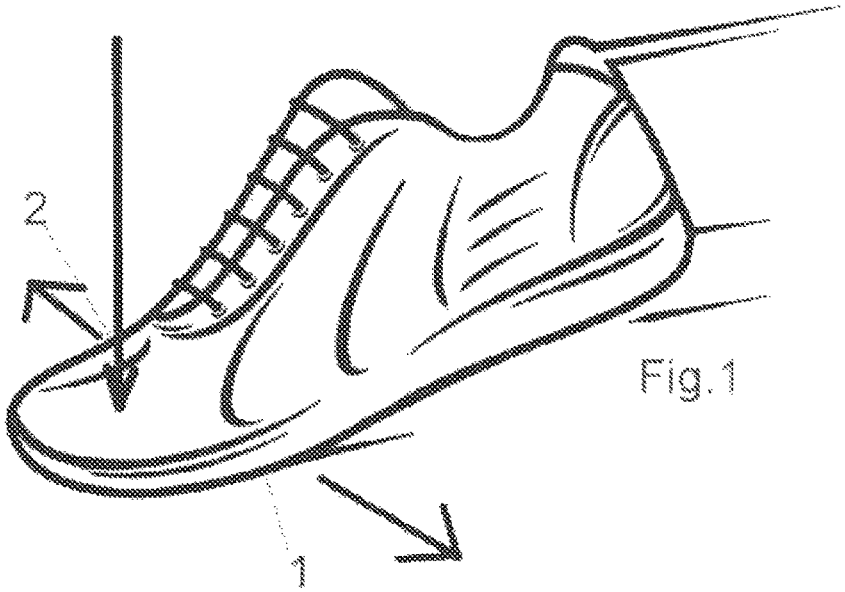
FIG. 1 represents the direction of the deforming effect of the shoe at the time of walking.
Figure 2:
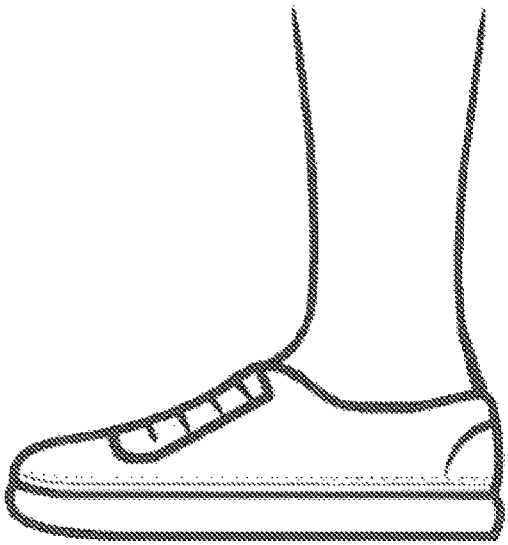
FIG. 2 represents a lateral view of the shoe in a static position.
Figure 3:
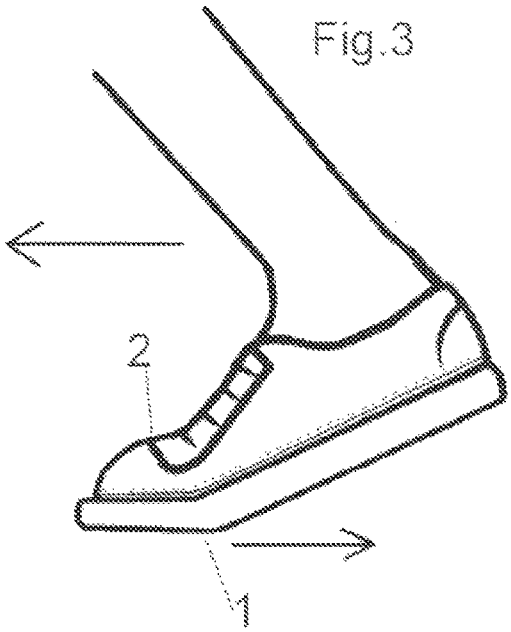
FIG. 3 represents a lateral view of the shoe upon walking and the directions of the relative advancing forces.
Figure 4:
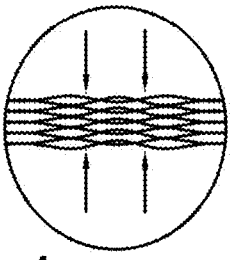
FIG. 4 represents a focus of the forces acting on the inner sole of the shoe.
Figure 5:
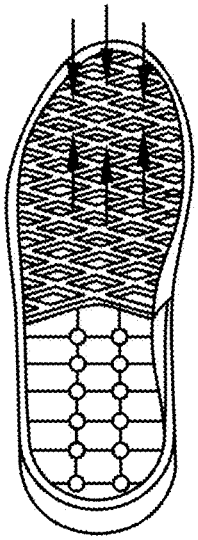
FIG. 5 represents a front view of the inner sole of the shoe with a focus on the forces acting on it.
Figure 6:
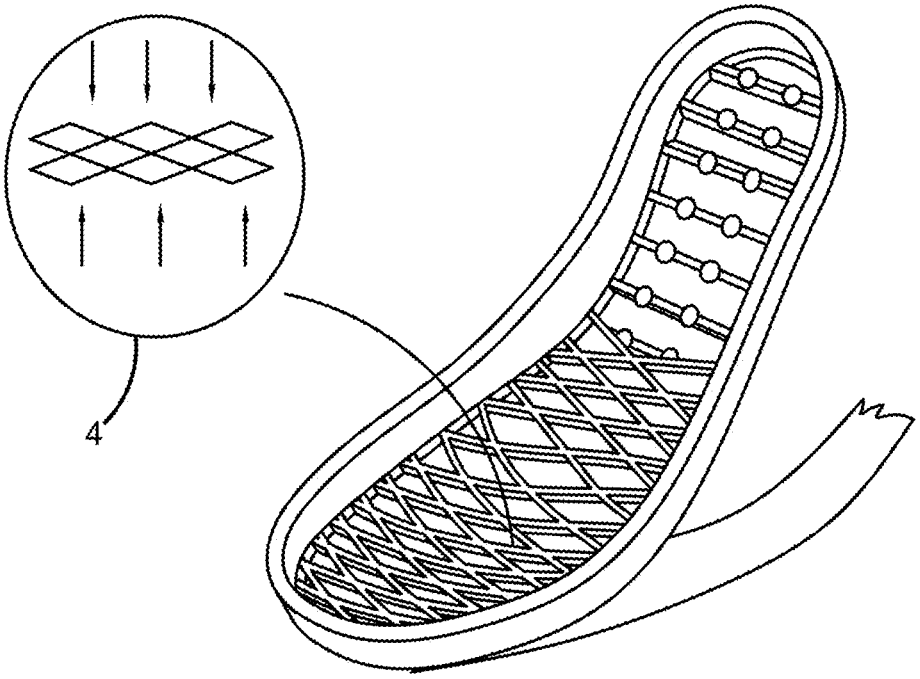
FIG. 6 represents a perspective view of the inner sole of the shoe upon walking with a focus on the forces acting on it.
Figure 54:
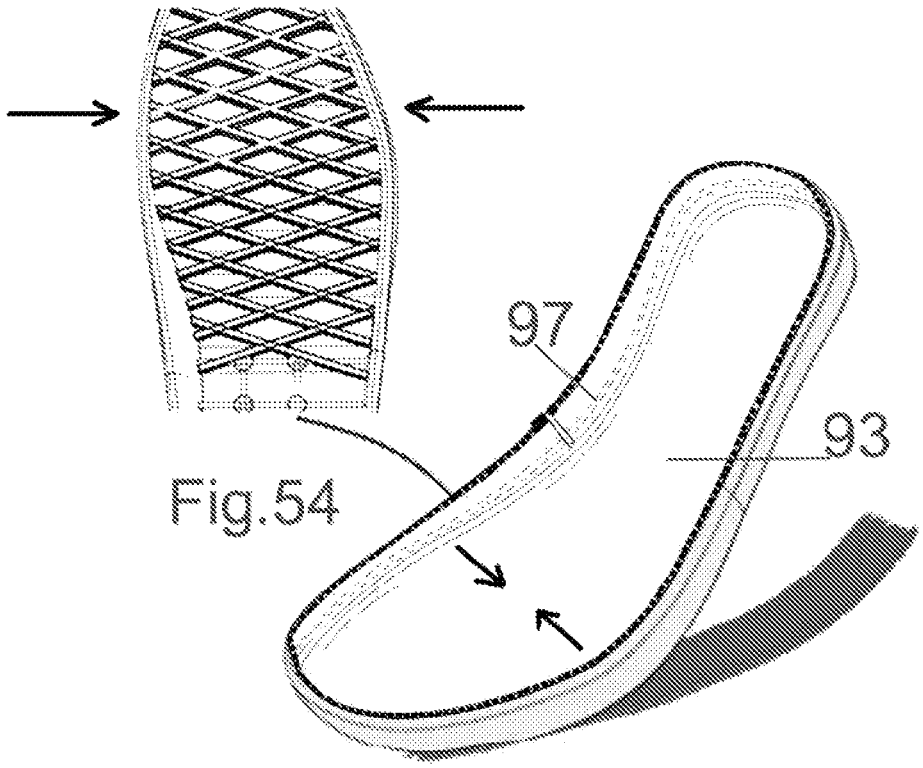
FIG. 54 represents a perspective view of the sole module with focus on the forces acting on the sole during walking.

It will be clearly evident to those skilled in the sector that the invention of the upper sole connection module together with the particular midsole made allows the sole to better react to the vertical pressure of the foot (FIG. 1), to the force of advancement of the walk (FIG. 3) and the consequential horizontal deforming effect of the shoe (FIGS. 4-5). The mobility and independence of the midsole, firmly sewn to the upper sole module, its continuation along the perimeter edge of the inner hull of the sole and the resistance to deformation of the fabric with which it is made, ensures that the sole remains compact and contrasts the opposing and deforming forces that weigh on the shoe when the user walks (FIG. 54). The wrapping and containment of the sole notoriously made by means of the extension of the upper inside the sole is, therefore, reproduced and adapted to the modular system of footwear of the present invention.

For these reasons, the sole module of the present invention has a greater elasticity, a greater compression and release capacity, as well as a greater return capacity of the structure to its point of origin.

As further indicated above, the main problem of making a double-face shoe is that of its difficulty in assuming any type of aesthetic appearance. The innovative scope of the present invention therefore consists in having created a folding upper module that can take on any type of design without the use of fixed structures on the sole to protect the foot.

Upper Module

The upper module (n. 6 and 14, FIGS. 7-9), together with the sole module (n. 5 and 13, FIGS. 7-9) and the corresponding finishing module (n. 7 and 15, FIGS. 7-9), constitutes the basic shoe of the present invention.

Obviously, this module has a lower perimeter whose length is equal to that of the sole module to which it is engaged, while the upper perimeter is of a length suitable for substantially circumscribing the ankle circumscription (FIGS. 7-9, 56, 57).

The upper module can have different shapes depending on the shoe model that one wants to make every time, such as, for example, a sneakers or other type.

Figure 55:
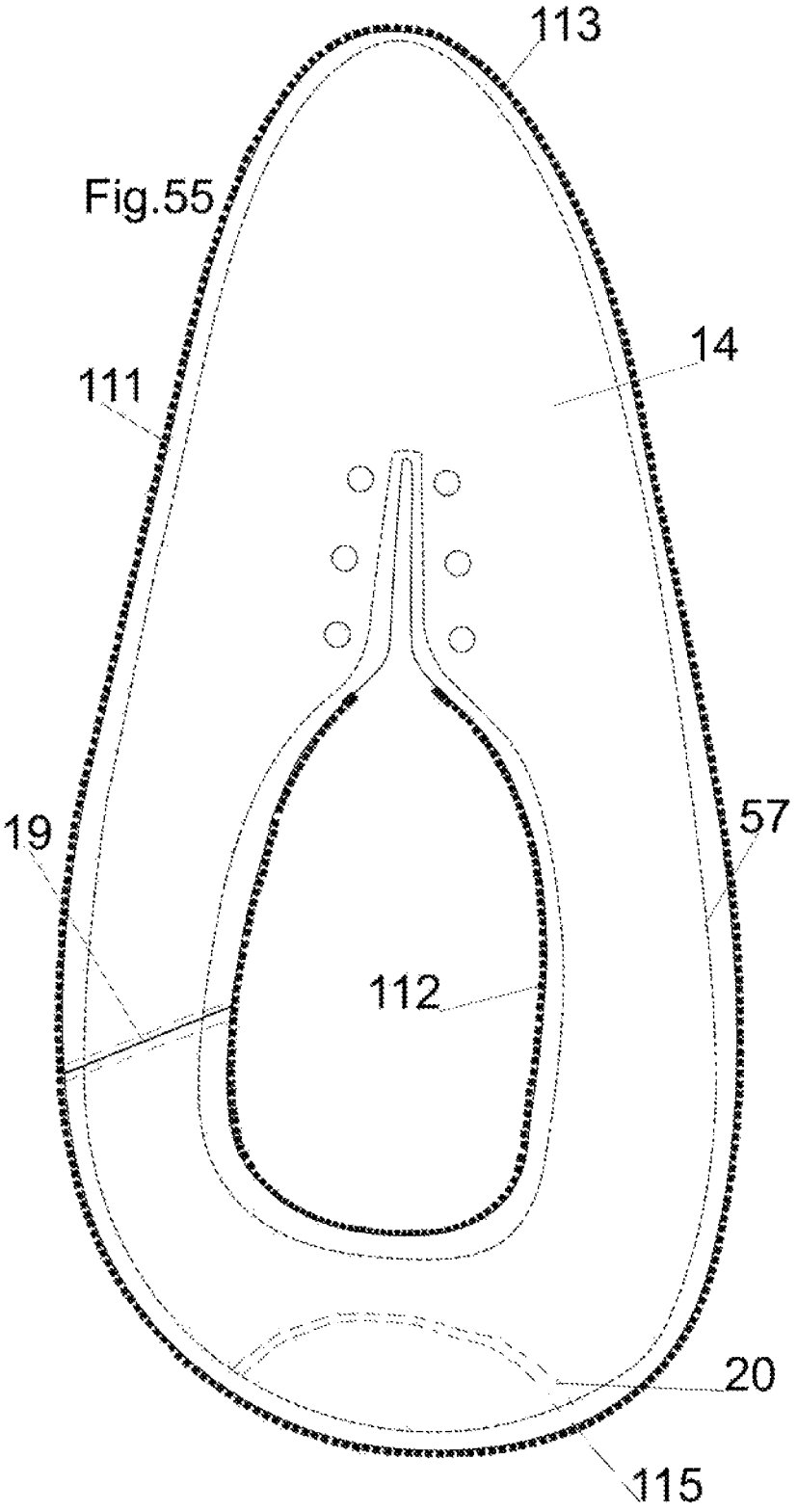
FIG. 55 represents a front view of the upper module with rivet and two chains of teeth of the zipper.

The elliptical shape of the front part of the upper (n. 113, FIG. 55), together with the interchangeability and folding of the module in question, entails the need to make, according to the known technique, some vertical cuts along the perimeter of the shape corresponding to the tip, whose number and length will vary according to the size of the shoe, and then ironed. Depending on the needs, a thermo-adhesive interlining template is then inserted in correspondence with the tip to optimally shape the tip itself.

Figure 56:
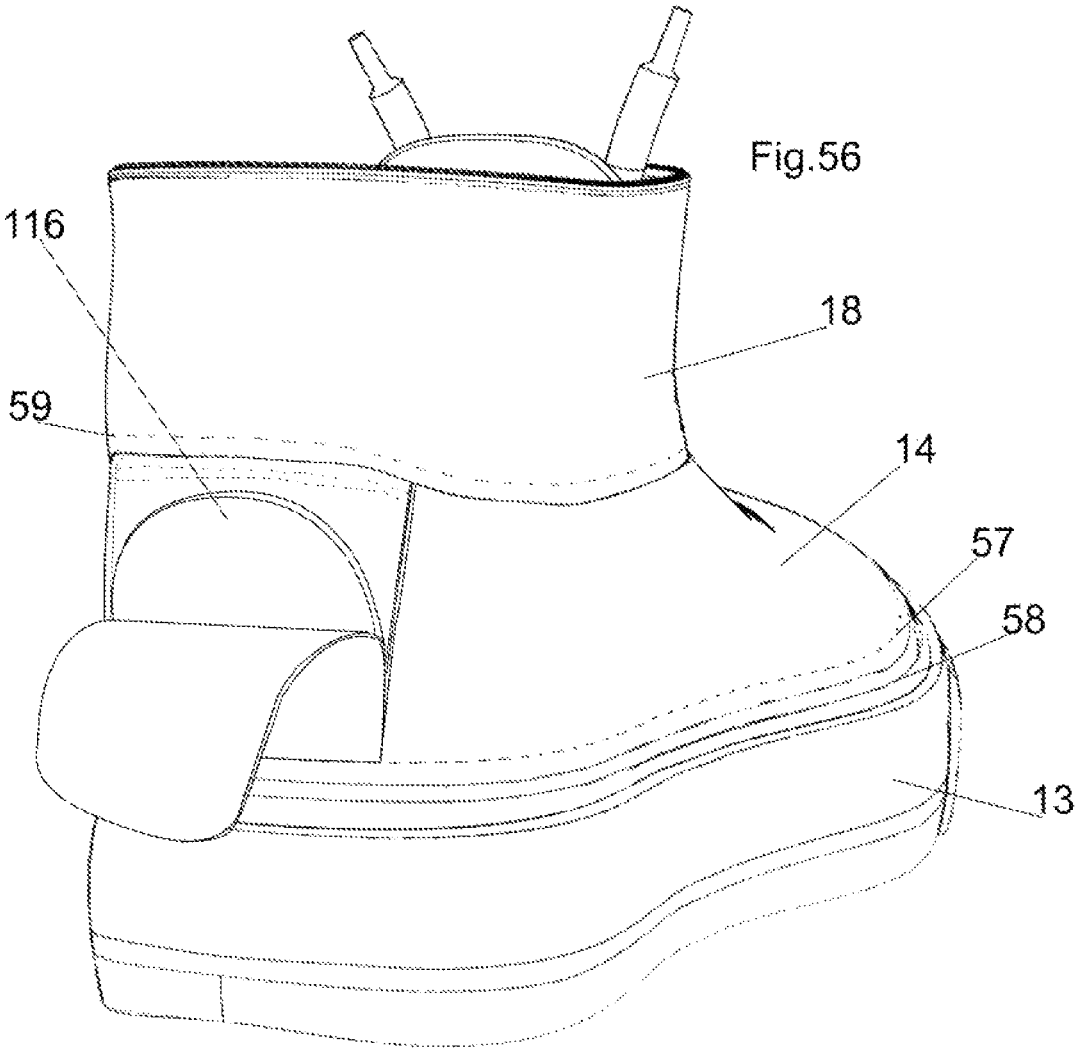
FIG. 56 represents a perspective view of the high shoe in section with focus on the buttress.

On the rear part of the upper, in correspondence with the heel and between the two shapes of the module, a piece of sponge with a substantially rectangular shape seen in plan and of variable size according to the size of the shoe is inserted and positioned (n. 116, FIG. 56). Reinforcing seams are also applied there (n. 115, FIG. 55) which follow different lines depending on the model of shoe to be made. These devices are used to create a buttress (n. 115, FIG. 55) which stiffens the rear part of the upper and prevents it from collapsing on itself.

Tab Module

Figure 57:
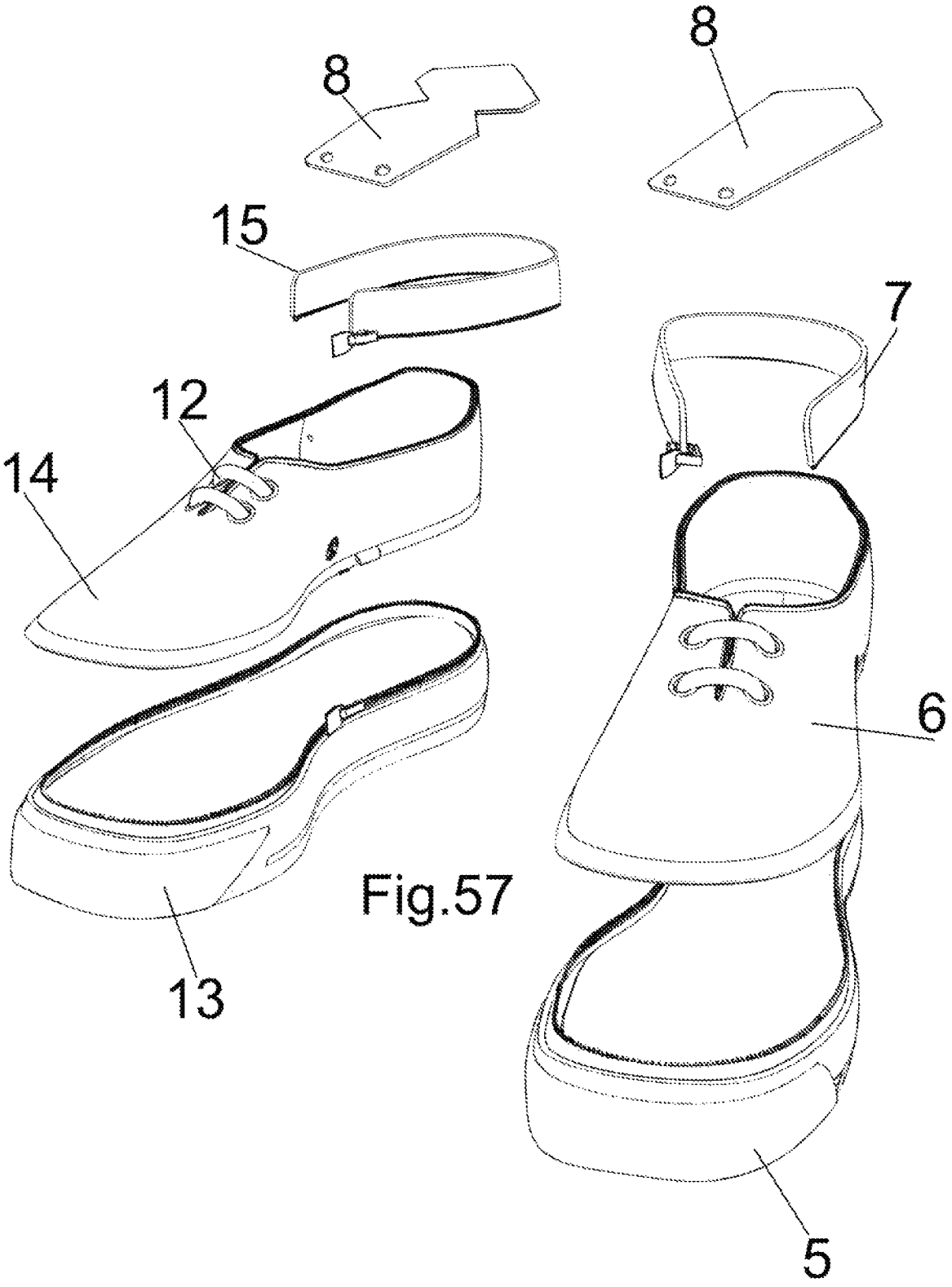
FIG. 57 represents an exploded view of the basic shoe according to the present invention, right and left, with tongue.

In the preferred embodiment of the shoe, it is provided that the upper module closes in the upper part of the user's foot through the use of laces and tongue (FIG. 57). For this eventuality, the present invention provides a solution to the problem of positioning such tongue and related laces since in the footwear present in the current state of the art it is made in such a way as not to allow the reversible upper to be folded over.

To this end, in one embodiment, the closure of the double-sided upper by means of laces takes place through the use of movable tabs, called tab modules, which are also double-sided (n. 8, FIG. 57) in which lateral sections there are some eyelets inside which the lace is inserted (n. 117-120, FIG. 60 and n. 12, FIG. 61). In particular, for example, the lace will be inserted in the first eyelet on the right of the tongue (n. 117, FIG. 60) and then in the first eyelet on the right of the upper (n. 121, FIG. 62). Then it will be inserted in the first left eyelet of the upper (n. 123, FIG. 62) and in the first left eyelet of the tongue (n. 119, FIG. 62), and so on to go up. Obviously, this implies that the upper module also has some eyelets in its upper part in correspondence with the vamp (FIG. 57, 64, 65).

The provision of movable tabs is functional not only to make possible the overturning of the upper but also to allow the closure of the upper modules by means of eyelets and laces in order to have a complete uniform shoe regardless of its height.

According to the present invention, in fact, the tongue has a variable height based on that of the shoe made by the user. There will therefore be tabs that cover only the instep of the foot (FIG. 8), others that extend up to the user's ankle (FIG. 11) or even up to the desired height of the leg (n. 74, FIG. 43).

Figure 67:
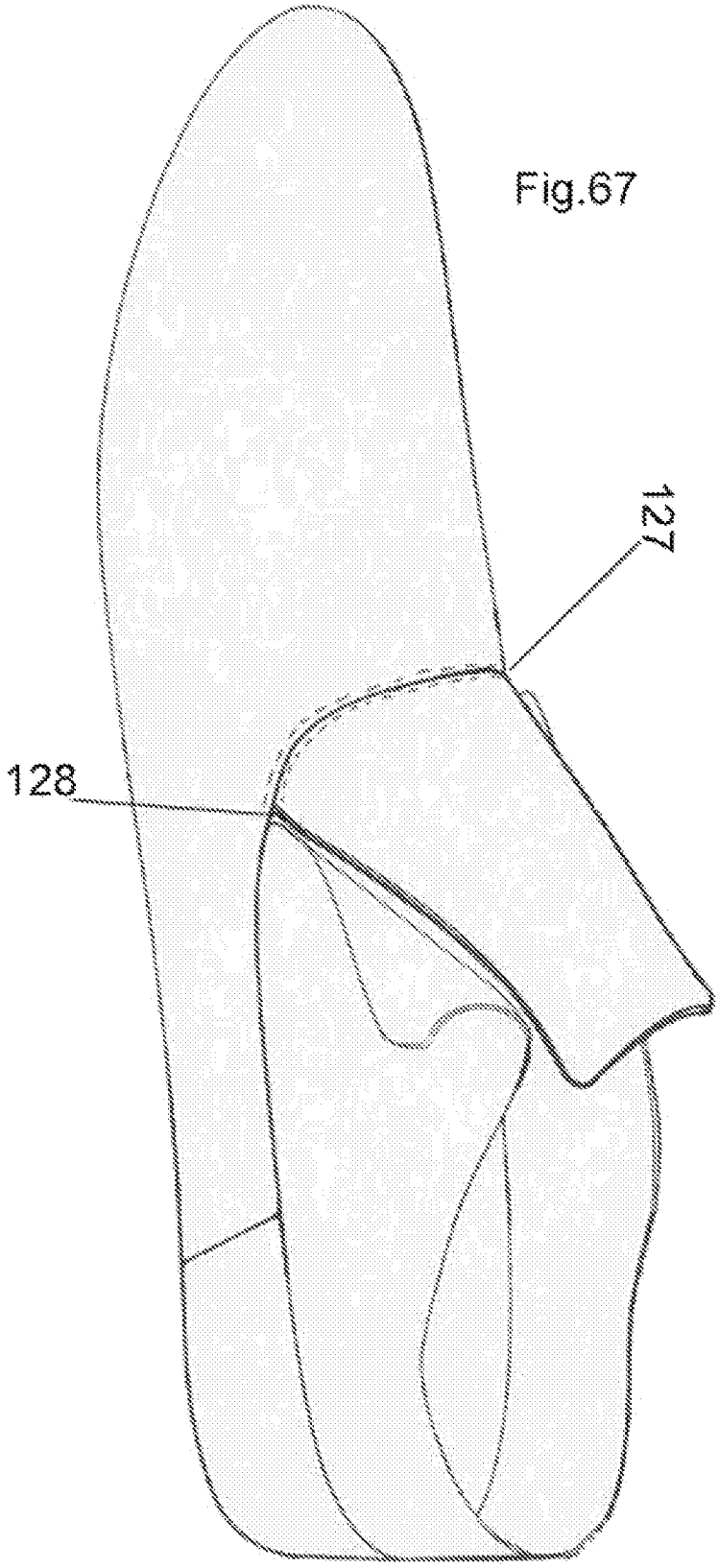
FIG. 67 represents a perspective view of the upper module with tongue integrated in the shape of the upper itself.

These movable tongues constitute only a preferred embodiment of the present invention, but this does not exclude the possibility of making uppers whose shape includes that of the tongue in such a way that there is no interruption between the two elements, according to the known art. (FIG. 67). In this second hypothesis, the reversibility of the upper can be allowed, due to the fact that the tongue and the part corresponding to the vamp have only two points or segments in common, which are found in the right and left extremities of the base of the tongue (n. 127-128, FIG. 67).

The tab module in question can have different shapes and such as to adapt optimally to the user's body. It can therefore be rectangular, trapezoidal or of any other shape suitable for the purpose and the particular design to be created. In a particular embodiment, the shape that makes up the tongue has the shape of a polygon seen in plan (FIG. 60) and has two notches with a triangular section that are mirrored to each other that make it more ergonomic and comfortable (n. 125-126, FIG. 60), allowing it to mold itself optimally to the user's upper and foot.

Finally, as indicated above, the known prior art footwear is not able to adapt perfectly to the specific characteristics of the user's foot, ankle and leg, if not by means of laces or stretch inserts.

In the shoe of the present invention, such need is solved by means of size adapter modules and the boot module.

Ankle Size Adapter Module

Figure 68:
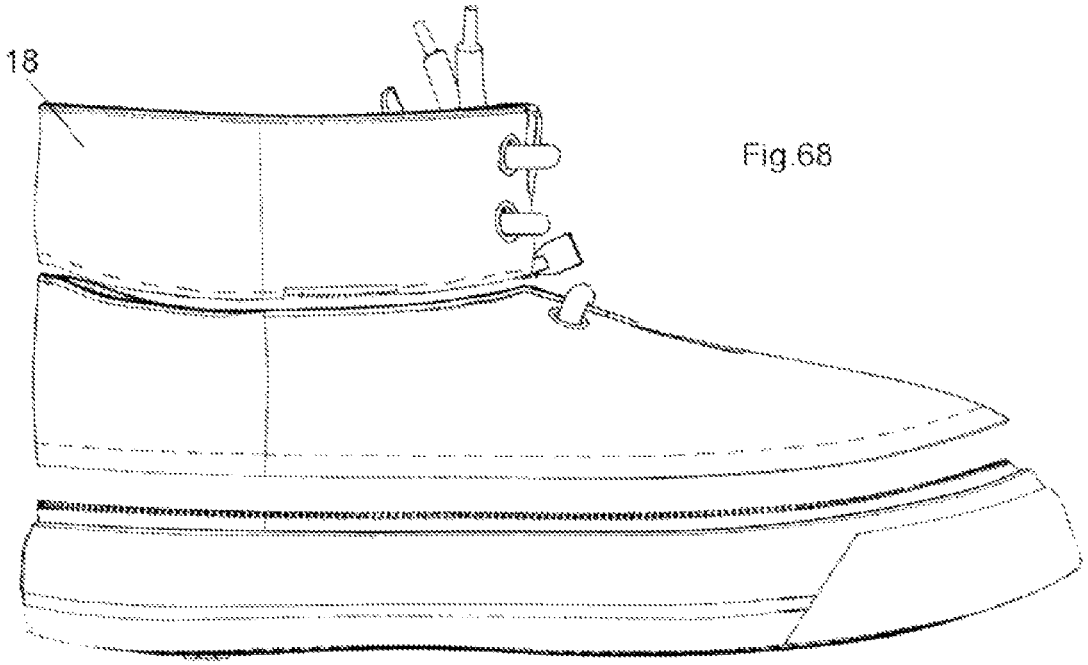
FIG. 68 represents an exploded side view of the high shoe according to the present invention.

According to the present invention, it will be possible to attach to the upper module, in place of the corresponding finishing module (n. 7 and 15, FIG. 7), a module called ankle size adapter (n. 17-18, FIGS. 10-12, 21) and 23, FIGS. 13-15, 25 and 27, FIG. 16-18, n. 18, FIG. 68), whose function is to allow the transformation of the low shoe into a high shoe that adapts optimally to the circumference of the user's ankle.

Figure 69:
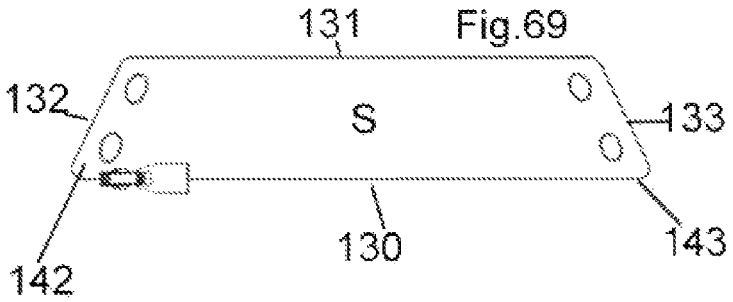
FIG. 69 is a front view of the small ankle size adapter module.
Figure 70:
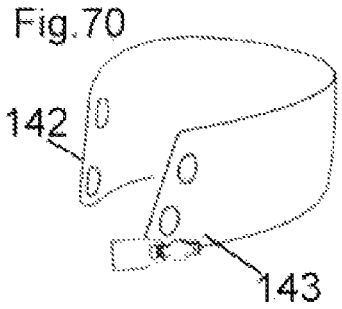
FIG. 70 is a perspective view of the small ankle size adapter module.
Figure 73:
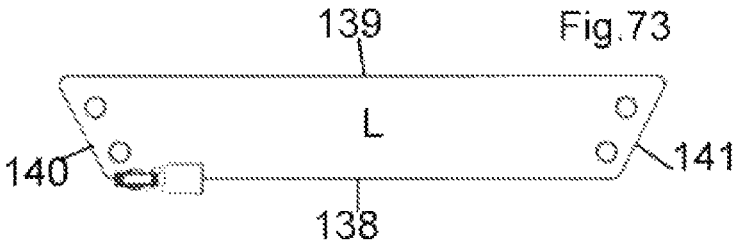
FIG. 73 is a front view of the wide ankle size adapter module.
Figure 74:
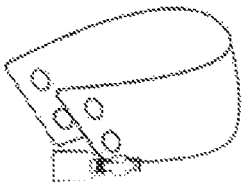
FIG. 74 is a perspective view of the wide ankle size adapter module.

In particular, the module in question will have a substantially rectangular (FIG. 71) or trapezoidal (FIGS. 70 and 73) shape, seen in plan according to the shape of the user's ankle and, in the selected actuation mode, will present in correspondence with the two shorter sides a row of two or more eyelets that will be used to position the laces and close the module (for example, n. 142-143, FIGS. 69-70). Obviously, the provision of this method of closing the module does not exclude that it can be achieved by means of other coupling systems which are however compatible with the innovative scope of the present invention.

Each ankle size adapter module has the lower edge of the same length as the ankle loop of the upper module to which it must engage (FIG. 19) and variable height according to the number of the shoe and, in any case, sufficient to ensure substantial coverage of the area corresponding to the malleolus (FIG. 68). The variability of the module in question capable of guaranteeing the perfect fit and performability of the shoe therefore affects the length of its upper edge.

Figure 71:
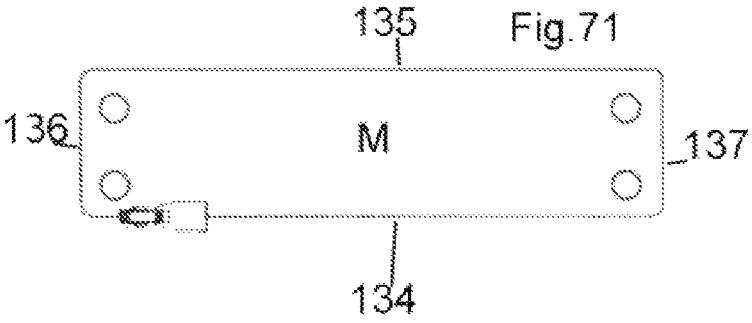
FIG. 71 is a front view of the regular ankle size adapter module.
Figure 72:
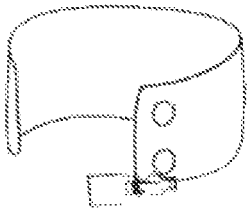
FIG. 72 is a perspective view of the regular ankle size adapter module.

Specifically, to create a shoe with a regular ankle, the ankle size adapter module will have a substantially rectangular shape and therefore the upper and lower edges of the same length (n. 134-135, FIG. 71). To create a shoe with a small ankle, the ankle size adapter module will have a substantially trapezoidal shape with an upper base (#131, FIG. 69) approximately ¼ shorter than that of the lower base (n. 130, FIG. 69). On the contrary, to create a shoe with a wide ankle, the module will have a substantially trapezoidal shape with an upper base (n. 139, FIG. 73) approximately ¼ longer than that of the lower base (n. 138, FIG. 73).

Boot Module

Figure 21:
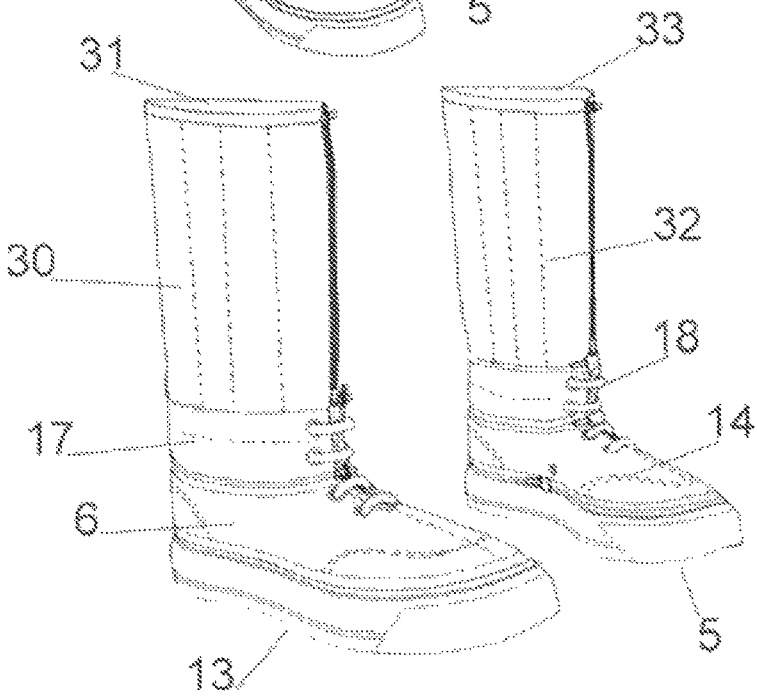
FIG. 21 represents an assembled perspective view of the boot according to the present invention, including the sole module, the upper module, the regular ankle size adapter module, the regular size boot module and the overturned finishing module.
Figure 22:
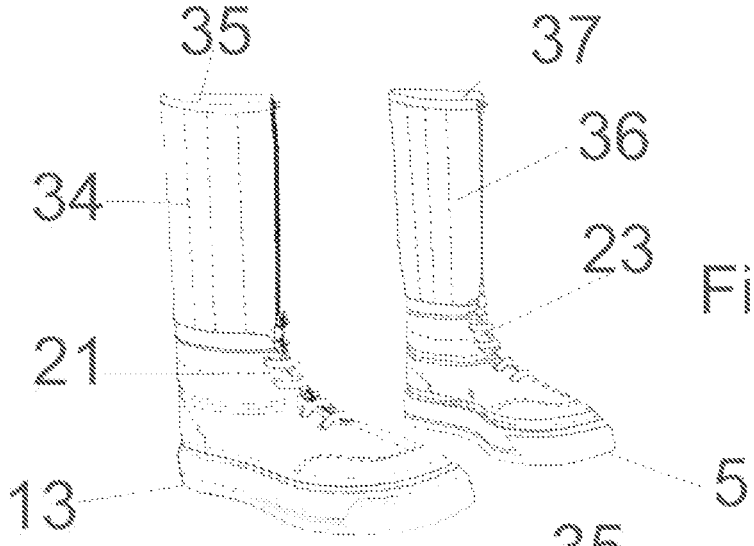
FIG. 22 represents an assembled perspective view of the boot according to the present invention, including the sole module, the upper module, the small ankle size adapter module, the small size boot module and the finishing module.
Figure 30:
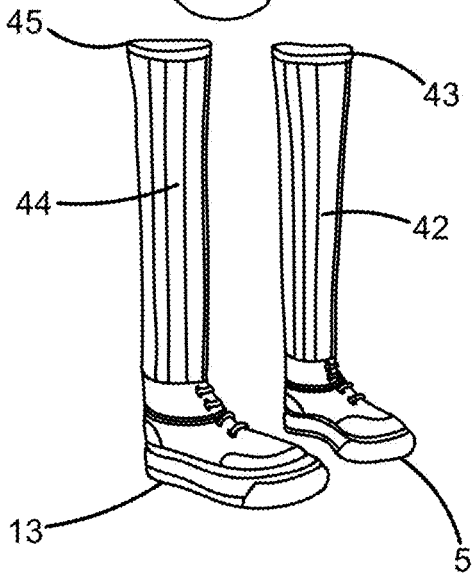
FIG. 30 represents an assembled perspective view of the boot according to the present invention, with the thigh-high boot module, overturned.

The boot module is the one that allows the height of the shoe to develop and wraps around the user's leg (see for example n. 30 and 32, FIGS. 19-21, n. 42 and 44, FIGS. 28-30). With the modular system of the present invention, the latter will be free to choose the height of the final shoe assembled by him by attaching the module in question to the ankle size adapter module. In particular, such module can have a height up to below the knee (for example see n. 32 and 30, FIG. 19) or it can extend up to the user's thigh (for example see n. 42 and 44, FIG. 28).

The boot module has a substantially trapezoidal shape seen in plan (FIG. 45) and, specifically, of an isosceles trapezium with lower base (n. 80, FIG. 45) smaller than the upper one (n. 79, FIG. 45) and of a length equal to that of the upper base of the corresponding ankle-size adapter module (see for example FIGS. 20, 23, 26). The height of the trapezoidal shape will vary according to the design one wants to give to the boot and, in any case, such as to substantially cover the user's leg below the knee, when it is a standard height boot (see for example FIG. 19), while up to the thigh when it is a question of thigh-high boot (see for example FIG. 28).

Precisely by virtue of the fact that the length of the lower base of the boot module corresponds to the upper base of the ankle size adapter module, it follows that also this module adapts optimally to the shape of the user's leg (regular size boot module n. 30 and 32, FIG. 20, small boot module n. 34 and 36, FIG. 23, large boot module n. 38 and 40, FIG. 26).

According to the present invention, the closure of the boot module takes place by joining the oblique sides of the trapezoidal shape (81-82, FIG. 45) and engaging them with each other by means of the selected connection means, that is a zip (first preferred actuation method, FIGS. 19-30), a sheath (second preferred actuation method, n. 183, FIG. 93) eyelets and laces (n. 75, FIG. 43) or the use of any other type of connecting tool suitable for the purpose or again by combining them.

Figure 43:
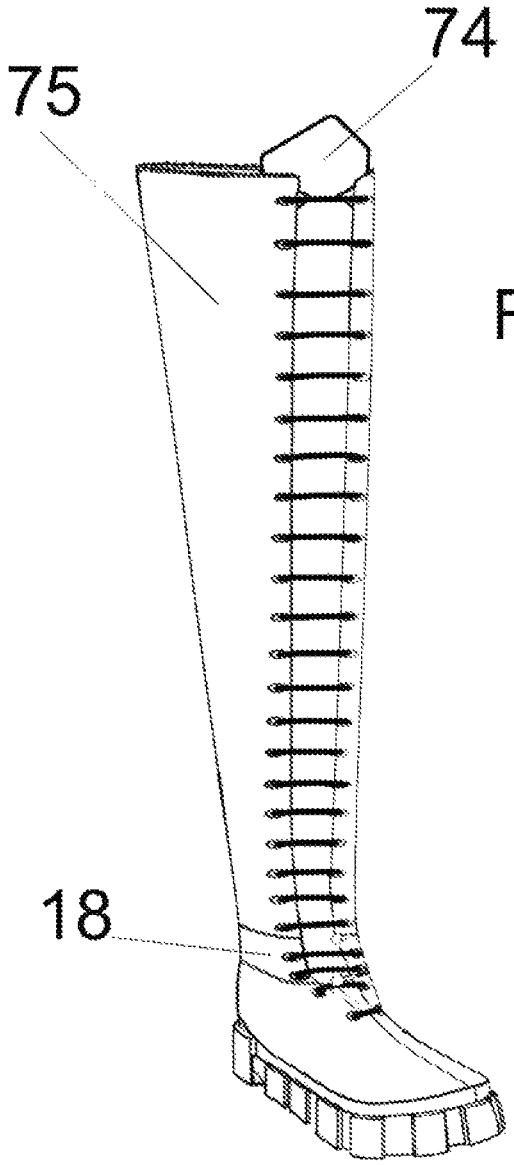
FIG. 43 represents a perspective view of the boot with closure by means of eyelets, laces and tongue according to the present invention.

Assuming that the boot module wraps the user's leg and is joined by eyelets and laces (n.75, FIG. 43), a tongue is required, of variable length and, in any case, such as to substantially match the upper edge of the boot module chosen by the user and which is directly engaged to the upper (n. 74, FIG. 43). This means that, when the user wants to compose a boot that closes with laces and eyelets, he must necessarily use an upper module with a detachable tongue and replace the combined tongue with another one specifically provided for the boot module.

Thigh Size Adapter Module

The present invention provides second way of implementing the boot at thigh height (FIGS. 31-36). In particular, to the boot module it will be possible to attach, in place of the corresponding finishing module, a module called thigh size adapter, whose function is allowing the transformation of the leg height boot into a thigh-high boot, which adapts optimally to the circumference of the latter (n. 46 and 48 FIGS. 31-33, n. 51 and 53, FIGS. 34-36).

Figure 75:
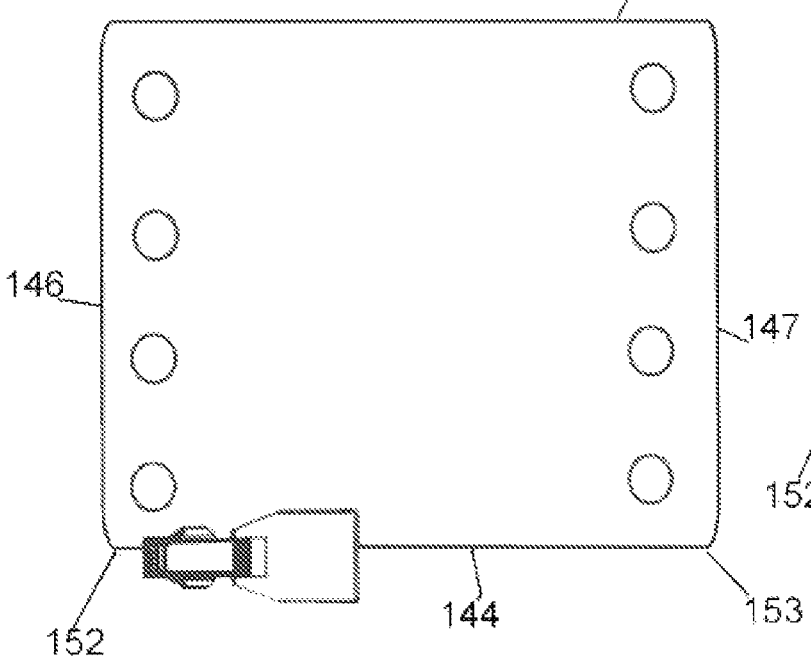
FIG. 75 is a front view of the regular thigh size adapter module.
Figure 76:
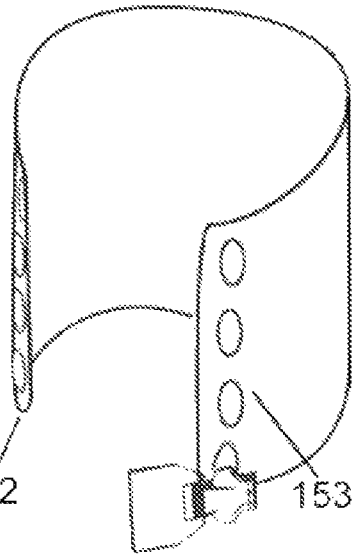
FIG. 76 is a perspective view of the regular thigh size adapter module.
Figure 77:
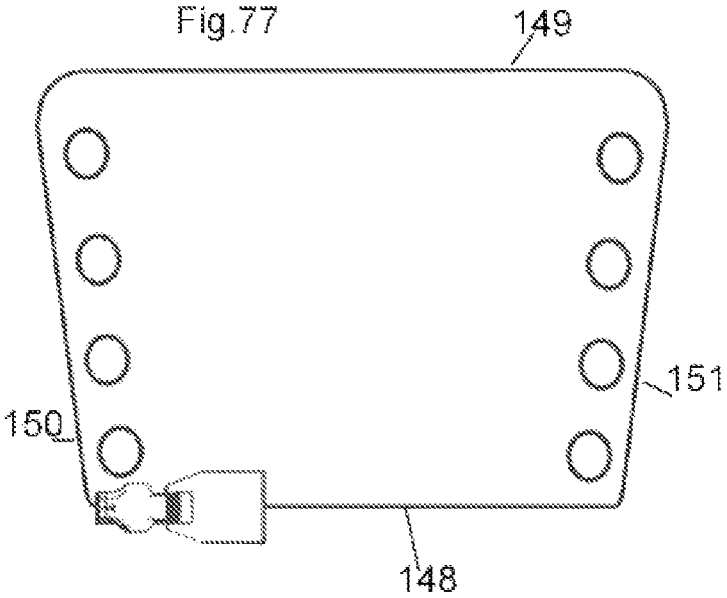
FIG. 77 is a front view of the wide thigh size adapter module.
Figure 78:
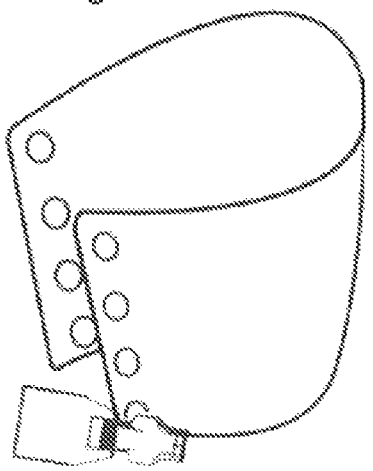
FIG. 78 is a perspective view of the wide thigh size adapter module.

In particular, the module in question will have a substantially rectangular (FIG. 75) or trapezoidal (FIG. 77) shape, seen in plan according to the shape of the user's thigh (FIGS. 31-36) and, in the selected actuation mode, will have a row of eyelets on the two vertical sides which will be used to position the laces and close the module (n. 152-153, FIG. 76). Obviously, the provision of this method of closing the module does not exclude that it can be achieved by means of other coupling systems which are however compatible with the innovative scope of the present invention.

Each thigh size adapter module has the lower edge of the same length as the upper base of the corresponding boot module to which it must engage (n. 48 and 46 FIGS. 31-33; n. 53 and 51 FIGS. 34-36) and variable height according to the shoe number and, in any case, sufficient to guarantee substantial coverage of the user's thigh (see for example FIG. 31). The variable of the module in question capable of guaranteeing the perfect fit and performability of the shoe therefore affects the length of its upper edge.

Specifically, to create a boot that fits a medium-sized thigh, the thigh-size module will have adapter a substantially rectangular shape and therefore the upper and lower edges of the same length (n. 144-145, FIG. 75). To create a boot that fits a large thigh, the thigh size adapter module will have a substantially trapezoidal shape with an upper base (n. 149, FIG. 77) approximately ¼ longer than the lower base (n. 148, FIG. 77).

At this point, the advantage of also providing this module will be evident, allowing it to create a boot at thigh height that adapts itself even more optimally to the conformation of the user's knee and thigh.

Finishing Module

As indicated above, the modular system of the present invention provides for an aesthetically pleasing final shoe as the assembly of the modules is not perceptible from the outside.

This is made possible not only through the provision of the aforementioned peripheral flaps that shield the connection means between each module, but also through the provision of terminal modules, called finishing modules, which complete the shoe and have a lower edge of a length equal to that of the upper edge of the corresponding module to which it engages (see for example, n. 7 and 15, FIGS. 8, n. 19 and 20, FIGS. 11, n. 22 and 24, FIGS. 14, n. 26 and 28, FIGS. 17, n. 31 and 33, FIGS. 20, n. 35 and 37, FIGS. 23, n. 39 and 41, FIGS. 26, n. 43 and 45, FIGS. 29, n. 47 and 49, FIGS. 32, n. 52 and 54, FIG. 35).

Unlike in the other modules of the present invention and described above, the one in question is devoid of the connection means in its upper edge (see for example n. 7 and 15, FIG. 57), which can have any type of design according to the aesthetic taste of the user.

It will be obvious that all above described modules involve problems with their coupling determined by the variability of the size of the shoe, of the direction of use of the module and, for the upper modules, of the circumference of the ankle and/or of the leg of the user.

Figure 83:
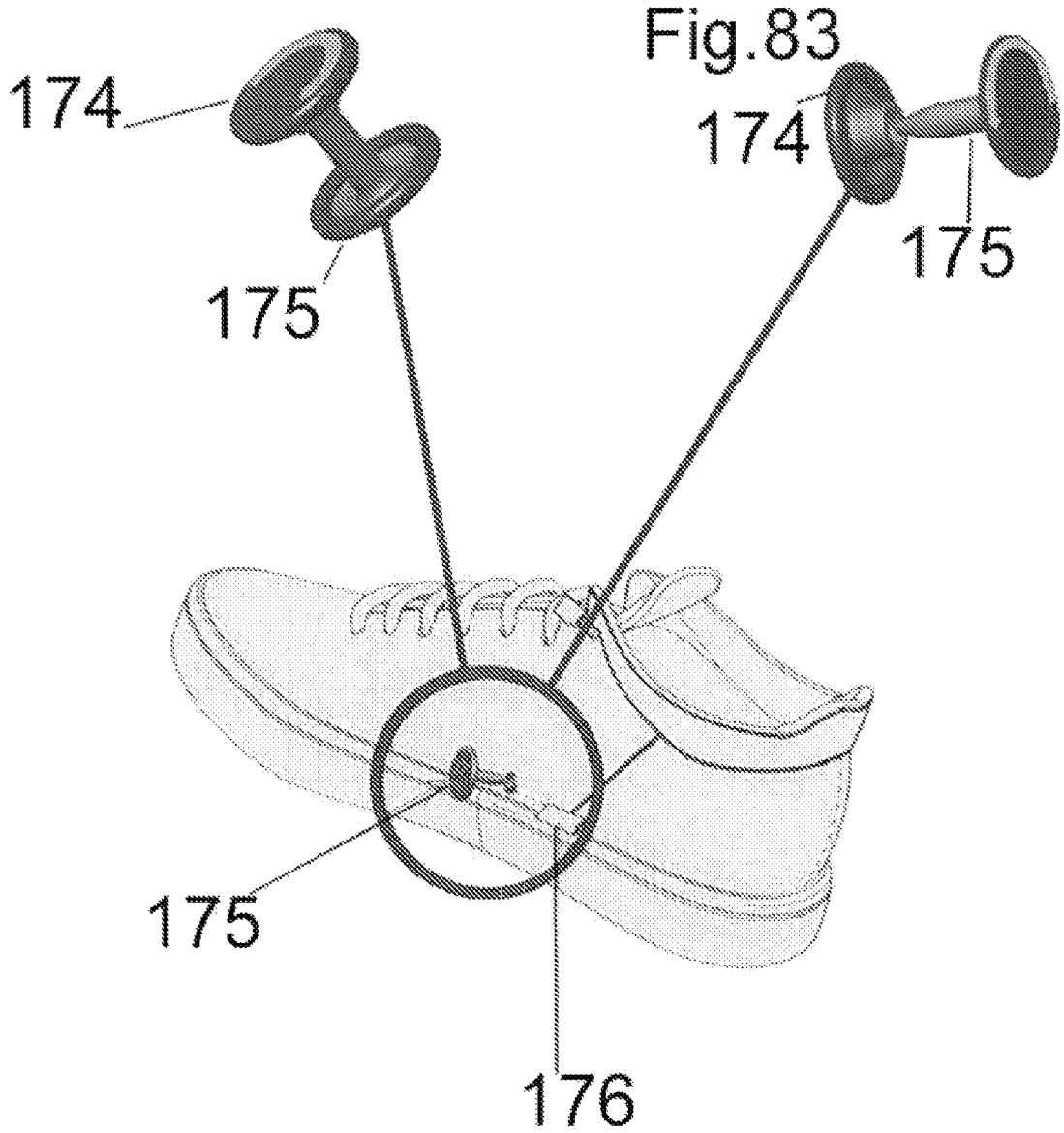
FIG. 83 represents an exploded view of the basic shoe with zipper and rivet.

For this reason, in the present invention, a special double-headed rivet made of metal, plastic or other suitable material (n. 174-175, FIG. 83 and FIG. 84) is fixed on each module, so that one of them is always visible regardless of which side of the module is chosen as external.

The peculiarity of the rivet positioned on the modules is that both heads are engraved with the number of the shoe, specifying whether it is EU, USA or UK, as well as the size of the module (FIG. 84), i.e. for example S, M, L, corresponding to the circumference of the user's ankle and/or leg.

As will be explained in detail below, the rivet also allows the insertion of further indications that are necessary based on the connection means chosen for the union between the various modules.

In light of all the foregoing, it appears clear that the present invention has concretely solved the technical problems underlying the production of a shoe that is not only interchangeable but also double-faced and more corresponding to the shape of the user's leg, allowing the itself to present all most different possible aesthetic styles, such as laces, leggings and so on. The obvious consequence is the double benefit in terms of money for the user who, for example, instead of buying two uppers with different patterns to have two different shoes, thanks to the present invention, will be able to purchase a single double-face upper.

The creative potential of the shoe of the present invention is boundless. The modules, all double-sided, can in fact be joined together even in height, on the leg, up to the level that best reflects the user's needs. Their infinite combinations are intuitive. The individual user can then become his own stylist, creating his own unique and highly original footwear through the unique and original assembly of each module.

The shoe of the present invention is therefore not only customizable but becomes multi-season and suitable for any occasion. The user can in fact freely choose which and how many modules of the shoe to join together and therefore also decide the height of the shoe and/or boot.

Furthermore, any terminal module chosen by the user will have its respective finishing module, designed to cover the final connection means so that even the last edge of the shoe will not create problems of rubbing in contact with the user's body nor it will look unsightly. From the outside, the shoe will in fact always be complete and harmonious.

The modular system of the present invention can be better understood and implemented with reference to the attached drawings, which illustrate some exemplary and non-limiting embodiments thereof, given that the shoe systems described in this document can use components and sub-components adaptable to any function and aesthetics of the shoe. All these shoe models are, therefore, intended to fall within the scope of the present invention.

First Embodiment of the Means of Connection Between the Modules

In this first embodiment, the engagement means applied to the individual modules consist of zippers with teeth made of metal, such as Zama or other similar material. The autonomous washability of each shoe module requires, in fact, that said hinge be resistant to high temperatures and that it does not deform even after numerous washes. It is in fact clear that its eventual de formation would compromise the perfect interchangeability between the various modules. Therefore, the zip must necessarily be made of a material resistant to high washing temperatures such as, for example, zamak or other similar alloys. On the contrary, it cannot be made of plasticized material due to its inclination to deformation. The plasticized material cannot be used also because it is less resistant to deformation and/or breakage caused by any impact that the foot can undergo during walking, especially in its front part.

Figure 79:
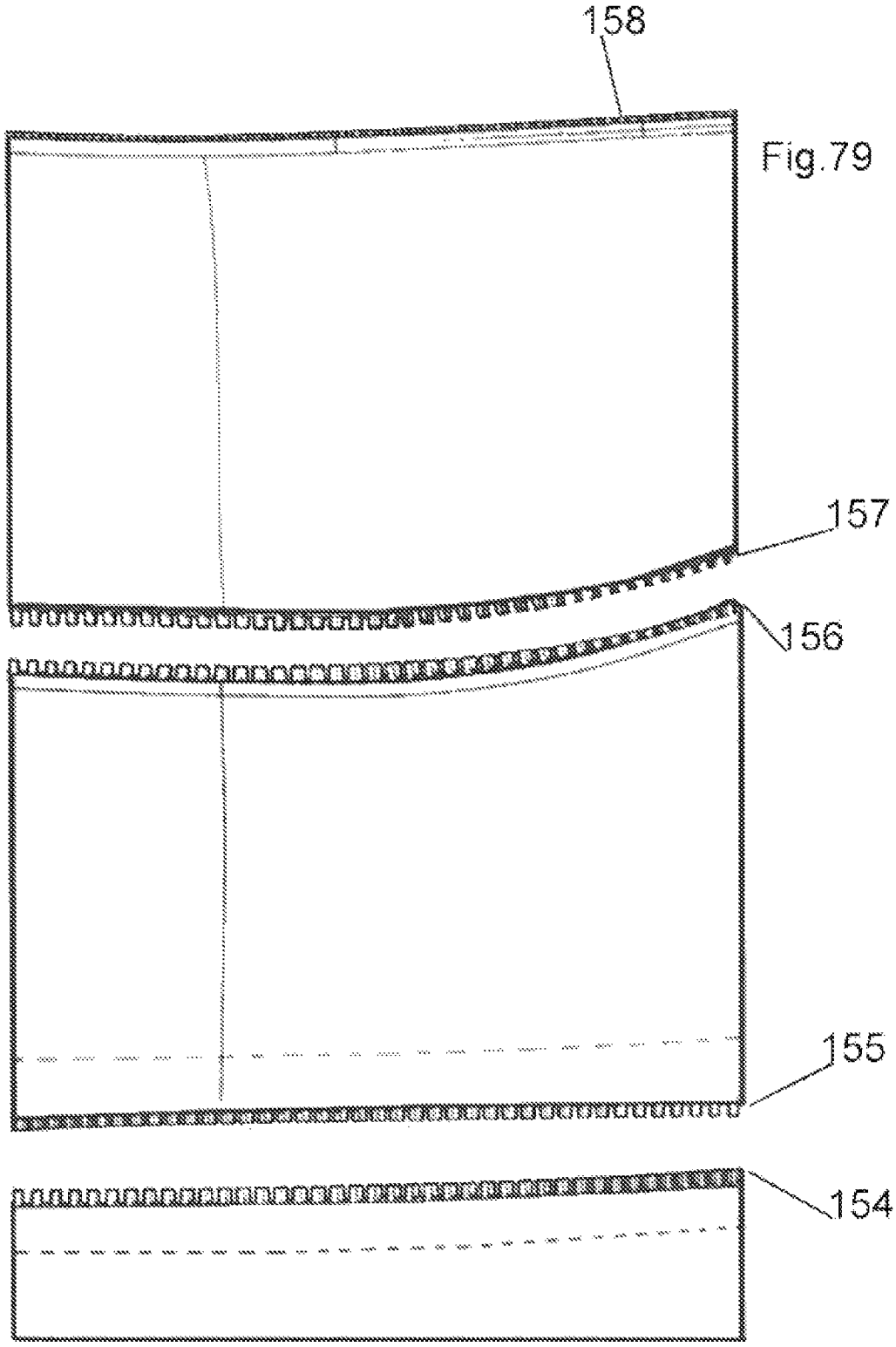
FIG. 79 shows the rows of teeth of the hinges present at the edges of the modules in relation to the first embodiment.
Figure 80:
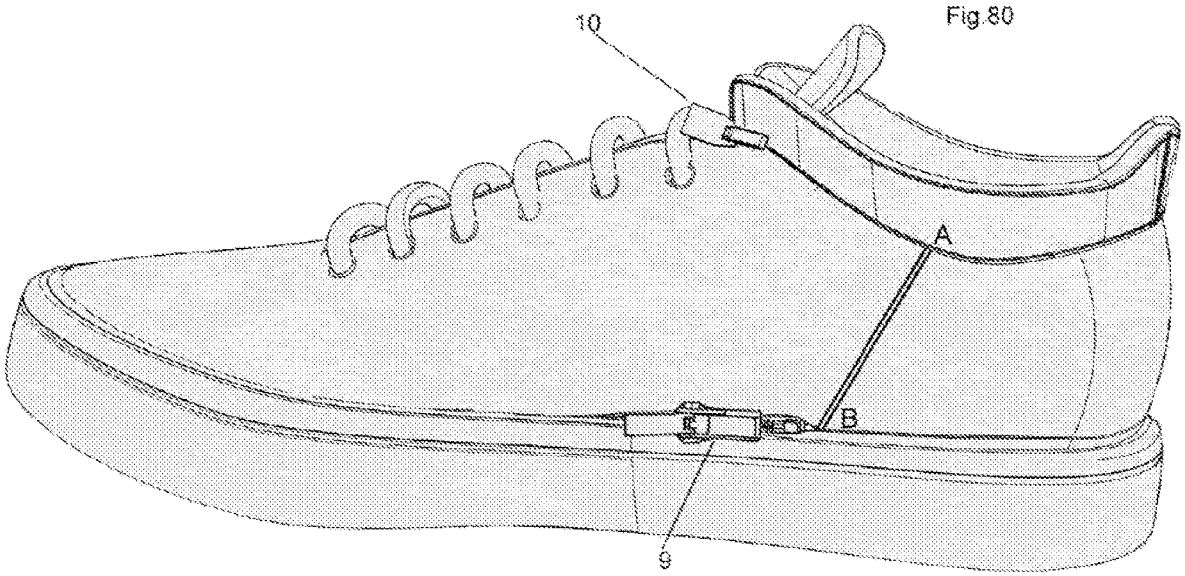
FIG. 80 represents a perspective view of the basic shoe with sliders.

In the present invention, each zip fastener is composed of two rows of complementary teeth, each applied at the respective edge of a module (n. 154-158, FIG. 79). In particular, in a first embodiment, the chain of teeth applied along the upper perimeter edge of the sole module (n. 154, FIG. 79) and the lower perimeter edge of the upper module (n. 111, FIG. 55) is size T5 (n. 155, FIG. 79) and the relative slider is a standard slider (n. 9, FIG. 80). The chain of teeth applied along the upper edge of the upper module (n. 112, FIG. 55) and on the edges of all supplementary modules (n. 156, FIG. 79; n. 157-158, FIG. 79) is of size T3 and the relative cursor is always double-sided (see for example n. 10, FIG. 80).

The connection means are of the sizes indicated above for various reasons. A particular technical problem due to the use of the zip for the shoe of the present invention consists in making its modules perfectly interchangeable when these are the result of industrial production. In other words, it is necessary that any module on the market can be perfectly coupled with the others without creating any defect and, specifically, without an excess of teeth or tissue following their union. It is clear that the number of teeth of each webbing must be the same, but compelling the manufacturer to count the number would certainly be a long and non-functional procedure. A further innovation of the present invention therefore consists in having introduced a functional and fast method that allows all modules to be coupled easily. For this purpose, it is necessary that the teeth are as small as possible, such as T5 or T3, so that the space between one and the other is minimal. The tape of the zipper of each module can then be cut according to the length of the side where it is to be sewn. In fact, the size of the teeth means that strips of equal length automatically correspond to the same number of teeth and, moreover, the space between one and the other tooth does not cause excesses of unsightly or non-functional tissue, leaving holes in the closure of the hinge. Furthermore, a chain with small teeth is more pleasing from an aesthetic point of view, which will be particularly appreciated with reference to the modules supplementary to the basic shoe.

Finally, each of the modules described above, due to its unique characteristics, has specific packaging methods also with reference to the connection means in question.

For example, the cup of the slider is always applied to the sole module at a predetermined point of the medial longitudinal arch of the foot (FIG. 80) which is identified by drawing an imaginary perpendicular line that joins the instep A to the plantar arch B seen flat. Said cup is then positioned in the connection module of the upper sole at the point of intersection between such perpendicular line and the foot arch itself. This has the obvious advantage that the cursor is positioned in a point of the shoe that does not cause any discomfort for the user, and is also more protected, being on the internal side (see for example FIG. 8).

Figure 81:
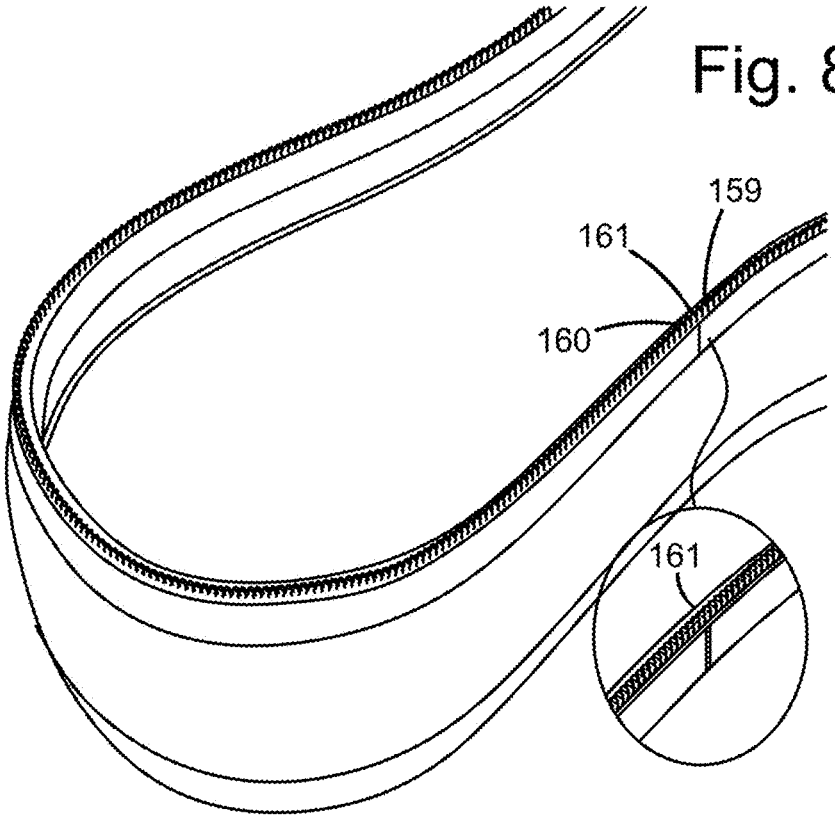
FIG. 81 represents a perspective view of a portion of the sole module with focus on the ends of the belts that make up the upper sole module.

Between the cup of the chain slider (n. 159, FIG. 81) and the stop (n. 160, FIG. 81)) there is a space of approximately 7 mm (n. 161, FIG. 81). This device allows the user to engage the sole module with the upper module with extreme ease, precisely because the space between the stop and the cup allows the cursor to be correctly housed and facilitates the movements of the fingers to open/close the zipper. Furthermore, by moving the cursor, it is possible to appreciate the ease of its sliding along the track created by the two belts that make up the joining module.

Figure 82:
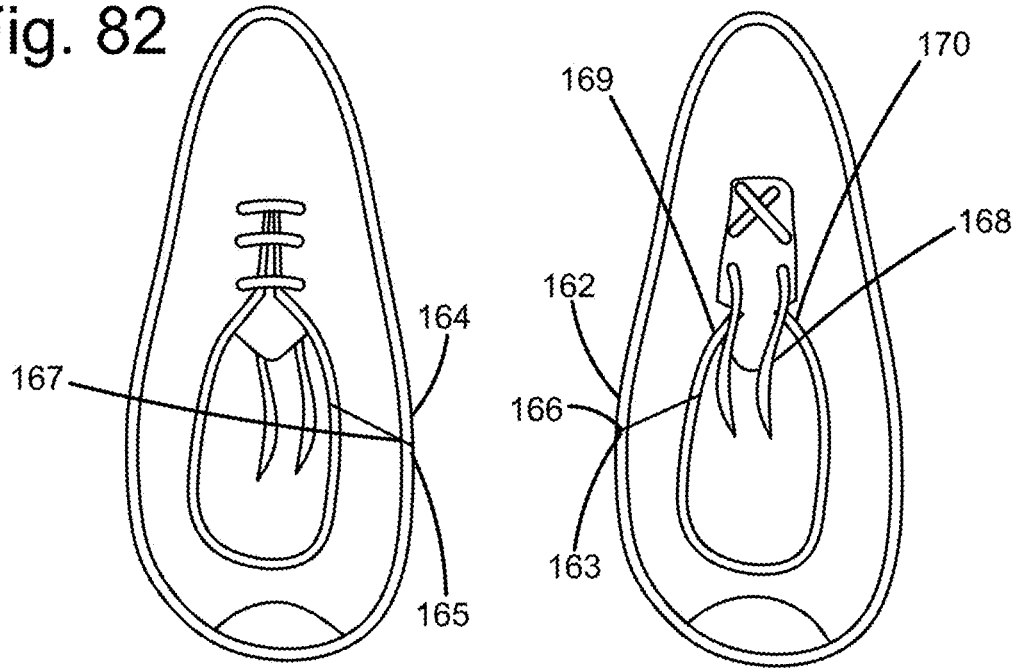
FIG. 82 represents the upper module with zip and rivet, right and left.

In detail, the ribbons of the aforementioned module, which in this embodiment do not have their ends sewn together (FIG. 81), must be positioned in such a way as to ensure that the cursor turns clockwise in the right shoe (see for example, FIG. 7) and anticlockwise in the left shoe (see, for example FIG. 10) and, therefore, the pin of the zipper must always be positioned in the front part of the upper (n. 162 and 164, FIG. 82). Only by positioning the pin in this way can it be inserted into the cup of the slider even when the upper module is overturned to ensure perfect interchangeability. In fact, it is clearly impossible and impracticable to foresee that the zipper turns in the same direction for both shoes, right and left, when overturned, given that once the upper has been overturned, its pin—which was previously in correspondence with the cursor—is on the opposite side with respect to the same, with the impossibility of committing to the same.

Now it is evident that the upper module is bilateral, that is, it can be switched from the right side to the left side of the shoe when turned over on itself to create the double-sided effect. This has a significant advantage in terms of greater aesthetic appeal, given that the shape of the upper will respect the anatomy of the foot.

In the present invention, the slider is never positioned on the upper (for example, FIG. 82), which will always have two zip chains equipped only and exclusively with a pin (n. 162 and 164, FIG. 82) and a stop (n. 163 and 165, FIG. 82), which will be particularly appreciated by the user in light of the fact that the cost of the multiple uppers purchased to compose different footwear will not be increased by the cost of the slider, that is to say the most expensive than the zipper. Indeed, in a modular shoe it will be the upper module that will be replaced several times, while the sole module will be almost unique.

Pin and zip fastener located along the outer edge of the upper module are positioned as follows: by placing the module vertically and placing us in front of it (FIG. 82), the pin will be positioned above the stop at a distance of about 7 mm (n. 166 and 167, FIG. 82), mirroring what is foreseen in the connection module of the upper sole (n. 161, FIG. 81).

A small tab (n. 176, FIG. 83) is inserted between the shapes of the upper module and, precisely between the pin and the stop, in order to cover the corresponding space between the pin and the stop of the upper sole joining module where it is located. the slit originating from the non-sewing of the ends of its ribbons between them. The reason for the provision of such a tab is both functional and aesthetic, given that, by means of it, the slot is completely closed and hidden.

As regards the zip located along the upper edge of the upper module, the pin (n. 168, FIG. 82) must be at a minimum distance of about 0.5 cm from the end of the ankle loop (n. 170, FIG. 82) so as to be free and not totally covered by the peripheral flaps of the module and in such a way as to ensure the necessary space for the movements that the user will have to make with his fingers to open/close the zip. The stop (n. 169, FIG. 82) is always positioned on the side corresponding to that of the medial longitudinal arch, above the stop of the chain positioned on the lower edge of the upper (n. 163, FIG. 82), while the pin will be always positioned in correspondence with the lateral longitudinal arch.

Figure 34:
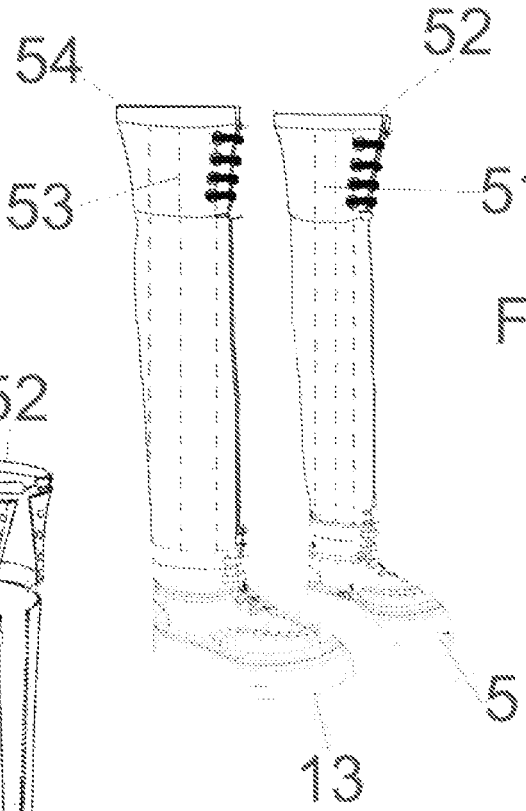
FIG. 34 represents an assembled perspective view of the thigh-high boot according to the present invention, including the sole module, the upper module, the ankle size adapter module, the boot module, the wide thigh size adapter module and the finishing module.

With reference to the upper supplementary modules, including the finishing modules, the cursor, as mentioned, is always double-sided and is applied on the chain of teeth positioned in the lower part of each module (see, for example, FIG. 34).

In the same way as in the modules already described, the pin must be free and not completely covered by the peripheral flaps of the module and in such a way as to ensure the necessary space for the movements that the user will have to make with his fingers to open/close the hinge zip, with the difference that it must be positioned at a minimum distance of 1 cm from the edge of the edge.

Likewise, each additional module is bilateral as it can be used for both right and left footwear depending on which of the two sides is chosen by the user and, therefore, in each module the cursor turns clockwise in the right footwear and counterclockwise in the left footwear.

Finally, according to the present invention, the boot module packaging method has further peculiarities when also the joining means used for the union between its vertical edges is a zip.

In this case, the double-sided slider of the zip that is used to close the module must be positioned in the upper part of the module itself (n.50, FIG. 46), so that the zip always closes from the top towards the bottom, regardless of which side of the module will be chosen by the user as external, which will prevent the hinge from opening due to the stresses caused by the movements of the leg.

Figure 46:
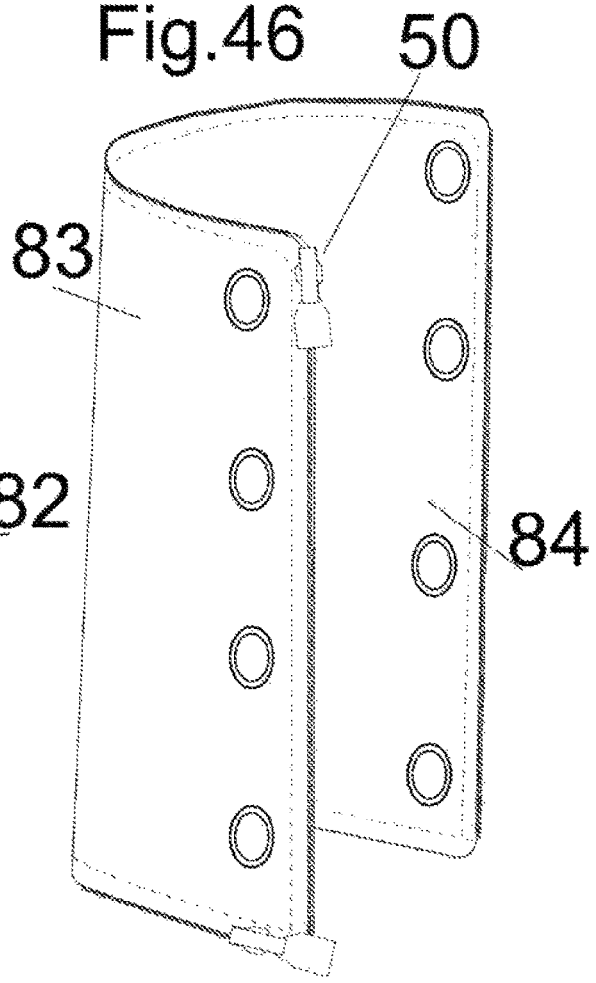
FIG. 46 represents a perspective view of the boot module with vertical closure by means of a zipper and laces.

Even in this case, the pin must be free so as to ensure the necessary space for the user's movements and must be positioned at a distance of about 1 cm from the upper end of the side of the trapezoidal shape (FIGS. 45 and 46).

Compliance with this packaging rule allows both the zip that engages the boot module to the ankle-size adapter module to be closed at the same time, as well as the zip used to close the boot module along its vertical, since it is neither physically nor mechanically possible that two chains of zip fasteners, one placed vertically, one placed horizontally, can cross.

Figure 84:
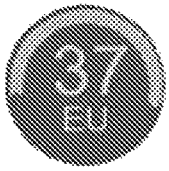
FIG. 84 represents a front view of the rivet with size and coupling direction.

Considering that in this first embodiment of the connection system between the modules, each of the modules is bilateral, on each head of the rivet applied to them there is, in addition to the additional information indicated above, an arrow indicating their direction of coupling and the sliding one of the cursor (n. 175, FIG. 84). The aim is clearly to facilitate and indicate to the user the methods of composition of the shoe.

Second Embodiment of the Connection System Between the Modules

Figures 85, 86:
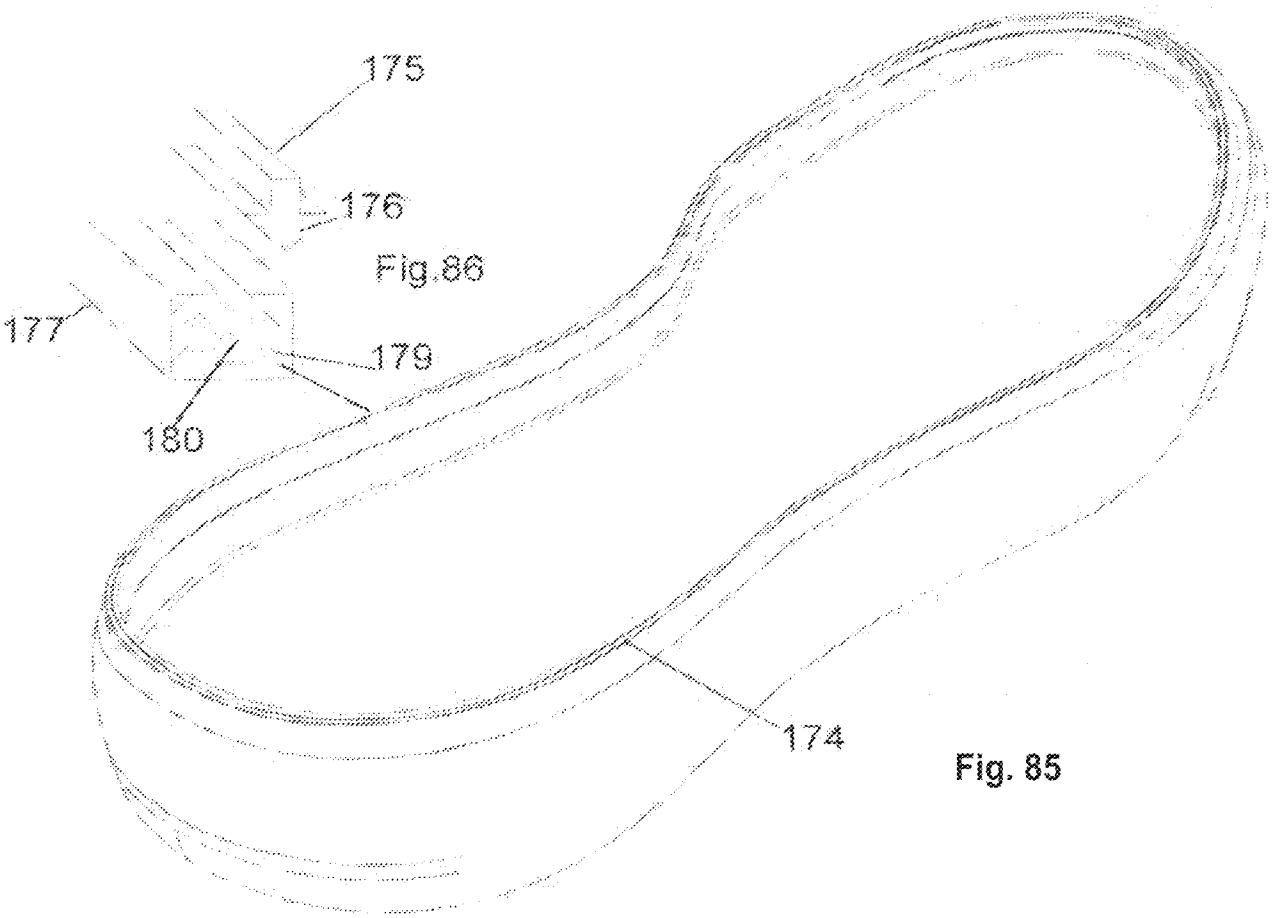
FIG. 85 represents a perspective view of the sole module with connection means by means of a sheath.
FIG. 86 represents a perspective view of a portion of the sheath.
Figures 87, 88:
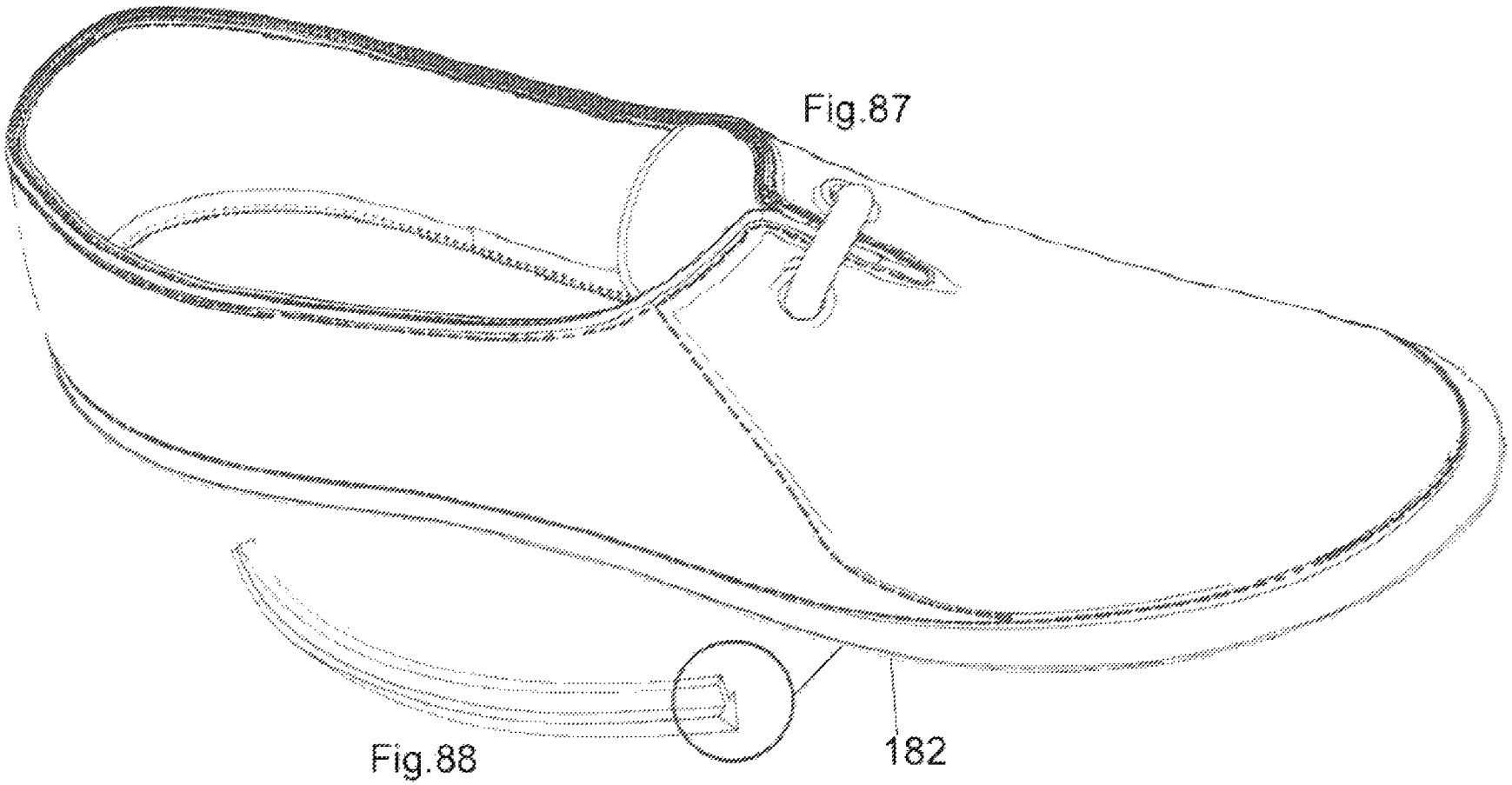
FIG. 87 represents a perspective view of the upper with a means of connection by means of a sheath.
FIG. 88 represents a focus on the male sheath.
Figure 93:
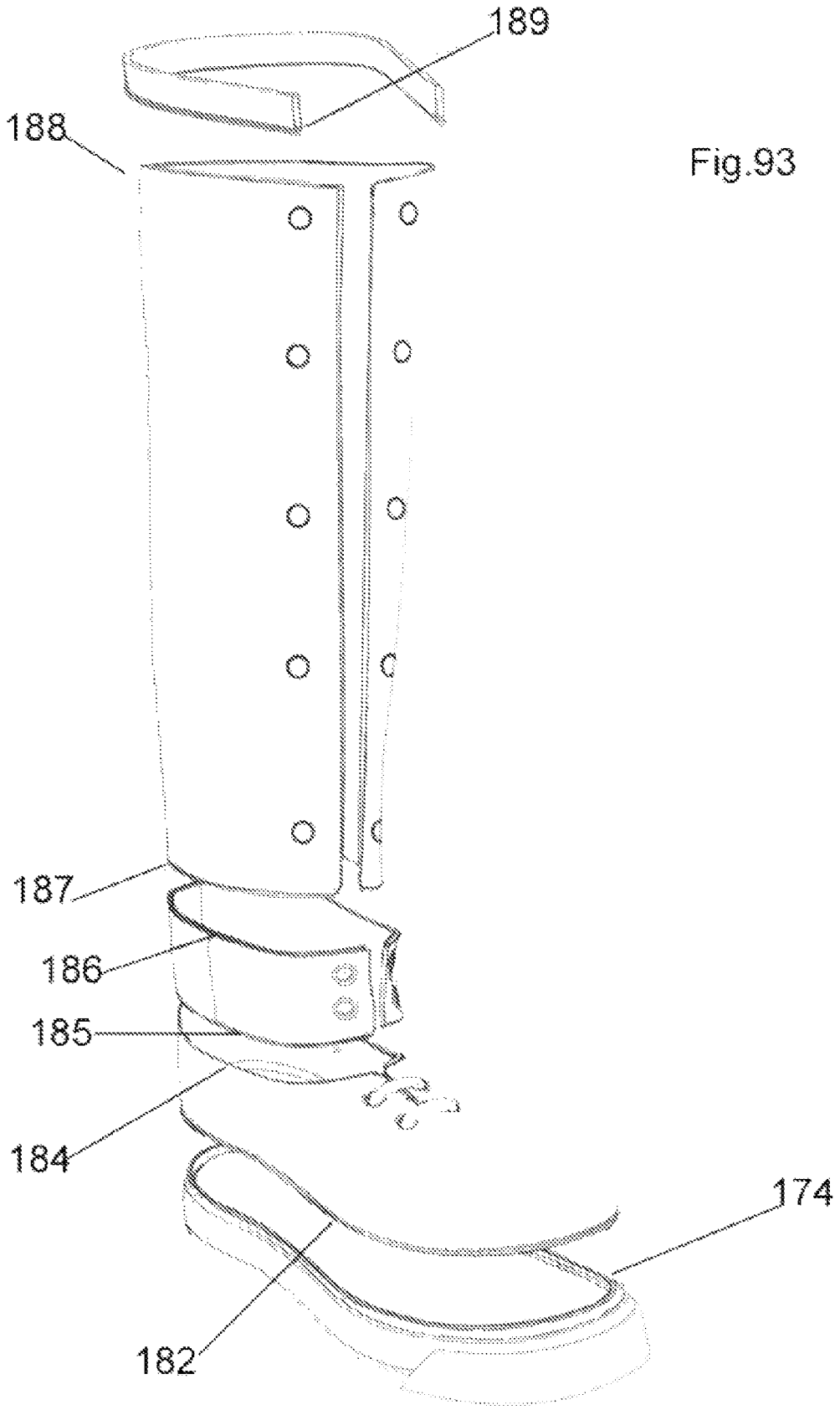
FIG. 93 represents an exploded view of the complete shoe according to the present invention with connection means by means of a sheath.

In the second embodiment of the present invention, the means of connection between the modules is constituted by a pressure sheath of silicone rubber or other similar material which runs along the perimeter of the single module (n.174, FIG. 85, n.182, FIG. 87, n. 174, 182, 184-189, FIG. 93).

In particular, said means of conjunction consists of the union of two parts, one so-called male (n. 175, FIG. 86) and the other so-called female (n. 177, FIG. 86).

In all modules, the male sheath is located in the lower perimeter of the module (n. 182, FIG. 87, n. 185, 187, 189, FIG. 93) and has an arrow-shaped front section (n. 176, FIG. 86). On the contrary, the female sheath is located in the upper perimeter of the module (n. 174, FIG. 85, n. 184, 186, 188, FIG. 93) and has a rectangular vertical section (n. 179, FIG. 86), whose internal cavity is of the same shape as the aforementioned arrow of the male sheath (n. 180, FIG. 86).

Clearly, in the sole module there is only the so-called female sheath, while in the finishing modules there is only the so-called male sheath. Furthermore, in the sole module and, in particular, in the one for joining the sole to the upper, unlike the first embodiment indicated above, the ends of the belts are sewn together, therefore, without interruption (FIG. 85), provided that there is no longer the need for the user to handle them in order to insert the pin into the cup of the zipper slider. Finally, the ends of the sheath are joined together by heat sealing, so that it appears as a single body without interruptions. Similarly, the ends of the sheath present in the upper module on the lower edge are also joined together by heat sealing.

Figure 89:
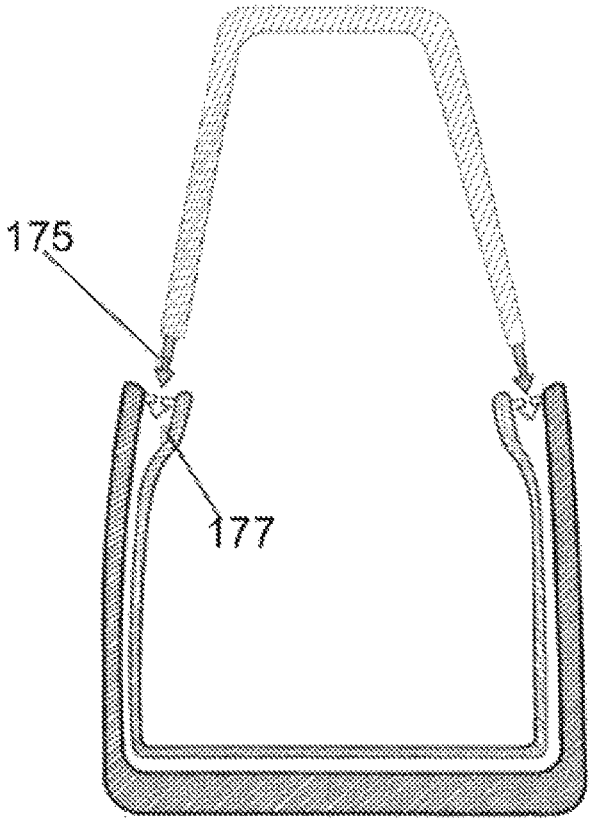
FIG. 89 shows a section of the male and female sheaths not joined together.
Figure 91:
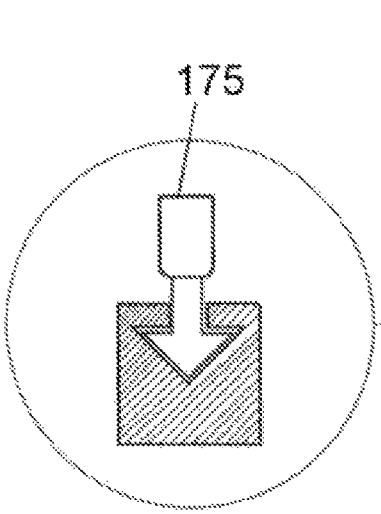
FIG. 91 represents a focus on the section of the male and female sheaths joined together.
Figure 90:
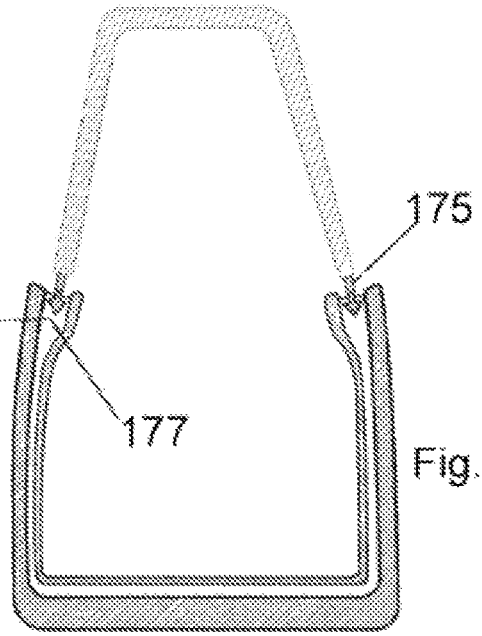
FIG. 90 is a section of the male and female sheaths joined together.
Figure 92:
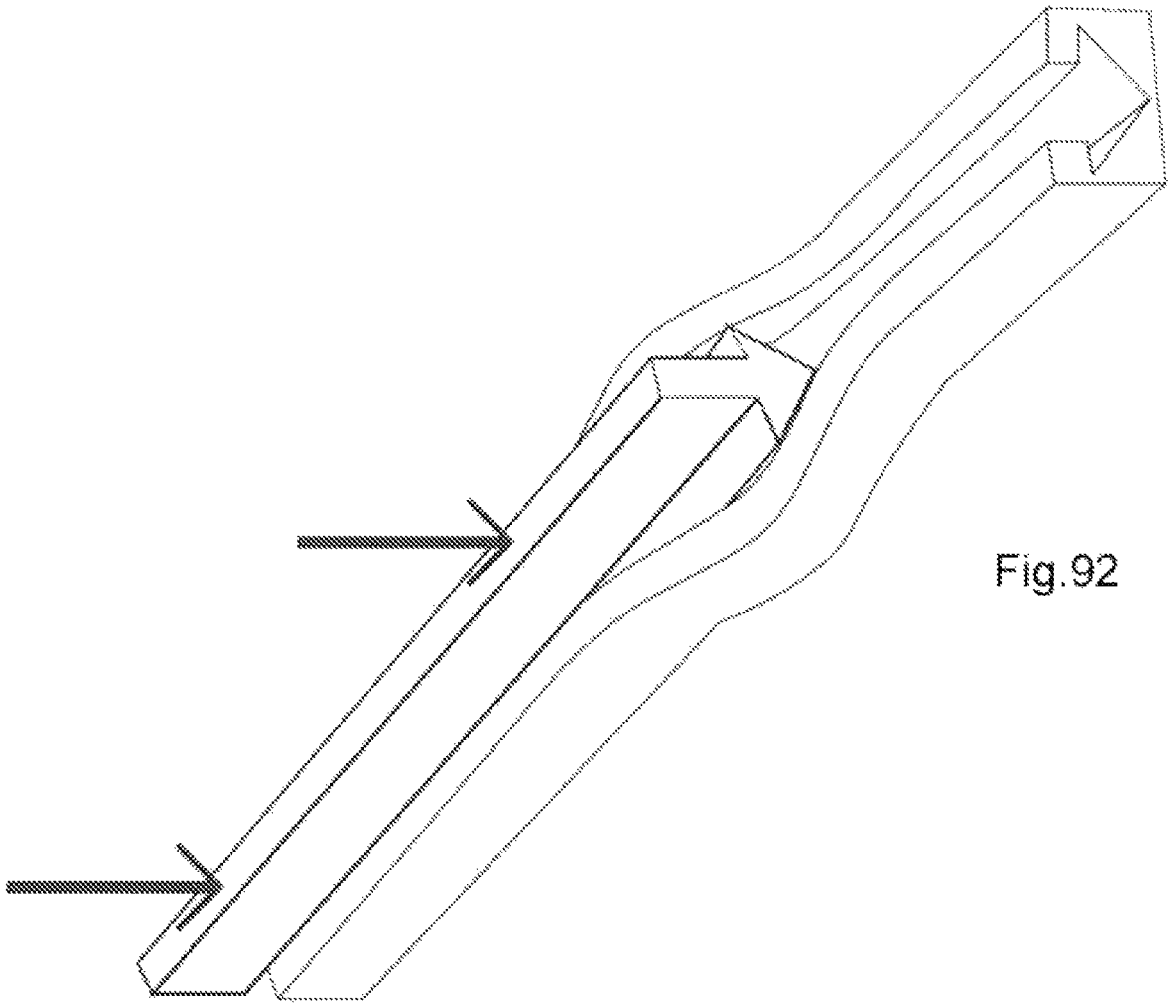
FIG. 92 shows how the male sheath and the female sheath are attached.

The union between the various modules takes place by means of the pressure exerted by the user on the male sheath in contact with the female sheath (FIG. 92). Once the first is inserted into the second, the joint between the two sheaths will be simple and immediate (n. 175 and 177, FIGS. 89, 90 and 91). It therefore appears evident that the modules of the present invention are not necessarily bilateral when the connection means used for their use is the one in question. In fact, the union between the so-called sheath male and female takes place by means of pressure so that their obligatory direction of conjunction is not foreseen and/or imposed.

The stability of the union between the modules is given by the peculiar shape of the sheath. In particular, the 90° angle formed between the arrow shaft and its tip (n. 176, FIG. 86) ensures that the male sheath does not come off the female during the user's walk, even after opposing forces weighing on one or the other part of the sheath. In fact, the internal cavity of the female sheath mirrors the shape of the aforementioned arrow (n. 180, FIG. 86) so that the male sheath, once inserted into the female sheath, completely fills the latter (FIG. 91). Indeed, the vertical section of the two sheaths joined together corresponds to a full rectangle (see also FIG. 91).

The aforementioned type of connecting means for footwear is partially already known in the current state of the art. However, each of said connection tools provides, for the coupling of the modules, the interlocking of the so-called male part with the so-called female part and their subsequent flow until complete conjunction. This entails the obvious drawback that, for example, it will not be possible to perfectly interchange the upper with the sole. In fact, the shape of the shoe itself does not allow it to slide along its entire perimeter. The fact that, in today's state of the art, the interchangeability between sole and upper by means of sliding is ample proof of this, is provided only for parts of the shoe (U.S. Pat. No. 4,363,177 or 2020040026264).

It will therefore certainly be appreciated that the shoe of the present invention in accordance with the second embodiment allows complete, simple, durable and functional interchangeability between the various modules by means of a sheath having the full length of the edge of the module to be joined.

In conclusion, the modular system of the shoe of the present invention as conceived and described is susceptible of numerous modifications and variations, all included within the scope of the inventive concept as claimed. Likewise, also the means of connection between the modules is susceptible to numerous modifications and variations and may have other embodiments without thereby departing from the protective scope of the present invention as claimed.

All above described details can be replaced with other technically equivalent elements and all materials used, as well as the contingent shapes and sizes, can be of any type conforming to the needs, without thereby departing from the protective scope of the following claims as claimed below.

The invention claimed is:

1. A modular system for composing footwear assembled by combining at least two interchangeable modules connected in a removable way by connection means, the interchangeable modules comprising:

a sole module removably connectable to an upper module and comprising a sole of elastic material, along an edge of which a joining module is a fixed upper sole comprising connection means between the modules for removably connecting the sole module to an upper module, the upper module removably connectable to the sole module and connectable to upper modules by means of connection means connected to its edge, a tab module removably connectable to the upper module by means of connection means connected to lateral sections of the tab module and to an upper part of the upper module, an ankle-cutting adapter module removably connectable to the upper module and to upper modules by means of connection means connected to lower and upper edges and/or to vertical sides, a boot module removably connectable to the corresponding ankle-cutting adapter module and to the upper modules by means of connection means connected to the lower and upper edges and/or to the vertical sides, a thigh size adapter module removably connectable to the corresponding boot module and to the upper modules by means of connection means connected to the lower and upper edges and/or to the vertical sides, a finishing module removably connectable to the corresponding lower modules by means of connection means to the lower edge.

2. The modular system of claim 1, wherein the sole module comprises a preformed sole of elastic material which comprises an inner shell along the edge of which the upper sole connection module is fixed on a perimeter.

3. The modular system of claim 2, wherein the sole module comprises a midsole housed on a bottom of the inner shell and fixed to the sole joining module upper at its edge.

4. The modular system of claim 1, wherein the connection means comprise a webbing, and in that the module for joining the upper sole comprises two belts sewn together, of length corresponding to an inner perimeter of the sole and of sufficient height to cover the connection means, between which a strap of the connection means is inserted.

5. The modular system of claim 1, wherein the ankle-cutting adapter module has a substantially trapezoidal or rectangular geometry seen in plan and a length of variable upper perimeter edge to be adapted to a circumference of a user's ankle.

6. The modular system of claim 1, wherein the thigh size adapter module has a substantially trapezoidal or rectangular geometry seen in plan and a variable length of an upper perimeter edge to fit a user's thigh circumference.

7. The modular system of claim 1, wherein the tab module has a variable height according to the height of the footwear made by a user and such as to cover only an instep of a foot, and/or an ankle and/or a leg.

8. The modular system of claim 1, wherein the modules are made by sewing at least one shape of water-repellent material on an internal side of each module.

9. The modular system of claim 1, wherein the means for connecting the modules comprise zippers comprising a webbing, a slider and/or a pin and/or a stop.

10. The modular system of claim 9, wherein in each module the slider of the zippers turns clockwise in the right footwear and counterclockwise in the left footwear.

11. The modular system of claim 10, wherein in the sole module a cup of the slider is applied at a point of intersection between a plantar arch and a perpendicular line which, seen in plane, joins an instep to the plantar arch.

12. The modular system of claim 11, wherein in the sole module a zipper tape is equipped with a slider, in the upper module zipper tapes are exclusively equipped with pin and stop, in the upper modules a cursor is double-sided and is positioned on the tape located on the lower edge.

13. The modular system of claim 1, wherein the connecting means of the modules comprise a pressure sheath comprising a male part and a female part.

14. The modular system of claim 13, wherein the male part is located in a lower perimeter of each module and has an arrow-shaped front section, and in that the female part is located in an upper perimeter of each module and has a rectangular vertical section having an internal cavity of a same shape as an arrow of the male sheath.

15. The modular system of claim 1, wherein the connection means are shielded on both their sides with peripheral flaps which constitute the edges of each module.

16. The modular system of claim 1, wherein each module is double-sided, that is, can be folded so that two surfaces can be used as an exterior of the shoe.

* * * * *